United States Patent [19]

Karasawa et al.

[11] 4,413,899

[45] Nov. 8, 1983

[54] COPYING METHOD AND APPARATUS

[75] Inventors: Shuichi Karasawa, Kokubunji; Fuyuhiko Matsumoto, Wako; Shuichi Tsushima, Tokyo; Masatoshi Saitou; Tsutomu Ishida, both of Machida; Kunihiko Ikeda, Kodaira; Masao Yoshikawa, Machida; Tsutomu Sato, Kawasaki, all of Japan

[73] Assignee: Ricoh Company, Ltd., Japan

[21] Appl. No.: 229,730

[22] Filed: Jan. 29, 1981

[30] Foreign Application Priority Data

| | | | |
|---|---|---|---|
| Jan. 30, 1980 | [JP] | Japan | 55-8705 |
| Jan. 31, 1980 | [JP] | Japan | 55-9362 |
| Jan. 31, 1980 | [JP] | Japan | 55-9363 |
| Jan. 31, 1980 | [JP] | Japan | 55-9364 |
| Jan. 31, 1980 | [JP] | Japan | 55-9365 |

[51] Int. Cl.[3] ..... G03G 15/01

[52] U.S. Cl. ..... 355/4; 355/14 R; 355/14 TR; 430/43; 430/44

[58] Field of Search ..... 355/4, 14 R, 14 D, 14 TR; 430/42, 43, 44, 54, 57

[56] References Cited

U.S. PATENT DOCUMENTS

| | | | |
|---|---|---|---|
| 4,045,218 | 8/1966 | McVeigh | 355/4 X |
| 4,099,860 | 7/1978 | Connin | 355/14 C |
| 4,189,224 | 2/1980 | Sakai | 355/4 |

*Primary Examiner*—A. C. Prescott

*Attorney, Agent, or Firm*—Guy W. Shoup; Gerard F. Dunne; Eliot S. Gerber

[57] ABSTRACT

A copying method for producing duplicates of an original of at least two colors by using a composite photosensitive member including more than two photosensitive layers, wherein the photosensitive member is subjected to charging more than twice and exposed to an optical image of the original more than once by changing charging and exposing conditions, to vary charge carried on the surface and in the interior of the photosensitive member. This causes two types of electrostatic image to be formed on the surface of the photosensitive member; one type includes image regions having a positive surface potential, a negative surface potential and a substantially zero surface potential respectively and the other type includes two image regions having different surface potentials of same polarity respectively, and one image regions of substantially zero surface potential, depending on differences in color between image regions of the original corresponding to the image regions on the photosensitive member. By suitably selecting charging and exposing conditions, it is possible to selectively carry out, by using a single copying apparatus, a copying mode in which duplicates are produced in several colors, a copying mode in which duplicates are produced in one color and a copying mode in which image regions of one color are erased.

11 Claims, 76 Drawing Figures

α WHITE β

α WHITE β

α WHITE β

α WHITE β

α WHITE β

COPYING METHOD AND APPARATUS

BACKGROUND OF THE INVENTION

This invention relates to a method of switching the copying apparatus from one copying mode to another suitable for use in duplicating a two-color original and an apparatus therefor.

In producing duplicates of a color original or a two-color original having information shown in two colors or black and red, several copying modes are available nowadays. One of them is a copying mode in which all the colors of the original are reproduced with high fidelity. Another copying mode is one in which the reproduction of the original is in the form of an image in black only or in any one color as desired. In still another mode, the information shown in one of the colors in the original is reproduced in the same color but the information shown in the other color is erased.

Various methods have been proposed and are now known for carrying out the copying of a color original or a two-color original in such a manner that the colors of the original are reproduced with high fidelity or that the original is reproduced as an image in black only.

In general office routine in which copying apparatus are utilized, the number of originals containing information shown in black or blue and red on white paper is on an increase, and it is expected that this type of originals will account for the majority of the documents handled in office routine in the near future. The copying modes that have the highest demand in producing duplicates of such two-color originals include a copying mode in which information is copied in two colors with high fidelity, and a copying mode in which the images formed as duplicates are in one color only, such as black or red. The copying mode next in demand is one in which information in one color is reproduced while information in other color is erased.

Copying methods known in the art are all intended to enable one of such copying modes to be carried out. Thus when it is necessary to carry out more than two copying modes, it has hitherto been necessary to have more than two copying apparatus of different types ready for use. This has caused an increase in office expenses.

SUMMARY OF THE INVENTION

This invention has been devloped for the purpose of obviating the aforesaid disadvantage of the prior art. Accordingly, the invention has as its object the provision of a method of switching the copying apparatus for handling two-color originals from one copying mode to another so that any one of several copying modes can be selectively carried out as desired.

To enable one copying mode to be readily selected from a plurality of copying modes and carried out instantly, it is necessary that photosensitive members and the copying steps, such as charging, exposing, developing and transfer-printing, should be commonly used as much as possible for all the copying modes while effecting ON-OFF control of such steps that cannot be shared by all the copying modes, or that the plurality of copying modes be separately carried out by readily switching the steps from one operating condition to another to suit the copying mode selected.

According to this invention, the aforesaid object is accomplished by using a composite photosensitive member including more than two layers and forming three types of electrostatic latent image rigions on the photosensitive member by using a combination of more than two charging steps and more than one exposing step, such three types of electrostatic latent image portions consisting of either an image portion of positive polarity, an image portion of negative polarity and an image portion of a potential approximate to zero (including a potential that can be rendered approximately zero by application of a bias voltage at the time of developing) or two image portions of same polarity and different potentials and one image portion of a potential approximate to zero.

To simplify explanation, the description set forth hereinabove and the description set in hereinafter will refer to what is called copying for reproducing the contents of an original bearing information. It is to be understood, however, that the present invention is not limited to copying in the ordinary sense of the term and can have application in an electrostatic recording apparatus and a facsimile apparatus utilizing a printer in which latent images are formed by means of digital light signals and digital electric signals, such as OFT printer, Laser printer, multi-stylus printer, etc. It is to be understood that the term "copying" as used in this specification and the claims attached thereto is used in a broad sense and covers such operations as are carried out by using the aforesaid printers.

A photosensitive member used in performing copying according to the invention is in the form of a composite photosensitive member comprising a conductive base plate 1*a*, and at least two layers or a first layer 1*b* and a second layer 1*c* superposed over the conductive base plate 1*a* as shown in FIG. 1*a*. At least one of the first layer 1*b* and the second layer 1*c* is in the form of a photoconductive layer, and the other layer is in the form of an insulating layer or a photoconductive layer. If necessary, a composite photoconductive layer comprising more than three layers superposed on the conductive base plate may be used.

One example of the composite photosensitive member may comprise a photoconductive layer (SeTe, for example) as the first layer, and a transparent insulating layer (polyester) as the second layer. Another example may comprise a photoconductive layer (SeTe, for example) as the first layer and a photoconductive layer (formed of 4P-dimethylaminophenyl-2,6-diphenylthiapyrylium perchlorate, 4,4-bis (diethylamino)-2,2'-dimethyltriphenylmethane and polycarbonate) as the second layer. These are examples of the composite photosensitive members having two layers superposed over the conductive base plate, but there are many other combinations of the two layers.

In examples of the composite photosensitive layers having two photoconductive layers superposed over the conductive base plate, various combinations are available depending on the material of the photoconductive layers. For example, photoconductive layers of high sensitivity and low sensitivity to one of chromatic colors may be combined with each other. Also, other combinations may be obtained by taking into consideration the rectifying property at the time of charging.

An intermediate layer 1*d* (a coat of methanol solution of a phenol resin including methylene blue, for example) may be provided between the first layer 1*b* and the second layer 1*c* (FIG. 1*b*).

When any one of the aforesaid photosensitive members is used in carrying out copying of an original in two colors, copying conditions may vary depending on the type of the specific photosensitive member used. Also, copying conditions may vary depending on the specific copying mode used when copying is effected on information shown in two colors or color $\alpha$ (black, for example) and color $\beta$ (red, for example).

There are five types of copying modes as follows:

Copying mode 1 in which copying is carried out in two colors used in the original or in other two colors.

Copying mode 2 in which all the information contained in the original is formed as an image in one color. This copying mode is subdivided into copying mode 2*a* in which copying is carried out in color $\alpha$ (black, for example), and copying mode 2*b* in which copying is carried out in color $\beta$ (red, for example).

Copying mode 3 in which the information shown in one color in the original is reproduced while the information shown in the other color is erased. This copying mode is also subdivided into copying mode 3*a* in which the information in color $\alpha$ (black, for example) is reproduced while the information in color $\beta$ (red, for example) is erased, and copying mode 3*b* in which the information in color $\beta$ (red, for example) is reproduced while the information in color $\alpha$ (black, for example) is erased.

As set forth hereinabove, a plurality of types of photosensitive members and a plurality of types of copying modes are available. In order that copying may be carried out in the same copying machine by selecting a desired photosensitive member from several types of photosensitive members and in a desired copying modes selected from among the several copying modes, it is necessary that charging, exposing, developing and transfer-printing steps of the copying process followed by the electronic copying machine be commonly performed as much as possible for all the copying modes. Moreover, in a copying machine which has a tendency to high speed operation, there is a demand for a simple copying process in which, instead of repeating the same copying process for each color, an electrostatic latent image can be formed in two colors in a condition in which the image portions of different colors can be electrically distinguished from each other in a single process, a visible image having two image portions of two colors can be formed by a single developing operation (including cases in which image portions of colors $\alpha$ and $\beta$ are simultaneously developed and cases in which they are developed successively in chronological sequence), and the visible image on the photosensitive member can be printed in one transfer-printing operation on copy sheets.

Experiments and researches conducted by us have shown that a plurality of copying modes having different copying conditions can be selectively carried out in the same copying machine by using a copying process in which more than two charging operations and one or more than two exposing operation are used in combination.

Figure 1A:
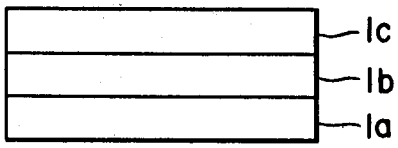
FIG. 1 is a sectional view of the photosensitive member in explanation thereof, a and b show different examples.

The changes in the electric charge are shown in models to facilitate understanding of the relation between the polarities of the electric charge and do not represent the actual conditions of the electric charge.

DESCRIPTION OF THE PREFERRED EMBODIMENTS

The copying process according to the invention enabling copying to be carried out in the same copying machine using different types of photosensitive members and in different copying modes will now be described by referring to the drawings.

In the description set forth hereinafter, the invention will be described with respect to six different types of photosensitive members including: I. a composite photosensitive member having an insulating layer (upper layer, hereinafter U layer), a photosensitive layer (lower layer, hereinafter L) and a conductive base plate superposed one over another in the indicated order, with an intermediate layer being located between the U layer and the L layer when desired; II-A a photosensitive member including a photoconductive layer (U layer) sensitive to light of color $\beta$, a photoconductive layer (L layer) insensitive to light of color $\beta$, and a conductive base plate superposed one over another in the indicated order; II-B a photosensitive member including a photoconductive layer (U layer) insensitive to light of color $\beta$, a photoconductive layer (L layer) highly sensitive to light of color $\beta$ and a conductive base plate superposed one over another in the indicated order; II-C a photosensitive member including a photoconductive layer (U layer) sensitive to light of color $\beta$, a photoconductive layer (L layer) transmitting light of color $\alpha$ and substantially insensitive to light of color $\beta$, and a conductive base plate superposed one over another in the indicated order; II-D a photosensitive member including a photoconductive layer (U layer) transmitting light and highly sensitive to color $\beta$, a photoconductive layer (L layer) substantially insensitive to light of color $\beta$ when charged, and a conductive base layer superposed one over another in the indicated order; and II-E a photosensitive member including a photoconductive layer (U layer), a photoconductive layer (L layer) and a conductive base plate superposed one over another in the indicated order, with an intermediate layer being interposed between the U layer and L layer when desired, generally referred to as a triple-layer photosensitive member.

Figure 1B:
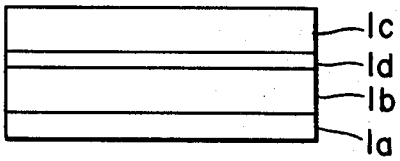

I. A Composite Photosensitive Member of Type I Shown in FIG. 1

(1) Copying Mode 1

Copying steps are followed in the order described hereinafter.

(i) Primary Charging of the Photosensitive Member Positively or Negatively

Figure 2A:
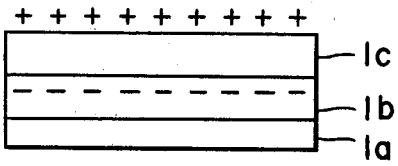
FIGS. 2–5 are views in explanation of the composite photosensitive member having a conductive layer and an insulating layer, FIGS. 2 and 4 being schematic views showing different examples of changes in electric charge occurring in copying mode 1, and FIGS. 3 and 5 being views showing changes in surface potential corresponding to FIGS. 2 and 4 respectively.
Figure 3:
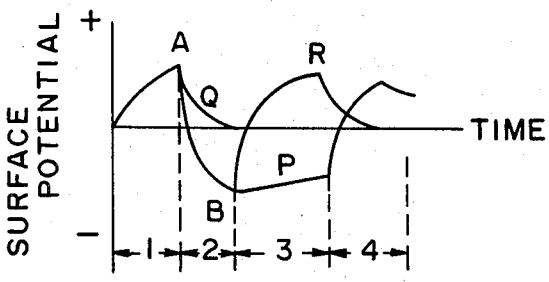

In step 1, the photosensitive member is positively charged in the dark by a primary charger as shown in FIG. 2*a*. The surface of the U layer 1*c* is positively charged, and the electrons are introduced from the conductive base plate 1*a* into the L layer 1*b* to negatively charge a portion of the L layer 1*b* near the boundary between the L layer 1*b* and U layer 1*c*. The surface potential of the photosensitive member is positive as shown at a point A in FIG. 3.

Figure 2D:
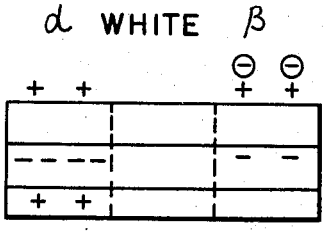
Figure 2B:
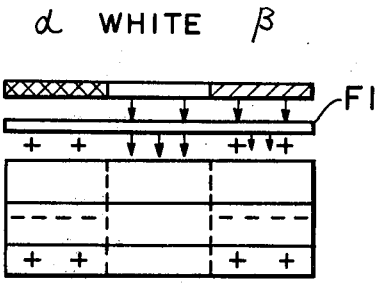

(ii) Secondary Charging of the Photosensitive Member with Polarity Opposite That of Primary Charging Simultaneous as Exposure to an Optical Image of the Original through a Filter Blocking Light of Color $\beta$ Being One of the Chromatic Colors When color $\beta$ is red, the photosensitive member is exposed to an optical image of the original through a cyan filter as shown in FIG. 2*b* as step 2. The L layer 1*b* in regions of the photosensitive member corresponding to the white regions of the original (the background of the image, for example) becomes conductive. The electric charge on the surface is neutralized, so that the electric charge in the L layer 1*b* disappears. In regions corresponding to the regions of color $\beta$ or red, for example, the light is blocked. In regions corresponding to the regions of color $\alpha$ or black, for example, the photosensitive member is hardly exposed. Thus both the L layer 1*b* and U layer 1*c* remain insulating. The secondary charging neutralizes almost all the surface electric charge of the photosensitive member while allowing a portion of the electric charge to remain intact, so that the conductive base plate 1*a* is negatively charged. The surface potential of the photosensitive member changes from positive to negative in regions corresponding to the red regions and black regions of the oringinal as indicated at a point B in FIG. 3. At this time, the potential of regions corresponding to the white regions of the original becomes almost zero as represented by a curve Q.

(iii) Exposing of the Photosensitive Member to an Optical Image through a $\beta$ Color Transmitting Filter In step 3, the photosensitive member is exposed to an optical image through a red color transmitting filter, for example.

Figure 2E:
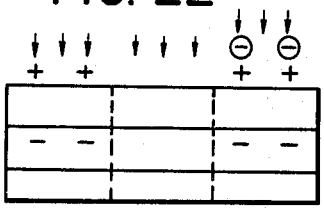
Figure 2C:
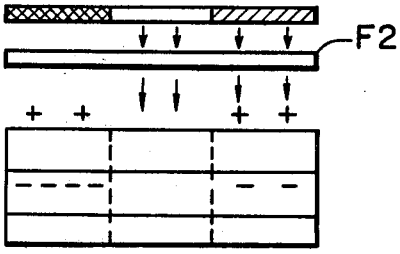
Figure 2F:
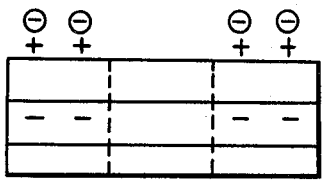

As shown in FIG. 2*c*, regions of the photosensitive member corresponding to the white and black regions of the original remain in the same condition as shown in FIG. 2*b*, but regions corresponding to the red regions have the L layer 1*b* rendered conductive by exposing, so that only the electric charge that is restrained by the surface potential remains in a portion of the L layer 1*b* near the boundary between the L layer 1*b* and U layer 1*c*. The surface potential of the photosensitive member remains substantially zero in regions thereof corresponding to the white regions of the original but shows a change in regions corresponding to the red regions of the original as represented by a curve R in FIG. 3 and becomes zero. In regions corresponding to the black regions of the original, substantially the same potential as indicated at a point B remains intact as represented by a curve R in FIG. 3.

(iv) Developing in Color $\beta$

In step 4, the latent image is developed by using a red toner of negative polarity, for example. As shown in FIG. 2*d*, the toner adheres to regions of positive surface potential of the photosensitive member corresponding to the regions of red color of the original.

(v) Exposing of the Entire Surface to White Light

In step 5, the photosensitive member is exposed to white light. This renders the L layer 1*b* conductive and allows only the electric charge restrained by the surface potential to remain in the L layer 1*b* of regions corresponding to the black regions while the other electric charge in the L layer 1*b* and the electric charge in the conductive plate 1*a* disappear, as shown in FIG. 2*e*. In the photosensitive member, the surface potential of regions corresponding to the white regions remain unchanged, but the surface potential of regions corresponding to the red regions in which developing has caused a reduction in potential becomes substantially zero while the surface potential of regions corresponding to the black regions become positive.

(vi) Developing in Color $\alpha$

In step 6, the latent image is developed with a developing agent containing charged powder of negative polarity, such as black toner. The black toner adheres to regions corresponding to the black regions only that have positive surface potential.

(1') A Modification of Copying Mode 1

Conditions for effecting charging and exposing may be varied depending on the property of the photosensitive member and the characteristics the toner.

(iii) Positive or Negative Primary Charging of the Photosensitive Member

In step 1, the photosensitive member is negatively charged and exposed to white light in its entire surface simultaneously as the charging or immediately thereafter. This charges the surface of the photosensitive member negatively, and a portion of the L layer 1*b* near the boundary between the L layer 1*b* and U layer 1*c* is positively charged. The surface potential of the photosensitive member becomes negative as shown at a point A in FIG. 5.

Figure 4A:
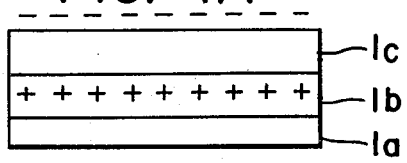
Figure 4B:
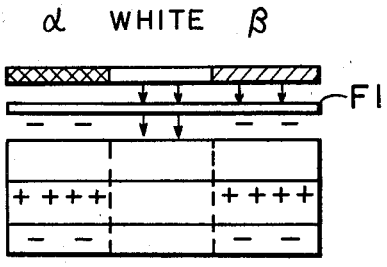
Figure 4C:
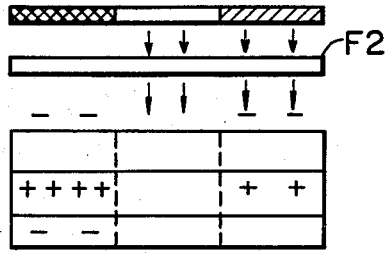

(ii) Secondary Charging with Polarity Opposite That of Primary Charging Simultaneously as Exposing through a Color $\beta$ Blocking Filter In step 2, the photosensitive member is exposed to an optical image through a filter F1 blocking red color as shown in FIG. 4*b*. The L layer 1*b* becomes conductive in regions of the photosensitive member corresponding to the white regions of the original and the surface potential almost disappears after being neutralized by the secondary charging, so that the positive electric charge in the L layer 1*b* also disappears. The red regions are blocked by the filter F1 and the black regions are hardly exposed, so that the L layer 1*b* and U layer 1*c* both remain insulating and the electric charge in the L layer 1*b* remains unaltered. The surface potential is neutralized by the secondary charging and almost disappears while a portion thereof remains intact, so that the conductive base plate 1*a* is a negatively charged accordingly.

Figure 5:
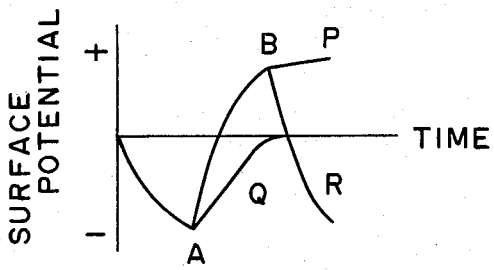

The surface potential of the photosensitive member shows changes shown in FIG. 5. That is, the potential becomes positive in the red and black regions while becoming almost zero in the white regions as represented by a curve Q.

(iii) Exposing the Photosensitive Member to an Optical Image through a Color $\beta$ Transmitting In step 3, the photosensitive member is exposed to an optical image through a red color transmitting filter F2.

As shown in FIG. 4, regions of the photosensitive member corresponding to the white and black regions remain in the same condition as shown in FIG. 4*b*, but regions corresponding to the red regions have the L layer 1*b* rendered conductive by exposing, so that only the electric charge that is restrained by the surface electric charge remains intact in a portion of the L layer 1*b* near the boundary between the L layer 1*b* and U layer 1*c*. The surface potential of regions corresponding to the black regions remains substantially unchanged as represented by a curve P in FIG. 5 but the surface potential of regions corresponding to the red regions becomes negative as represented by a curve R.

(iv) Developing in Color $\beta$

Figure 4D:
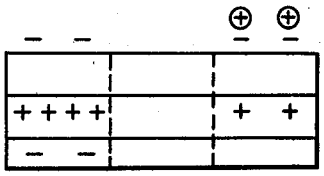

In step 4, the latent image is developed by using a red toner of positive polarity, for example. The developing agent adheres to latent image regions corresponding to the red regions having negative surface potential only, as shown in FIG. 4*d*. No red toner adheres to the black regions because of like polarity.

(v) Developing in Color $\alpha$

Figure 4E:
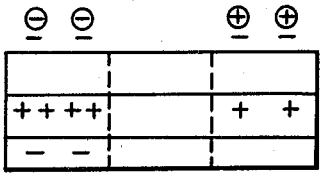

In step 5, the latent image is developed by using a black toner of negative polarity, for example. The developing agent adheres to the latent image portions corresponding to the black regions that have positive surface potential only, as shown in FIG. 4*e*.

(2) Copying Mode 2*a*

Copying is carried out by following the steps set forth hereinafter.

(i) Positive or Negative Primary Charging of the Photosensitive Member

Figure 6A:
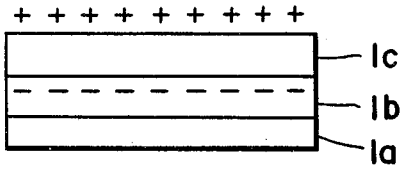
FIG. 6 is a schematic view showing changes in electric charge occurring in copying mode 2*a;*

As step 1, the photosensitive member is positively charged, for example, in the dark as shown in FIG. 6*a*.

The surface of the photosensitive member is positively charged, and the electrons are introduced into the L layer 1b from the conductive base plate 1a, so that a portion of the L layer 1b near the boundary between the L layer 1b and U layer 1c is negatively charged. The surface potential of the photosensitive member is positive as shown at a point A in FIG. 7.

Figure 6B:
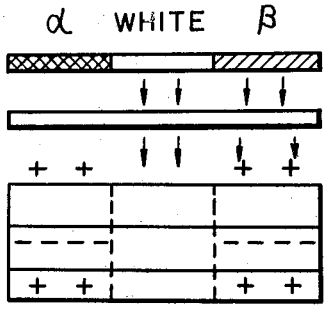

(ii) Secondary Charging of the Photosensitive Member with Polarity opposite That of Primary Charging Simultaneously as Exposing of the Photosensitive Member to an Optical Image through a Color $\beta$ Blocking Filter In step 2, the photosensitive member is exposed to an optical image through a cyan filter 2 as shown in FIG. 6b. Regions of the photosensitive member corresponding to the white regions have the L layer 1b rendered conductive and have the electric charge on the surface substantially neutralized by the secondary charging, so that the electric charge of the L layer 1b disappears. The red regions are blocked by the filter, and the black regions are hardly exposed, so that the L layer and U layer both remain insulating. Thus the secondary charging causes almost all the surface electric charge to disappear by neutralization with only a portion thereof remaining intact, and the conductive base plate 1a is positively charged accordingly.

Figure 7:
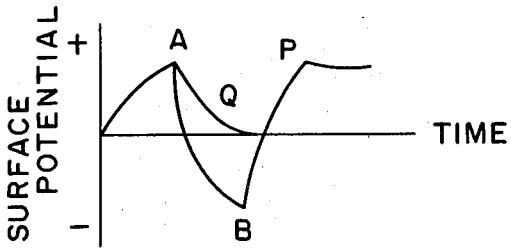
FIG. 7 is a view showing changes in surface potential corresponding to FIG. 6.

The surface potential of portions of the photosensitive member corresponding to the black and red regions becomes negative as shown at a point B in FIG. 7, and the surface potential of portion of the photosensitive member corresponding to the white regions becomes almost zero as represented by a curve Q.

(iii) Exposing of the Photosensitive Member to White Light in the Entirety

Figure 6C:
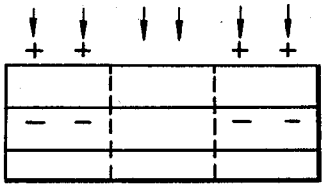

In step 3, the photosensitive member is exposed to white light in the entirety. As shown in FIG. 6c, the L layer 1b is rendered conductive and the electric charge that is restrained by the surface electric charge only remains intact in the L layer 1b, with the other charge of the L layer 1b and the charge of the conductive base plate 1a disappearing.

The surface potential of portions of the photosensitive member corresponding to the white regions is substantially zero as represented by a curve Q in FIG. 7, but the surface potential portions of the photosensitive member corresponding to the red and black regions becomes positive as represented by a curve P.

(iv) Developing in Color $\alpha$

Figure 6D:
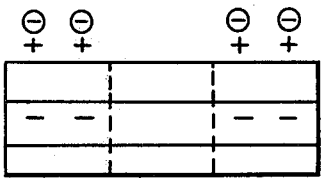

In step 4, the latent image is developed by using a black toner of negative polarity, for example. The black toner adheres to the red and black regions of the latent image on the photosensitive member as shown in FIG. 6d because the potential of these regions is positive. That is, the black regions and red regions of the original are copied as black image regions.

When the developing agent has positive polarity, the exposing of the photosensitive member in the entirety in step 3 may be dispensed with and developing may be begun immediately.

When a red developing agent is used, copying mode 2b may be carried out for an original in two colors to produce duplicates in red and white.

Although the copying process has been described up to the developing step, transfer-printing and fixing may be carried out in the usual manner.

In copying mode 1, the latent image includes $\alpha$ color regions and $\beta$ color regions. By rendering either one of an color developing and a $\alpha$ color developer inoperative or by suitably selecting the charging potentials of the primary charging and secondary charging to render the surface potential of either the latent image portions of color $\alpha$ or the latent image portions of color $\beta$ substantially zero following exposing of the photosensitive member to an optical image, it is possible to erase the latent image portions of either color $\alpha$ or color $\beta$ to carry out copying mode 3.

Stated differently, by carring out charging and exposing twice. It is possible to selectively carry out any one of five different copying modes by switching the charging conditions and replacing the filter.

II-A. A composite photosensitive member of Type II-A

To form the L layer 1b, a material is used which is almost insensitive to color $\beta$ under positive or negative charging and which has a potential imparting capability sufficiently high to enable the L layer 1b to contribute to the formation of surface potential on the photosensitive member when the surface of the photosensitive member is subjected to positive or negative corona discharge. To form the U layer 1c, a material is used which has a light transmitting ability, high sensitivity to color $\beta$ and a potential imparting capability high enough to enable the layer U 1c to contribute to the formation of surface potential on the photosensitive member when the surface of the photosensitive member is subjected to positive or negative corona discharge.

When the U layer 1c is formed of a material which essentially blocks the light of color $\beta$ by reflecting or absorbing same, a panchromatic material may be used for forming the L layer 1b because the same effect can be achieved by using such material as achieved when a material essentially having no sensitivity to color $\beta$ is used, even if the material for forming the L layer 1b is not specifically limited to those that have no sensitivity to color.

When the light of color $\beta$ is light of red color, the light of red color is absorbed by the U layer 1c if a cyan base pigment is incorporated in the material for the U layer 1c, so that the light of red color is prevented from reaching the L layer 1b. Thus even if a material having sensitivity to the light of red color is used for forming the L layer 1b, the L layer 1b is not rendered conductive by exposure to the light of red color.

Assume that red and black are used as colors $\beta$ and $\alpha$, a drum of aluminum or a film of polyester having aluminum deposited thereon by vaporization in vacuum may be used as the conductive base plate 1a. The L layer 1b may be in the form of a coat of selenium tellurium (containing 6 weight percent of tellurium) of 40 $\mu$m thick deposited by vaporization in vacuum or a coat of selenium. The U layer 1c may be in the form of a coat of a thickness of about 25 $\mu$m applied to the L layer 1b by dipping in a solution containing 2 weight parts of 4-p-dimethylaminophenyl-2,6-diphenylthiabpyrylium perchlorate, 4 weight parts of 4,4-bis (diethylamino)-2.2'-dimethyltriphenylmethane, 6 weight parts of polycarbonate (panright K-1300, trade name of Teijin Company, Ltd.) and 80 weight parts of methulene chloride.

The intermediate layer 1d interposed between the U layer 1c and L layer 1b may be in the form of a coat applied to the L layer 1b by dipping in a solution of phenol resin containing 20% weight of methanol and allowed to set by heating at 50° C. for one hour until the thickness of the coat reaches 1 $\mu$m.

The steps followed in carrying out the aforesaid five copying modes by using the photosensitive member described in detail, hereinabove will now be described.

(1) Copying Mode 1

The copying steps are followed in the order of description (i) Primary Charging of the Photosensitive Member under Exposure to Light of Color $\beta$ (Red, for Example)

Figure 8A:
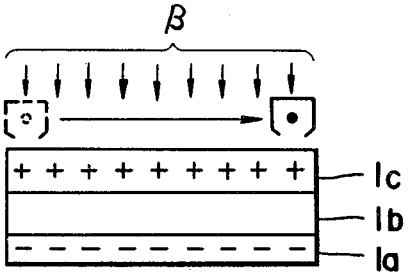
FIG. 8–21 are views in explanation of the composite photosensitive member having two photoconductive layers, FIGS. 8, 10, 12, 14, 16, 18 and 20 being schematic views showing changes in electric charge occurring in copying mode 1, copying mode 2*a*, copying mode 2*a*, copying mode 2*b*, a modification of copying mode 2*b*, copying mode 3*a* and copying mode 3*b* respectively and FIGS. 9, 11, 13, 15, 17, 19 and 21 being views showing changes in surface potential corresponding to FIGS. 8, 10, 12, 14, 16, 18 and 20 respectively.

The photosensitive member is charged at +6.5 kv, for example. As shown in FIG. 8*a*, a portion of the U layer 1*c* near the boundary between the U layer and L layer 1*b* is positively charged, and the conductive base plate 1*a* is negatively charged. As shown at a point A in FIG. 9, the surface potential of the photosensitive member becomes positive following the primary charging. Conversely, the photosensitive member may be negatively charged.

Figure 8B:
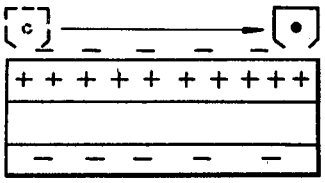

(ii) Secondary Charging of the Photosensitive Member in the Dark with Polarity Opposite the Primary Charging The photosensitive member is charged at −5.5 kv, for example. As shown in FIG. 8*b*, the surface of the photosensitive member is negatively charged and the conductive base layer 1*a* is positively charged, with the negative charge on the conductive base layer 1*a* being partly neutralized.

Figure 9:
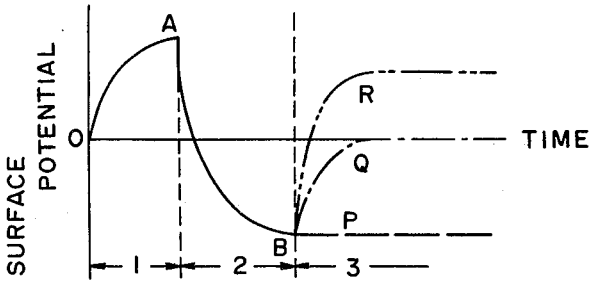

Following the secondary charging, the surface potential of the photosensitive member becomes negative as shown at a point B in FIG. 9. When negatively charged in the primary charging, the photosensitive member may be positively charged in the secondary charging, to render its surface potential positive.

(iii) Exposing of the photosensitive Member to an Optical Image

Figure 8C:
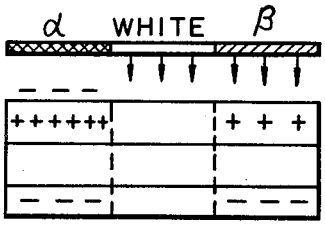
Figure 8D:
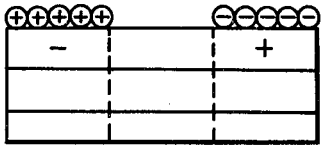

The photosensitive member is exposed to an optical image. By exposure, regions of the photosensitive member corresponding to the regions of color $\alpha$ (black, for example) have the electric charge remain intact as shown in FIG. 8*c*, and the surface potential of the photosensitive member remains substantially the same as the potential following the secondary charging, as represented by a curve P in FIG. 9.

Regions of the photosensitive member corresponding to the white regions or the background of the original image have their electric charge disappear due to the U layer 1*c* and L layer 1*b* becoming conductive, and the surface potential of the photoconductive member shows a change represented by a curve Q in FIG. 7 and becomes substantially zero following exposure.

Regions of the photosensitive member corresponding to the regions of color $\beta$ (red, for example) have the surface potential disappear due to the U layer 1*c* becoming conductive, and part of the positive charge on the U layer 1*c* remains intact. A negative charge corresponding to the positive charge remains in the conductive base plate 1*a*. The surface potential of the photosensitive member shows a change represented by a curve R in FIG. 9 and becomes positive following exposure.

In FIG. 9, the abscissa represents the time and the ordinate indicates the potential, and the intervals in time 1, 2 and 3 indicate step 1 (primary charging), step 2 (secondary charging) and step 3 (exposing) respectively.

(iv) Developing

The latent image formed on the photosensitive member by exposure to an optical image is developed by using a developing agent of color $\alpha$ and a developing agent of color $\beta$. The developing agent of color $\beta$ of negative polarity may include minuscule charged powder of red color. The developing agent of color $\alpha$ of positive polarity may include miniscule charged powder of black color.

Primary developing of the latent image in red color is carried out while a developing bias voltage of +50 v is applied to the photosensitive member, and then secondary developing in black color is carried out while a developing bias voltage of −100 v is applied. The primary developing and secondary developing may be carried out by reversing the order.

Following developing, a black toner of positive charge adheres to portions of the photosensitive member having a negative surface potential, and a red toner of negative charge adheres to portions of the photosensitive member having a positive surface potential.

(v) Transfer-Printing

Copy sheets are brought into contact with the photosensitive member following developing to form the image of the original on the copy sheets.

One example of transfer-printing conditions includes subjecting the photosensitive member to preliminary transfer-printing charging at +4.5 v followed by transfer-printing carried out by means of a first transfer-printing charger of +5.5 kv and a second transfer-printing charger of −5.0 kv.

(vi) After-Treatment

Following transfer-printing, the printed copy sheets have the printed images fixed, and the photosensitive member has the electric charge removed and its surface cleaned.

(2) Copying Mode 2*a*

The following copying steps are followed in the order of description:

(i) Primary Charging of the Photosensitive Member under Exposure in Color $\beta$ (Red, for example)

Figure 10A:
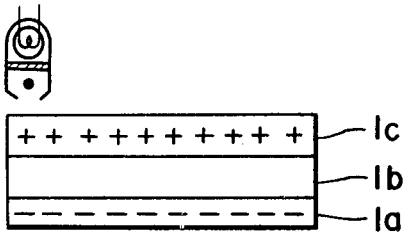

The photosensitive member is charged at +5.3 kv, for example. This causes a portion of the U layer 1*c* near the boundary between the U layer 1*c* and L layer 1*b* to be positively charged and the conductive base plate 1*a* to be negatively charged, as shown in FIG. 10*a*.

Figure 11:
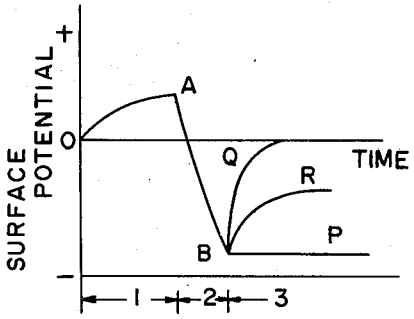

The surface potential of the photosensitive member becomes positive following the primary charging, as shown at a point A in FIG. 11. Like FIG. 9, FIG. 11 shows changes in the surface potential of the photosensitive member.

Figure 10B:
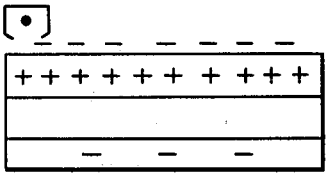
Figure 12B:
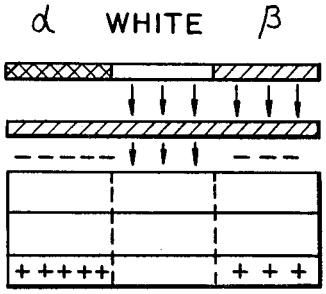

(ii) Secondary Charging of the Photosensitive Member with Polarity Opposite That of the Primary Charging in the Dark The photosensitive member is charged at −5.3 kv, for example. As shown in FIG. 10*b*, this causes the surface of the photosensitive member to be negatively charged and the conductive base layer 1*a* to be positively charged, with part of the negative charge on the conductive base plate 1*a* being neutralized.

Following the secondary charging, the surface potential of the photosensitive member becomes negative as indicated at a point B in FIG. 11.

(iii) Exposing to Optical Image

Figure 10C:
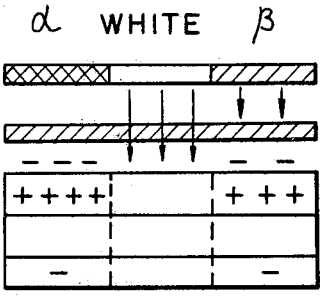

The photosensitive member is exposed to an optical image through a color $\beta$ or red color absorbing filter (cyan filter). Following exposing, regions of the photosensitive member corresponding to the regions of color $\alpha$ (black, for example) of the original have their charge remain substantially intact and the surface potential thereof remains negative as shown in FIG. 10*c*. Regions corresponding to the white regions have their charge removed due to the L layer 1b and U layer 1c becoming conductive. Thus the electric charge is removed and the surface potential becomes substantially zero. Regions corresponding to the regions of color $\beta$ (red, for example) have their electric charge remain substantially intact, except for part of the charge that is absorbed by the filter.

FIG. 11 shows changes caused to occur in surface potential by exposing. Curves P, Q and R represent changes in potential in regions corresponding to the color $\alpha$ regions, white regions and color $\beta$ regions respectively. It will be seen that the regions corresponding to the regions of colors $\alpha$ and $\beta$ have their negative surface potential remain intact, and the regions corresponding to the white regions have their surface potential become substantially zero.

(iv) Developing

The latent image formed on the photosensitive member is developed by using a developing agent of color $\alpha$ (black, for example) while a developing bias voltage of $-170$ v is being applied to the photosensitive member, for example. The developing agent of color $\alpha$ adheres to both regions of the photosensitive member corresponding to the regions of color $\alpha$ and regions of color $\beta$, so that the original in two colors is duplicated in a single color $\alpha$.

(v) Transfer-Printing

Following developing, copy sheets are brought into contact with the photosensitive member and transfer-printing of the developed image to the copy sheets is effected by using a transfer-printing charger of $-5.0$ kv, for example.

(iv) After-Treatment

After-treatment is carried out in the same manner as described by referring to copying mode 1.

(2') A Modification of Copying Mode 2a

Copying mode 2a may be carried out in accordance with a Carlson system, in place of the process described hereinabove.

(i) Primary Charging

Primary charging is carried out at 0 v. That is, the primary charging of the aforesaid example is carried out with the primary charger being essentially in off condition.

(ii) Secondary Charging of the Photosensitive Member in the Dark

Figure 13:
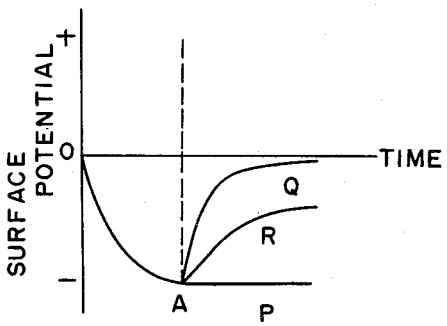
Figure 12A:
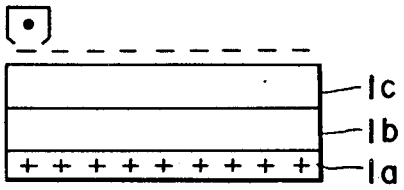

Secondary charging is carried out at $-5.0$ kv, for example, As shown in FIG. 12a, the surface of the photosensitive member and the conductive base plate 1a are negatively charged and positively charged respectively. The surface potential of the photosensitive member becomes negative as indicated at a point A in FIG. 13.

(iii) Exposing to Optical Image

The photosensitive member is exposed to an optical image through a filter absorbing color $\beta$ (such as cyan filter). Following exposing, regions of the photosensitive member corresponding to the regions of color $\alpha$ have their charge remain substantially intact, and regions thereof corresponding to the white regions have their charge removed due to the U layer 1c and L layer 1b becoming conductive. Regions of the photosensitive member corresponding to the regions of color $\beta$ have part of their charge remain intact due to absorption by the filter.

Following exposing, the surface potential of the photosensitive member shows changes as indicated by a curva P (color $\beta$ regions), a curve Q (white regions) and a curve R (color $\beta$ regions). It will be seen that the regions of colors $\alpha$ and $\beta$ have their surface potential become negative and the white regions almost zero.

(iv) Developing

Figure 12C:
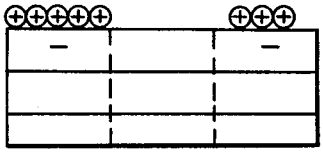
Figure 10D:
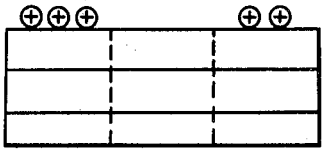

The latent image formed on the photosensitive member is developed by using a developing agent of color $\alpha$ while a developing bias voltage of $-200$ v, for example, is being applied. The developing agent of color $\alpha$ adheres to both regions of the photosensitive member corresponding to the regions of the original of color $\alpha$ and regions thereof corresponding to the regions of the original of color $\beta$, as shown in FIG. 12c.

(v) Transfer-Printing

Following developing, copy sheets are brought into contact with the photosensitive member and transfer-printing of the developed image on the copy sheets is effected by using a transfer-printing charger of $-5.0$ kv, for example.

(vi) After-Treatment

After-treatment is carried out in the same manner as described with reference to copying mode 1.

(3) Copying Mode 2b.

Copying steps are followed in the order of description.

Figure 14A:
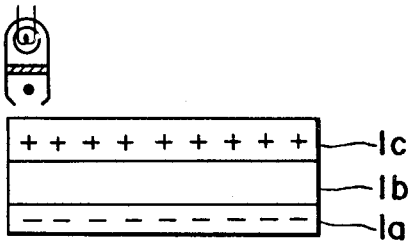

(i) Primary Charging of the Photosensitive Member under Exposure in Color $\beta$ The photosensitive member is charged at $+5.7$ kv, for example. As shown in FIG. 14a, a portion of the U layer 1c near the boundary between the U layer 1c and L layer 1b is positively charged, and the conductive base plate 1a is negatively charged. The surface potential of the photosensitive member becomes positive as indicated at a point A in FIG. 15.

(ii) Secondary Charging of the Photosensitive Member with Porality Opposite the Primary Charging in the Dark The photosensitive member is charged at $-4.1$ kv, for example. The charging voltage may be rendered O or OFF.

Figure 15:
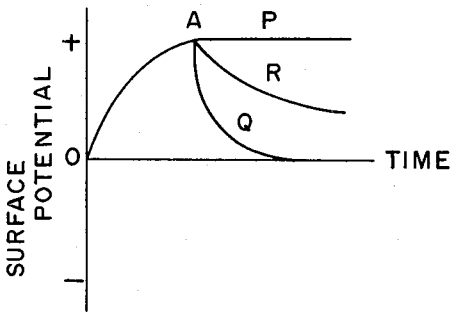
Figure 17:
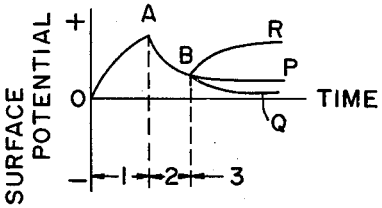
Figure 14B:
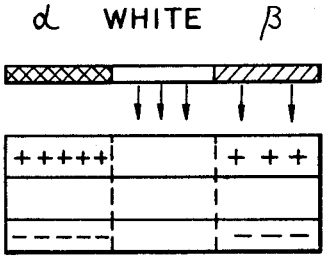
Figure 14C:
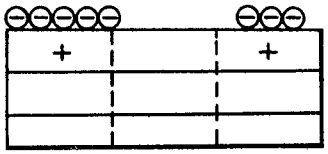
Figure 16A:
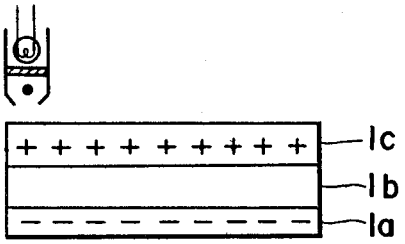
Figure 16B:
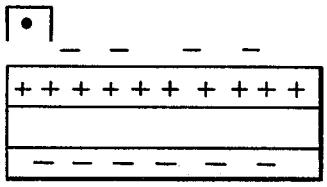
Figure 16C:
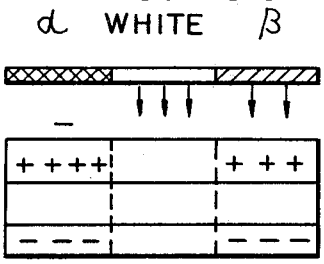

Examples of secondary charging being charried out with the secondary charger in off condition are shown in FIGS. 14 and 15. FIGS. 16 and 17 show examples of negative charging, at $-4.1$ kv, for example. Description will be omitted.

(iii) Exposing to Optical Image

The photosensitive member is exposed to an optical image. Following exposing, regions of the photosensitive member corresponding to the regions of color $\alpha$ (black, for example) of the original have their electric charge remain intact. The electric charge in regions corresponding to the white regions of the original disappears because the U layer 1c and L layer 1b are rendered conductive, while the electric charge in regions corresponding to the regions of color $\beta$ partly remains intact in the L layer 1b and the conductive base plate 1a because the L layer 1b is insensitive to color $\beta$, although the U layer 1c is rendered conductive.

The surface potential of the photosensitive member shows changes as shown in FIG. 15. As represented by a curve P, regions of the photosensitive member corresponding to the regions of color $\alpha$ have the same charge as after the primary charging. As indicated by a curve Q, regions of the photosensitive member corresponding to the white regions have their potential become substantially zero. A curve R shows that the potential of the regions of the photosensitive member corresponding to the regions of color $\beta$ remains positive although slightly reduced. It will be seen that the surface potential of the photosensitive member is kept in positive condition both in regions corresponding to the regions of color $\alpha$ and those corresponding to the regions of color $\beta$.

When color $\alpha$ is not black, the photosensitive member is advantageously exposed to an optical image through a filter blocking color $\beta$.

(iv) Developing

The latent image on the photosensitive member is developed by using a developing agent of color $\beta$ (red, for example) while a developing bias voltage of +150 v is being applied to the photosensitive member, for example.

The electrostatic latent image portions on the photosensitive member corresponding to the regions of color $\alpha$ and those on the photosensitive member corresponding to the regions of color $\beta$ can be developed into visible image portions by using the developing agents of color $\beta$.

(v) Transfer-Printing

Following developing, copy sheets are brought into contact with the photosensitive member and transfer-printing of the developed image on the copy sheets is effected by using a transfer-printing charger of +5.5 kv.

(vi) After-Treatment

After-treatment is carried out in the same manner as described with reference to copying mode 1.

(4) Copying Mode 3*a*

Copying steps are followed in the order of description.

Figure 18A:
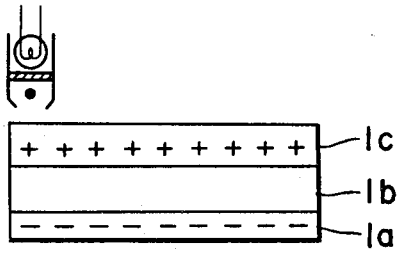

(i) Primary Charging of the Photosensitive Member under Exposure in color $\beta$ The photosensitive member is charged at +6.5 kv, for example. As shown in FIG. 18*a*, a portion of the U layer 1*c* near the boundary between the U layer 1*c* and L layer 1*b* and the conductive base plate 1*a* are charged positively and negatively respectively. Following the primary charging, the surface potential of the photosensitive member becomes positive as indicated at a point A in FIG. 19.

Figure 18B:
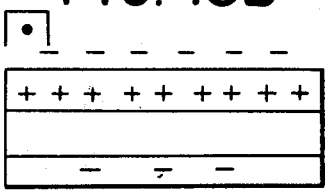

(ii) Secondary Charging of the Photosensitive Member with Polarity Opposite That of the Primary Charging in the Dark The photosensitive member is charged at −5.7 kv, for example. As shown in FIG. 18*b*, the surface of the photosensitive member is negatively charged and the conductive base plate 1*a* is positively charged, so that part of the negative charge of the conductive base plate 1*a* is neutralized. The surface potential of the photosensitive member becomes negative following the secondary charging, as indicated at a point B in FIG. 19.

(iii) Exposing to Optical Image

Figure 18C:
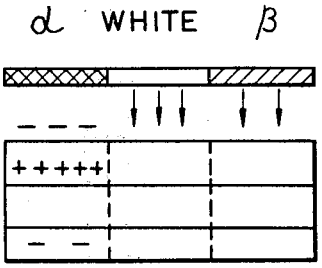

The photosensitive member is exposed to an optical image. Following the exposing, regions of the photosensitive member corresponding to the regions of color $\alpha$ (black, for example) of the original have their charge remain intact, and regions corresponding to the white regions have their charge removed because of the U layer 1*c* and L layer 1*b* becoming conductive, as shown in FIG. 18*c*. In regions corresponding to the regions of color $\beta$, the charge is removed with part of the charge remaining intact in the U layer 1*c* and conductive base plate 1*a* because the L layer 1*b* is insensitive to color $\beta$ although the U layer 1*c* is rendered conductive.

Figure 19:
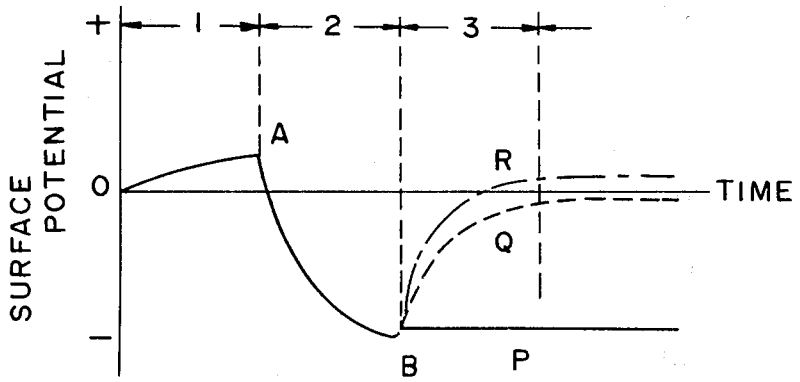

As shown in FIG. 19, the surface potential of the photosensitive member show changes. In regions corresponding to the regions of color $\alpha$, the potential remains substantially equal to that following the primary charging as represented by a curve P. In regions corresponding to the white regions, the potential becomes substantially zero as represented by a curve Q. In regions corresponding to the regions of color $\beta$, the potential becomes positive and almost zero as represented by a curve R. The regions corresponding to the regions of color $\beta$ are not developed by a toner of color $\beta$ so long as the potential thereof is below the developing initiation electric field strength level.

(iv) Developing

Developing is carried out by using a developing agent of color $\alpha$ (black, for example) while applying a bias voltage of −150 v to the photosensitive member. Electrostatic latent image portions corresponding to the regions of color $\alpha$ of the original are developed into visible image portions with the developing agent of color $\alpha$ while image portions corresponding to the white regions and regions of color $\beta$ are erased. Image regions corresponding to the regions of color $\beta$ are not developed even if a developer of color $\beta$ is operative. However, the effects can be increased if the developer of color $\beta$ is rendered inoperative.

(v) Transfer-Printing

Following developing, copy sheets are brought into contact with the photosensitive member, and transfer-printing is carried out by using a transfer-printing charger of −5.0 kv.

(vi) After-Treatment

After-treatment is carried out in the same manner as described with reference to copying mode 1.

(5) Copying Mode 3*b*

Copying steps are followed in the order of description.

(i) Primary Charging of the Photosensitive Member under Exposing in Color $\beta$ (Red, for example)

Figure 20A:
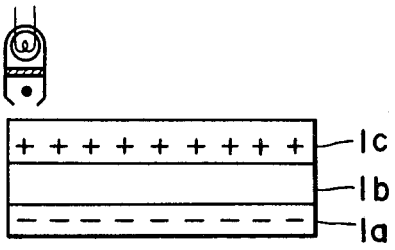

The photosensitive member is charged at +6.5 kv, for example. As shown in FIG. 20*a*, a portion of the U layer 1*c* near the boundary between the U layer 1*c* and L layer 1*b* and the conductive base plate 1*a* are charged positively and negatively respectively. Following the primary charging, the surface potential of the photosensitive member becomes positive as indicated at a point A in FIG. 21.

Figure 20B:
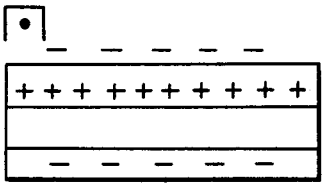

(ii) Secondary Charging of the Photosensitive Member with Polarity Opposite That of the Primary Charging in the Dark The photosensitive member is charged at −5.7 kv, for example. As shown in FIG. 20*b*, the surface of the photosensitive member is negatively charged, and the conductive base plate 1*a* is positively charged with part of the negative charge of the conductive base plate 1*a* being neutralized. The surface potential of the photosensitive member has a value substantially near zero as indicated at a point B in FIG. 21, following the secondary charging.

(iii) Exposing to Optical Image

Figure 20C:
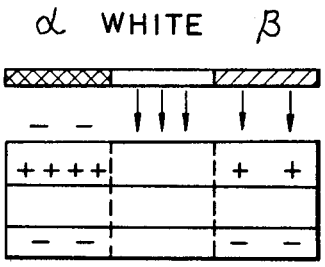
Figure 18D:
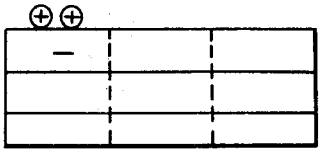
Figure 20D:
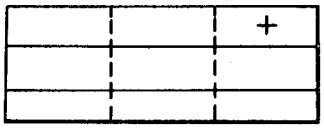

The photosensitive member is exposed to an optical image. Following exposing, as shown in FIG. 20*c*, regions corresponding to the regions of color $\alpha$ (black, for example) have their charge remian intact, and regions corresponding to the white regions have their charge removed because of the U layer 1*c* and L layer 1*b* becoming conductive. In regions corresponding to the regions of color $\beta$, the electric charge in a portion of the U layer 1c near the boundary between the U layer 1c and L layer 1b and the electric charge in the conductive base plate 1a remain intact because the U layer 1b becomes conductive and the L layer 1b is insensitive to color $\beta$.

Figure 21:
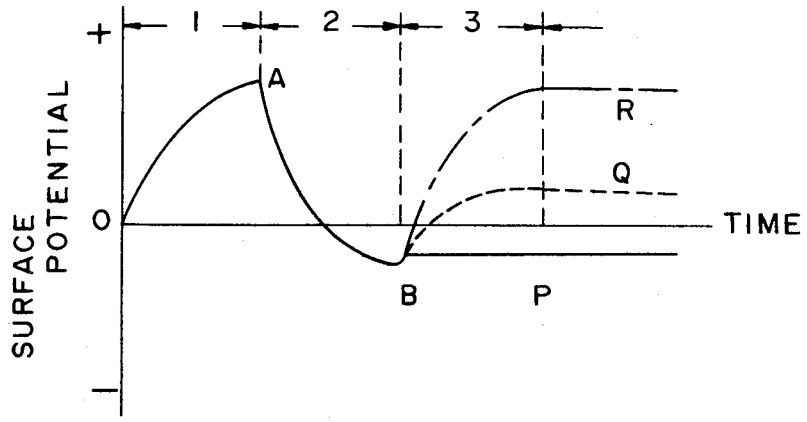

The surface potential of the photosensitive member shows changes as shown in FIG. 21. In regions corresponding to the regions of color $\alpha$, the surface potential remains substantially zero as represented by a curve P. In regions corresponding to the white regions, the polarity changes but the potential remains substantially zero as represented by a curve Q. In regions corresponding to the regions of color $\beta$, the potential becomes positive as represented by a curve R. The regions of color $\alpha$ and white regions are not developed because the potential is below the initiation electric field strength level.

(iv) Developing

Developing is carried out by using a developing agent of color $\beta$ (red, for example) while applying a developing bias voltage of +100 v to the photosensitive member. Electrostatic latent image regions corresponding to the regions of color $\beta$ are developed into visible image regions with the developing agent of color $\beta$ while electrostatic latent image regions corresponding to the white regions and regions of color $\alpha$ are erased. A developer of color $\alpha$ may be rendered inoperative.

(v) Transfer-Printing

Copy sheets are brought into contact with the photosensitive member that has been developed, and transfer-printing is carried out by using a transfer-printing charger of +5.5 kv.

(vi) After-Treatment

After-treatment is carried out in the same manner as described with reference to copying mode 1.

To facilitate understanding of the differences between the various copying modes described hereinabove, the descriptions are shown in tabulated form in Table 1. In Table 1, it will be seen that it is possible to selectively form any one of electrostatic latent images corresponding to one of five different copying modes from the same original in two colors by following the three steps of primary charging, secondary charging and exposing of the original to an optical image, by switching the copying apparatus between charging conditions and between the use and non-use of a fileter while using the same photosensitive member. It is necessary to select a developing bias voltage of the polarity and voltage and a transfer-printing charger of the type suitable for the electrostatic latent image corresponding to the selected copying mode. Erasion of image regions corresponding to the regions of one color of the original in copying mode 3a and 3b may be effected by rendering the developer of the one color inoperative in the developing step of copying mode 1.

TABLE 1

| | | Copying Mode | | | | | |
|---|---|---|---|---|---|---|---|
| | | 1 | 2a | | 2b | 3a | 3b |
| | | Color $\alpha$ (Black) | White, Color $\alpha$ (Black) | | White, | Color $\beta$ (Red) | Color $\alpha$ (Black) |
| Copying Step | | Color $\beta$ (Red) | | Carlson Method | Color $\beta$ (Red) | Erased | Erased |
| Primary Charging | | ON (+6.5 kv) | ON (+5.3 kv) | OFF | ON (+5.7 kv) | ON (+6.5 kv) | ON (+6.5 kv) |
| Primary Exposure | | ON | ON | OFF | ON | ON | ON |
| Secondary Charging | | ON (−5.5 kv) | ON (−5.3 kv) | ON (−5.0 kv) | OFF ON (−4.1 kv) | ON (−5.5 kv) | ON (−5.7 kv) |
| Exposing to Optical Image | | ON | ON | ON | ON | ON | ON |
| Filter Used in Exposing to Optical Image | | OFF | ON | ON | OFF | OFF | OFF |
| Developing | First Developing (⊖ Red) | ON | OFF | OFF | ON | OFF | ON |
| | First Developing Bias | ON (+50 v) | OFF | OFF | ON (+150 v) | OFF | ON (+100 v) |
| | Second Developing (⊕ Black) | ON | ON | ON | OFF | ON | OFF |
| | Second Developing Bias | ON (−100 V) | ON (−170 v) | ON (−200 v) | OFF | ON (−150 v) | OFF |
| Preliminary Charging for Transfer-Printing | | ON (+4.5 kv) | OFF | OFF | OFF | OFF | OFF |
| Transfer Printing | First Transfer-Printing Voltage | ON (+5.5 kv) | OFF | OFF | ON (+5.5 kv) | OFF | ON (+5.5 kv) |
| | Second Transfer-Printing Voltage | ON (−5.0 kv) | ON (−5.0 kv) | ON (−5.0 kv) | OFF | ON (−5.0 kv) | OFF |
| After-Treatment (Removing of Charge, Cleaning, Quenching Lamp, Fixing) | | ON | ON | ON | ON | ON | ON |

From the foregoing description, it will be appreciated that regions of colors $\alpha$ and $\beta$ of an original image can be selectively formed into electrostatic latent image regions by using the same photosensitive member merely by switching the copying apparatus between the conditions of three steps of primary charging, secondary charging and exposing of the photosensitive member to an optical image of the original. That is, the regions of colors $\alpha$ and $\beta$ of the original image can be formed into latent image regions of opposite polarities, or into latent image regions of the same polarity. Also, the regions of one color of the original can be formed into latent image regions of one polarity while forming the regions of the other color of the original into latent image regions in such a manner that the surface potential of the photosensitive member becomes substantially zero so that the latent image regions corresponding to the regions of other of the original are not developed into visible image regions. Thus it is possible to selectively form an electrostatic latent image corresponding to one of the five different copying modes.

It is also possible to effect copying in any one of the five copying modes by using any type of photosensitive member as desired by switching the copying apparatus between the conditions of the three steps of primary charging, secondary charging and exposing of the photosensitive member to an optical image of the original following selection of the desired type of photosensitive member. Stated differently, one can select a desired type of photosensitive member from several types and carry out copying in the same copying apparatus by indicating the selected type of photosensitive member and the copying mode. To this end, a control section is provided to the copying apparatus which switches the copying apparatus to the copying conditions for the selected copying mode suitable for the selected type of photosensitive member.

When the same copying apparatus is used, copying may be carried out using one type of photosensitive member onyl, and two, three or four copying modes out of the five copying modes described hereinabove may be selected beforhand so that switching of the copying apparatus may be effected between the previously selected copying modes.

One embodiment of the copying apparatus in which copying can be carried out by selecting one of the five copying modes according to the invention will now be described.

Figure 22:
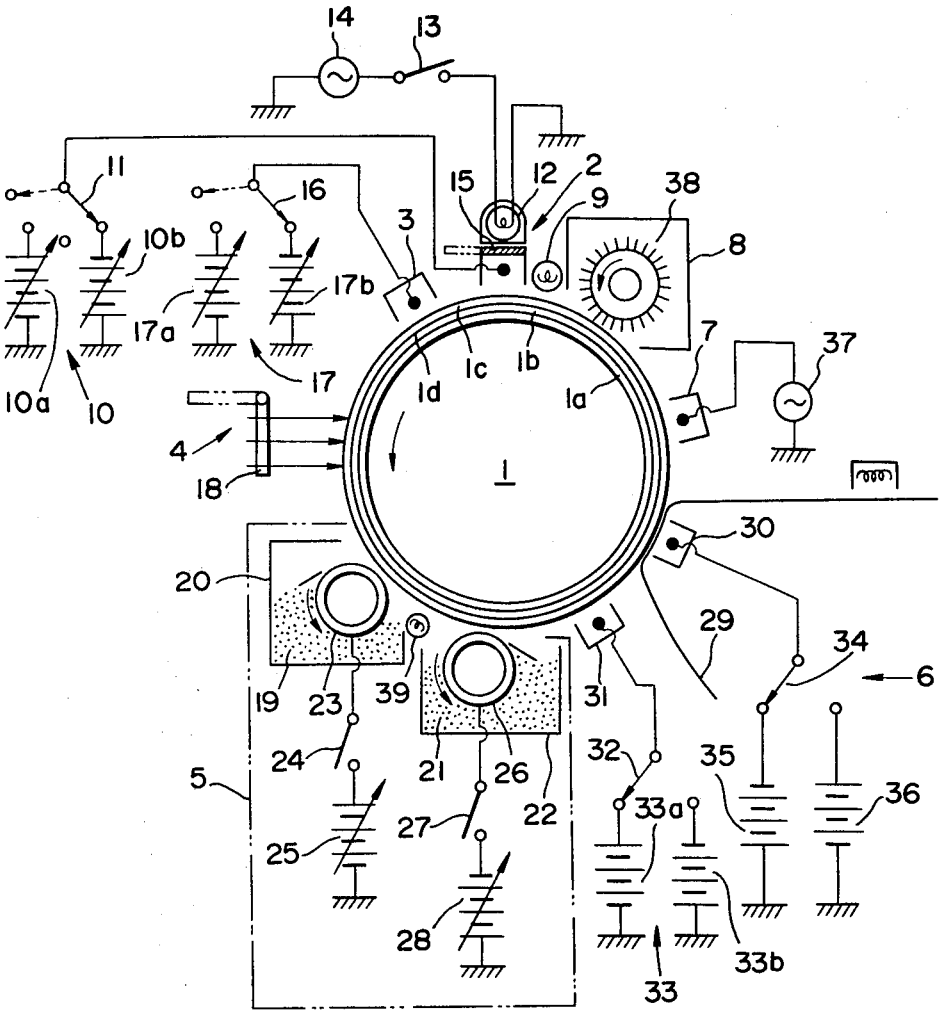
FIGS. 22 and 23 are views in explanation of different examples of copying apparatus that can be switched from one copying mode to another.

FIG. 22 shows a photosensitive member 1 in the form of a drum. However, the invention is not limited to the photosensitive member of the drum type and a photosensitive drum in the form of a sheet may be used. The apparatus should be suitable amended when the photosensitive member of the sheet form is used.

Arranged around the photosensitive member 1 in the direction of rotation of the photosensitive member are a primary charger 2, a secondary charger 3, a photosensitive member exposing optical system 4, a developing device 5, a transfer-printing device 6, a charge remover 7, and a cleaning device 8. A quenching device 9 may be provided if necessary.

The primary charger 2 has connected thereto a first varialbe voltage source 10 through a first change-over member 11, such as a switch or relay. The first variable voltage source 10 has its voltage and polarity changed by the change-over member 11.

As shown, the first variable voltage source 10 includes a positive variable voltage source 10*a* and a negative variable voltage source 10*b*. The primary charger 2 may be turned off by means of the change-over member 11.

The primary charger 2 is constructed such that the photosensitive member 1 can be exposed to an optical image of the original simultaneously as being subjected to primary charging. For example, the primary charger 2 may be in the form of an open type charger, and a light source 12 for exposing may be connected to a power source 14 via an ON-OFF switch 13, so that ON-OFF control can be effected. Interposed between the exposing light source 12 and the primary charger 2 is a filter 15 allowing color $\beta$ only to be transmitted therethrough which is movable between an operative position in which it blocks the light beam from the light source 12 and an inoperative position in which it is out of the path of the light beam, so that ON-OFF control can be effected.

The secondary charger 3 is connected to a second variable voltage source 17 via a second change-over member 16. Like the first variable voltage source 10, the second variable voltage source 17 can have its polarity and voltage changed by the action of the second change-over member 16. As shown, the second variable voltage source 17 also includes a positive variable voltage source 17*a* and a negative variable voltage source 17*b*. The second change-over member 16 may be in the form of a switch or relay which turns off the secondary charger 3 or gives thereto the selected polarity and selected one of voltage values. Depending on the type of the photosensitive member 1, the secondary charger 3 may be located in a position which is disposed in a portion of the path of the light beam for exposing the photosensitive member 1, and a filter blocking the color $\beta$ may be arranged to effect ON-OFF control.

The exposing optical system 4 may be of any known type, and includes a color $\beta$ blocking filter 18 which can be moved between an operative position disposed in the path of the light beam of the optical system and an inoperative position disposed out of the path of the light beam so that ON-OFF control can be effected.

The developing device 5 is constructed such that developing can be effected by using two types of developing anegnts, one in color $\alpha$ and the other in color $\beta$. One developer having the developing agents or two colors contained therein in the form of a mixture of developing agents may be used as the developing device 5. In the embodiment shown and described, however, the developing device 5 includes a first developer 20 containing therein a negative developing agent 19, and a second developer 22 containing therein a positive developer 21.

When a positive toner of color $\alpha$ and a negative toner of color $\beta$ are used, the toner of color $\alpha$ is contained in the second developer 22, and the toner of color $\beta$ is contained in the first developer 20. When the toner of color $\alpha$ has a negative porality and the toner of color $\beta$ has a positive polarity, the toner of color $\alpha$ is contained in the first developer and the toner of color $\beta$ is contained in the second developer 22.

The first developer 20 has a developing sleeve 23 connected, via an ON-OFF switch 24, to a first developing bias voltage source 25 of variable voltage. The second developer 22 has a developing sleeve 26 connected, via an ON-OFF switch 27, to a second developing bias voltage source 28 of variable voltage.

The developing bias voltage sources 25 and 28 may be constructed such that they can be switched between different voltages, so that the need to specify the polarity of each developing agent contained in the developer as aforesaid can be eliminated.

A white color exposing device 39 may be mounted between the first developer 20 and second developer 22.

The transfer-printing device 6 includes a transfer-printing charger 30 positioned against the photosensitive member 1 in such a manner that a transfer-printing sheet 29 in the transfer-printing position is interposed between the photosensitive member 1 and transfer-printing charger 30, and a preliminary transfer-printing charger 31 for subjecting the photosensitive member 1 to preliminary charging before it reaches the transfer-printing position.

The transfer-printing charger 30 can be switched between a first transfer-printing voltage source 35 of positive polarity and a second transfer-printing voltage source 36 of negative polarity by a change-over switch 34.

Figure 23:
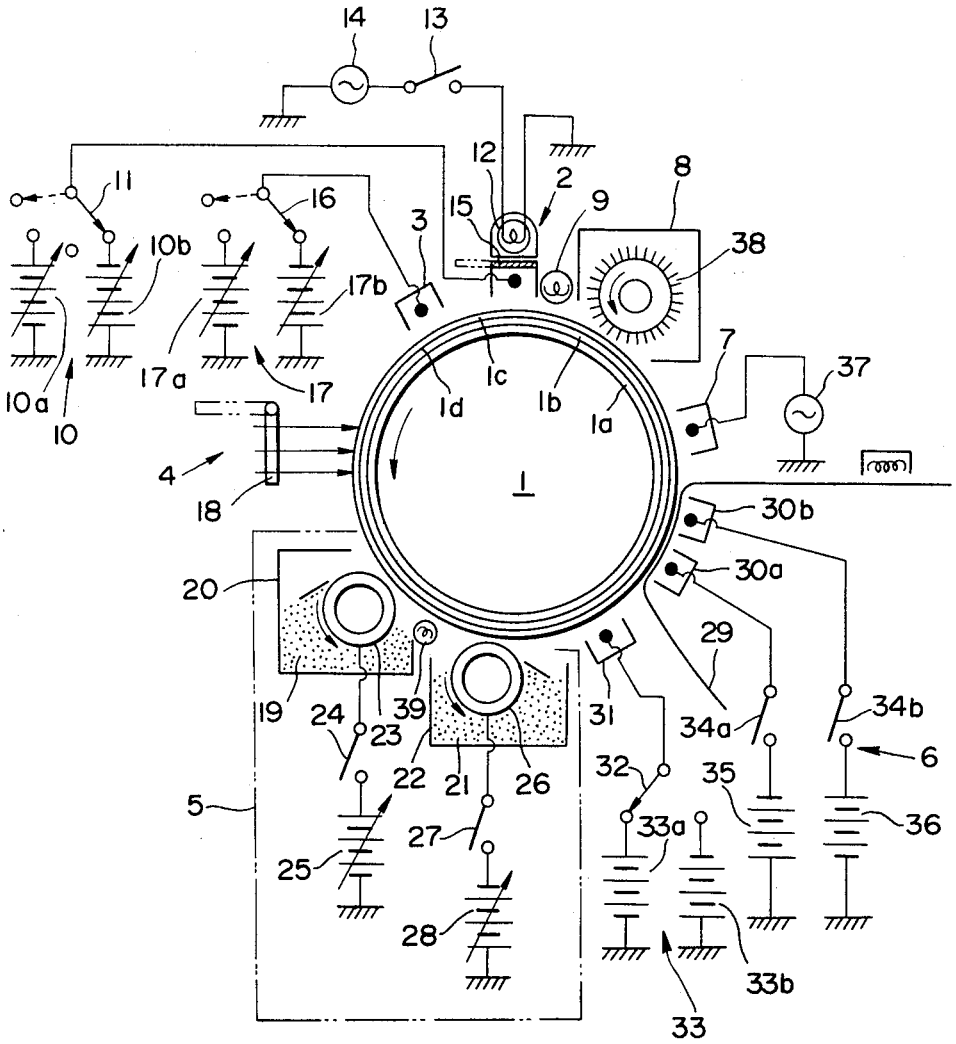

In order that the original in two colors can be duplicated in one transfer-printing operation in copying mode 1, a first transfer-printing charger 30*a* connected to the first transfer-printing voltage source 35 via an ON-OFF switch 34*a* and a second transfer-printing charger 30*b* connected to the second transfer-printing voltage source 36 via an ON-OFF switch 34*b* are advantageously disposed in side-by-side relation (FIG. 23).

The charge remover 7 is connected to a power pack 37 for charge removing.

The cleaning device 8 shown uses a cleaning brush 38.

FIGS. 22 and 23 mainly show parts of the copying apparatus dealing with copying of an original using the photosensitive member 1. The copying apparatus includes parts not shown in the drawings which are of known construction.

A method of effecting copying by switching the copying apparatus shown in FIG. 22 or 23 from one copying mode to another will be described by referring to a flow chart shown in FIG. 24.

The type of the photosensitive member to be used is selected by operating a change-over switch and a pushbutton on the operation panel. As the specific type of photosensitive member is selected, the control section is switched as by changeover switch to a control system associated with the selected type of photosensitive member. Then, desired copying mode is selected by operating a change-over switch or a pushbutton on the operation panel.

In one process for selecting the desired copying mode, one of the five different copying modes may be directly selected by depressing a pushbutton. Alternatively, the color of the duplicates to be made may be indicated as to whether the color is $\alpha$ or $\beta$ or both, or whether or not image portions in one of the two colors in which the original image is shown should be erased.

When the copying apparatus has built therein a control system capable of switching the apparatus from the conditions of one copying mode to those of another copying mode depending on the type of the photosensitive member, it is possible to switch the apparatus to the conditions of the desired copying mode by actuating a change-over switch for the photosensitive members and a change-over switch for the copying modes. However, when control is effected by using a microcomputer, for example, control may be effected according to the flow chart shown in FIG. 24. An example of control effected according to the flow chart shown in FIG. 24 will now be described.

In step 1, the desired type of photosensitive member is selected by actuating a pushbutton, for example, on the operation panel. The type of the photosensitive member used is set and the conditions of copying operation suitable for the selected type of photosensitive member are selected in step 1. Table 1 merely shows one example of the conditions.

In step 2, the desired copying mode is selected by actuating a button or switch on the operation panel.

In step 3, a selection is made as to whether image regions of colors $\alpha$ and $\beta$ are to be discriminated, in response to a selection signal produced in step 2. More specifically, a reply YES is given to the question whether image regions of colors $\alpha$ and $\beta$ are to be discriminated when two-color copying is to be effected by carrying out copying mode 1 and image regions of one color are to be erased by carrying out copying mode 3. A reply No is given when all the image portions are to be reproduced by carrying out copying in one of the colors $\alpha$ and $\beta$ in copying mode 2.

In step 4, a reply is given to the question as to whether copying is to be carried out in color $\beta$ in response to a NO signal produced in step 3. When copying mode 2*a* is selected, a NO signal is produced in step 4. In step 5, conditions of the primary charger 2, secondary charger 3 and exposing optical system 4 are changed to the conditions of copying mode 2*a* for the selected type of photosensitive member. For example, when the selected type of photosensitive member has two photoconductive layers in which the L layer is not sensitive to color $\beta$ and the U layer of high sensitivity to color $\beta$ and the developing agents used include a developing agent of negative polarity of color $\alpha$ and a developing agent of positive polarity of color $\beta$, the conditions shown in Table 1 are selected. When the selected copying mode is 2*a*, for example, the first variable voltage source 10 is set at +5.3 kv, the ON-OFF switch 13 of the light source 12 is turned on, the filter 15 is turned on, the second variable voltage source 7 is set at −5.3 kv, and the exposing filter 18 is turned on, in step 5. When the selected photosensitive member is of different type, conditions of copying are distinct from those described above, even if the copying mode remains unchanged.

When copying mode 2*b* is selected, a YES signal is produced in step 4, and the conditions of the primary charger 2, secondary charger 3 and exposing optical system 4 are changed to those suiting copying mode 2*b* for the selected type of photosensitive member, in step 6.

In stpe 6, the first variable voltage source 10 is set at +5.7 kv, the ON-OFF switch 13 of the light source 12 is turned on, the filter 15 is turned on, the second variable voltage source 17 is turned off, and the exposing filter 18 is turned off, for example.

In step 7, a reply is given to the question whether a single color is used in carrying out copying mode 1 or 3 when a YES signal is produced in step 3. When copying mode 1 is to be carried out to duplicate image regions of colors $\alpha$ and $\beta$ in different colors, a NO signal is produced in step 7. The production of a NO signal sets the conditions of the primary charger 2, secondary charger 3 and exposing optical system 4 at the conditions for copying mode 1 for the selected type of photosensitive member in step 8.

In step 8, the first variable voltage source 10 is set at +6.5 kv, the switch 13 of the light source 12 is turned on, the filter 15 is turned on, the second variable voltage source 17 is set at −5.5 kv, and the exposing filter 18 is turned off, for example.

In step 9, a decision is given as to whether copying is to be carried out in color $\beta$ when a YES signal is produced in step 7. In step 9, a signal NO is produced when copying mode 3*a* is selected in which image regions of color $\beta$ are to be erased and image regions of color $\alpha$ only are to be duplicated. As a result, the conditions of the primary charger 2, secondary charger 3 and exposing optical system 4 are changed to the conditions of copying mode 3*a* for the selected type of photosensitive member in step 10.

In step 10, the first variable voltage source 10 is set at +6.5 kv, the ON-OFF switch 13 of the light source 12 is turned on, hte filter 15 is turned on, the second variable voltage source 17 is set at −5.5 kv, and the exposing filter 18 is turned off, for example.

When copying mode 3b is selected in which image regions of color α is to be erased and image regions of colro β only are to be duplicated, a YES signal is produced in step 9, and the conditions of the primary charger 2, secondary charger 3 and exposing optical system 4 are changed to those suitable for carrying out copying mode 3b with the selected type of photosensitive member, in step 11.

In step 11, the first variable voltage source 10 is set at +6.5 kv, the ON-OFF switch 13 of the light source 12 is turned on, the filter 15 is turned on, the second variable voltage source 17 is set at −5.7 kv, and the exposing filter 18 is turned off, for example.

The conditions for the selected copying mode are set in step 5, 6, 8, 10 or 11, and a copying operation is started as a copying starting button is despressed.

Setting of conditions of primary charging, secondary charging and exposing uitable for carrying out the selected copying mode has been described with reference to FIG. 24. Conditions of developing and transfer-printing are also set, along with the aforesaid steps. More specifically, when copying modes 1, 2a and 3a are carried out, the developing bias voltage source of the developer containing a developing agent of color α is turned on, and the transfer-printing charger is connected to a voltage source of a polarity suitable for the developing agent of color α. The developing containing a developing agent of color β is rendered operative when the copying modes 1, 2b and 3b are carried out, and the transfer-printing charger is connected to the voltage source so that the polarity of the former may suit the porality of the developing agent.

By controlling the conditions of the copying steps, as described hereinabove, electrostatic latent image regions are formed on the photosensitive member in such a manner that the surface potential of the image regions corresponding to the regions of colors α and β differ from one another when different copying modes are selected, while the regions of the photosensitive member corresponding to the background regions of the original have a surface potential of substantially zero. More specifically, the image regions corresponding to the regions of color α have a surface potential which of one of positive and negative polarities in copying modes 1, 2a and 3a, of the other polarity in copying mode 2b and substantially zero in copying mode 3b. The image regions corresponding to the regions of color β have a surface potential which is of the other polarity in copying modes 1, 2b and 3b, of one polarity in copying mode 2a and substantially zero in copying mode 3a.

Thus an electrostatic latent image is formed which has a polarity varying depending on the color or colors in which the original is to be duplicated, and a visible image of two colors or one color can be obtained as desired in one copying operation while portions of the original not desired to be reproduced are erased.

From the foregoing description, it will be appreciated that the invention enables copying to be effected by using the desired type of photosensitive member of a composite type and by selecting one of five different copying modes on the same copying apparatus, merely by automatically changing the conditions of the steps of charging and exposing to be followed.

The method described hereinabove enables the copying apparatus to be switched from one copying mode to any one of the rest of the copying modes of all the five copying modes. However, when necessary, the aforesaid method can be modified to enable the copying apparatus to be switched between two types of copying modes only or between three or four types of copying modes only as desired. In these cases, some of the steps shown in the flow chart in FIG. 24 may be dispensed with. However, a flow chart necessary for carrying into practice the desired switching method would be obvious in view of the flow chart in FIG. 24.

In the method described hereinabove, the original in two colors has been described as being reproduced in the same two colors. However, the invention is not limited to this specific form of copying. For example, an original in two colors α and β may be reproduced in two colors other than α and β. Alternatively, an original in two colors α and β may be reproduced in such a manner that regiosn of the original in color α are reproduced in color β and regions of the original in color β are reproduced in color α. This can be readily achieved by suitably selecting the colors and polarities of the developing agents.

The copying apparatus shown in FIGS. 22 and 23 are constructed such that they can be adapted to meet all the conditions of the photosensitive members and the copying modes. Copying apparatus shown in FIGS. 25 and 26 can be switched from one copying mode to another under the conditions shown in Table 1 by using a photosensitive member having two photoconductive layers, the L layer being insensitive to color β and the U layer being highly sensitive to color β.

Figure 25:
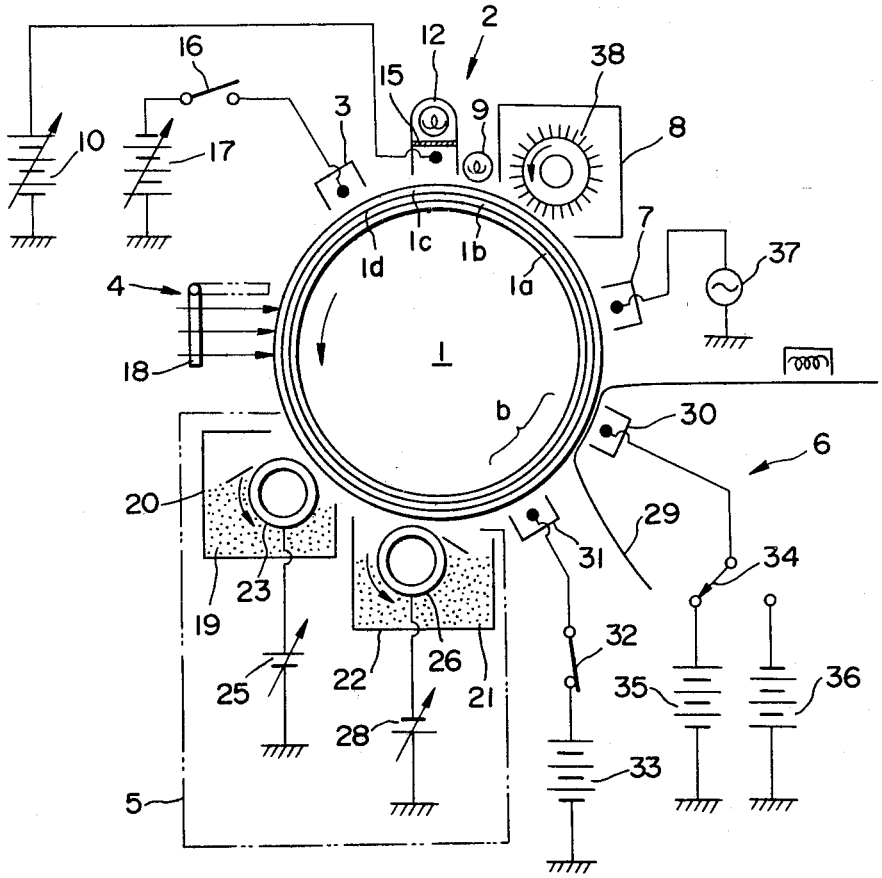
FIGS. 25 and 26 are views in explanation of different examples of essential portions of the copying apparatus that can be switched from one copying mode to another as shown in FIGS. 6–21.

In FIG. 25, a primary charger 2, a secondary charger 3, an exposing optical system 4, a developing device 5, a transfer-printing device 6, a charge removing device 7, a cleaning device 8 and a quenching device 9 (when necessary) are located around a photosensitive member 1 in the indicated order in the direction of rotation of the photosensitive member 1.

The primary charger 2 has a first variable voltage source 10 connected thereto and includes a filter 15 and a light source 12 for exposing the photosensitive member 1 to color β simultaneously as charging same. The filter 15 transmits color β (red, for example) only. An electric circuit may be provided so that when the variable voltage source 10 is turned on the light source 12 is simultaneously turned on. The polarity of the first variable voltage source 10 is selected to suit the polarity of the developing agent and the nature of the photosensitive member. In the example described hereinabove, a positive voltage is applied to the primary charger 2.

The exposing optical system 4 may be of any known type. As shown, the optical system 4 includes a color β blocking filter 18 which can be moved between an operative position disposed in the path of the light beam of the optical system 4 and an inoperative position disposed out of such path of the light beam.

The developing device 5 is constructed to carry out developing in two colors α and β. To this end, two developing agents of two colors may be contained as a mixture in one developer so as to develop colors α and β simultaneously. In the example shown, however, the developing device 5 includes two developers or a first developer 20 containing a color β developing agent 19 of negative polarity and having a developing a developing sleeve 23 to which a developing bias voltage is applied by a first developing bias voltage source 25 in the form of a variable positive voltage source, and a second developer 22 containing a color α developing agent 21 of positive polarity and having a developing sleeve 26 to which a developing bias voltage is applied by a second bias voltage source 28 in the form of a variable negative coltage source. The first developer 20 and second developer 22 can be controlled in operation so that they are individually moved to the operative position and the inoperative position.

The transfer-printing device 6 includes a transfer-printing charger 30 positioned against the photosensitive member 1 in a transfer-printing position in which a copy sheet 29 is brought into contact with the photosensitive member 1, and a preliminary transfer-printing charger 31 subjecting the photosensitive member 1 to preliminary charging before the latter reaches the transfer-printing position. The preliminary transfer-printing charger 31 is connected to a voltage source 33 via an ON-OFF switch 33 set at a predetermined voltage level.

The charger 30 can be switched by a change-over switch 34 between a first transfer-printing voltage source 35 and a second transfer-printing voltage source 36. The first and second transfer-printing voltage sources 35 and 36 are set at voltage levels suiting the developing of the latent image with the developing agents contained in the first developer (color $\beta$, for example) and the second developer (color $\alpha$, for example) respectively. For example, they are set at +5.5 kv and −5.0 kv respectively.

Figure 26:
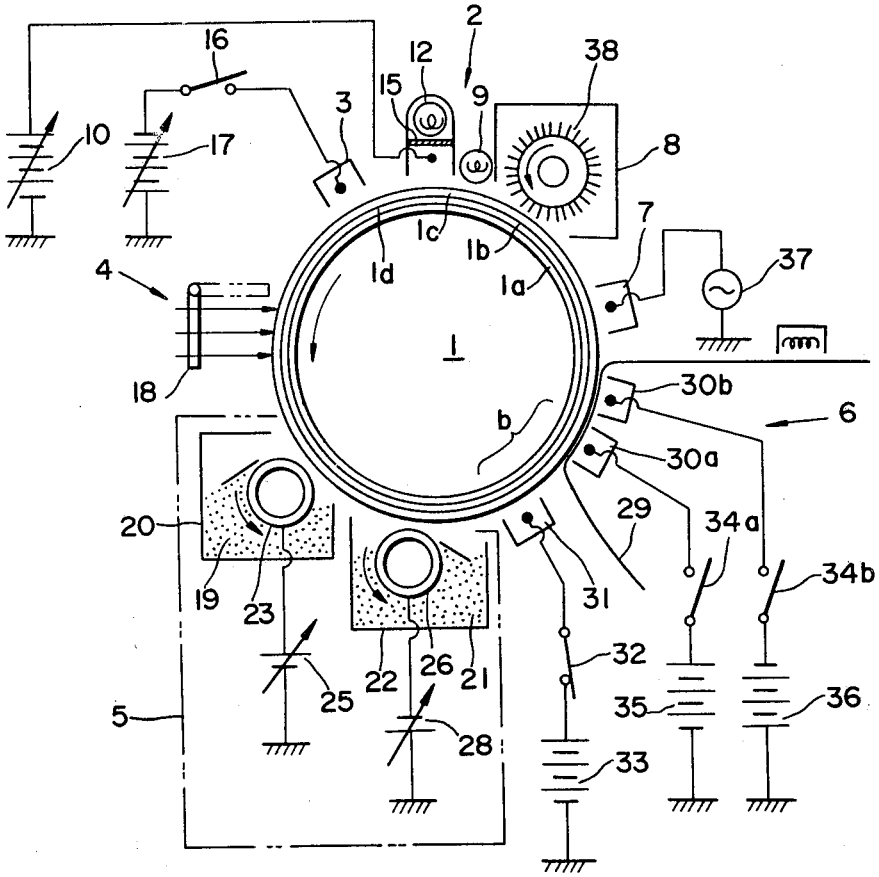

When copying mode 1 is carried out, the latent image is developed with the developing agents of colors $\alpha$ and $\beta$. To this end, as shown in FIG. 26, the first transfer-printing charger **30*a* connected to a first transfer-printing voltage source 35 via an ON-OFF switch 34*a* and the second the transfer-printing charger 30*b* connected to a second transfer-printing voltage source 36 via an ON-OFF switch 34*b*** are preferably arranged in side-by-side relation.

The charge removing device 7 is connected to a charge removing power pack 37.

The cleaning device 8 includes a cleaning brush 38.

A method of carrying out copying by switching the copying apparatus shown in FIG. 25 or 26 from one copying mode to another will be described by referring to a flow chart shown in FIG. 27.

In step 1, the desired copying mode is selected by actuating a change-over switch or a pushbutton on the operation panel. In selecting the desired copying mode, one of the aforesaid five types of copying mode may be directly selected. When copying mode **2*a*** is selected, the button for the mode is depressed, for example. Alternatively, a pushbutton for selecting the color in which copying is to be made or pushbutton requiring image regions to be duplicated in color other than the selected color to be erased may be depressed.

When any one of the five copying modes is directly selected, an electric circuit may be used which enables the first variable voltage source 10, second variable voltage source 17, the power source 25 of first developer and the power source 28 of second developer have to have their voltages automatically changed to predetermined levels upon production of a mode selecting signal. Such electric circuit will also enable the OFF-ONN switch 16, ON-OFF switch 32 of preliminary transfer-printing charger, and change-over switches 34 or **34*a* and 34*b*** of transfer-printing charger to be automatically turned on or off depending on the selected copying mode. The use of such electric circuit enables switching of the copying apparatus from one copying mode to another to be readily effected as by depressing a copying mode changing button.

Figure 27:
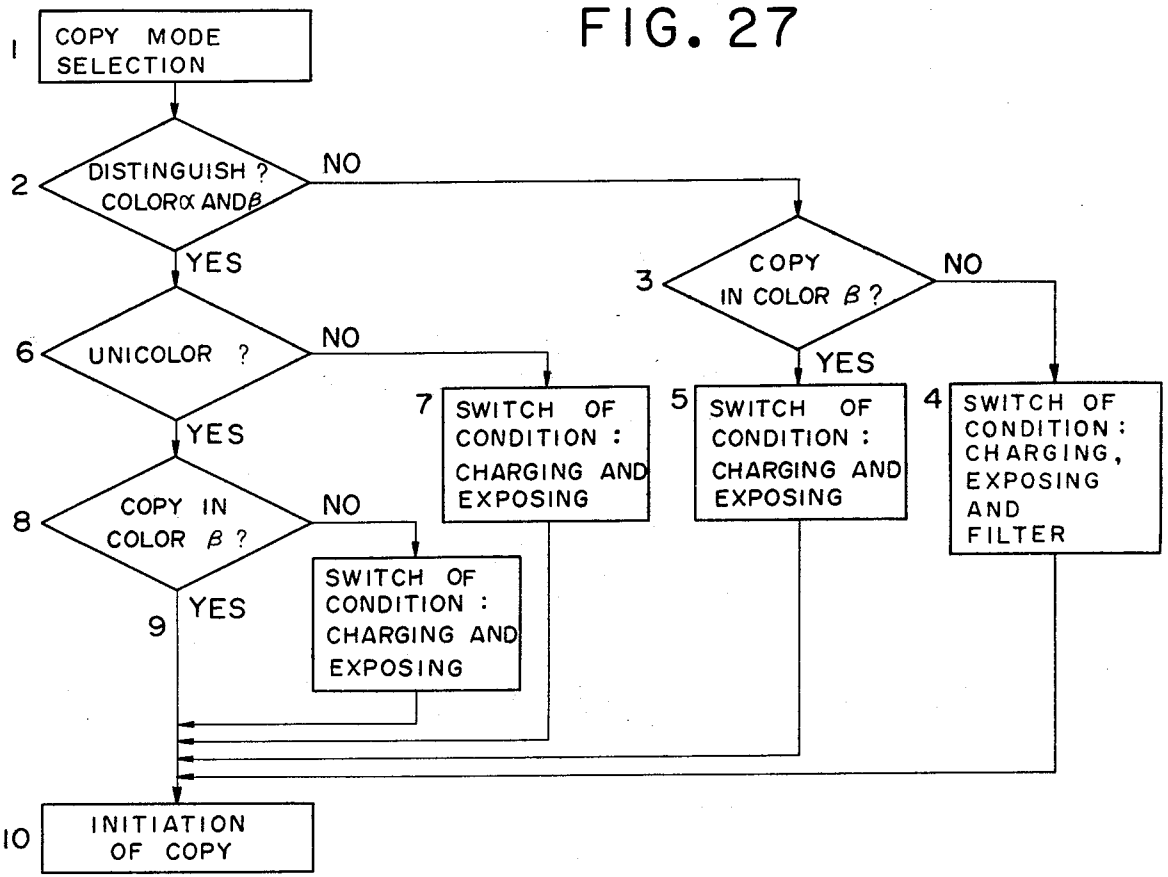
FIG. 27 shows one example of a flow chart showing the switching process carried out by using a photosensitive member having two photoconductive layers.

A control process shown in a flow chart in FIG. 27 may be used when selection of a color in which duplication is to be made or selection of copying of all the information on the original or erasing of part of the information is carried out by means of a change-over switch or pushbutton. The control process may also be sued when a pushbutton for selecting one of the five copying modes is depressed to change the conditions of charging, exposure, developing and transfer-printing to suit the selected copying mode while the control section judges what color or colors are to be used and whether or not part of the information is to be erased.

One example of such control process will be described by referring to the conditions shown in Table 1.

In step 1, the desired copying mode is selected by actuating a change-over switch or pushbutton on the operation panel.

In step 2, a selection is made as to whether image portions of color $\alpha$ and $\beta$ are to be discriminated. More specifically, a reply YES is given to the question whether image regions of colors $\alpha$ and $\beta$ are to be discriminated when two-color copying is to be effected by carrying out copying mode 1 and image regions of one color are to be erased by carrying out copying mode 3. A reply NO is given when all the image regions are to be reproduced by carrying out copying in one of the colors $\alpha$ and $\beta$.

In step 3, a judgement is given as to whether copying is to be carried out in color $\beta$ upon receipt of a NO signal in step 2.

When copying mode **2*a* is selected, a NO signal is produced in step 3 and the first variable voltage source 10 and second variable voltage source 17 have their voltage levels changed to suit the conditions of copying mode 2*a***.

In the example shown in Table 1, the first variable voltage source 10 and second variable voltage source 17 are set at +5.3 kv and −5.3 kv respectively. When the Carlson system is adopted, the first variable voltage source 10 is turned off and the second variable voltage source 17 is set at −5.0 kv. When the Carlson system is adopted, the light source 12 normally connected via a switch is turned OFF simultaneously.

In step 4, the exposing filter 18 is moved to the operative position.

When copying mode **2*b* is selected, a YES signal is produced in step 3 and the first variable voltage source 10 and second variable voltage source 17 have their voltages changed to suit the conditions of copying mode 2*b* in step 5. For example, the first variable voltage source 10 is set at +5.7 kv and the second variable voltage source 17** is turned off or set at −4.1 kv as shown in Table 1.

When a YES signal is produced in step 2 or either copying mode 1 or 3 is selected, it is judged whether copying to be effected in one color (step 6).

When copying mode 1 is selected in which colors $\alpha$ and $\beta$ are both used, a NO signal is produced in step 6. The production of the NO signal causes the first variable voltage source 10 and second variable voltage source 17 to have their voltages changed to suit the conditions of copying mode 1 (step 7). For example, the first variable voltage source 10 and second variable voltage source 17 are set at +6.5 kv and −5.5 kv respectively as shown in Table 1.

When a YES signal is produced in step 6, a judgement is given as to whether copying is to be effected in color $\beta$ (step 8).

When copying mode 3a is selected in which image regions of color $\beta$ are erased and image regiosn of color $\alpha$ only are reproduced, a NO signal is produced in step 8 and the first variable voltage source 10 and second variable voltage source 17 have their voltages changed to suit the conditions of copying mode 3a (step 9). For example, the first variable voltage source 10 and second variable voltage source 17 are set at +6.5 kv and −5.5 kv respectively as shown in Table 1.

When copying mode 3b is selected in which image portions of color $\alpha$ are erased and image portions of color $\alpha$ only are reproduced, a YES signal is produced in step 8. If the copying apparatus is set such that charging and exposing conditions are set beforehand at the conditions of copying mode 3b, the production of the YES signal brings the copying apparatus to a condition in which copying can be started by depressing a button, for example. When the copying apparatus is set at other copying mode beforehand, the production of a YES signal causes the first variable voltage source 10 and second variable voltage source 17 to have their voltages changed to suit the conditions of copying mode 3b.

Copying conditions are changed to suit the selected copying mode by following the aforesaid steps. By depressing a pushbutton for starting copying, the control is actuated to carry out one copying step after another.

The process for changing the conditions of primary charging, secondary charging and exposing to suit the selected copying mode has been mainly described by referring to FIG. 27. Conditions of developing and transfer-printing may be changed simultaneously. More specifically, the second developer 22 and second transfer-printing voltage source 36 are turned on when copying modes 1, 2a and 3a are selected and the first developer 20 and first transfer-printing voltage source 35 are turned on when copying modes 1, 2b and 3b are selected, simultaneously as the steps shown in FIG. 27 are followed.

By changing the copying conditions as described hereinabove, the surface potential of the photosensitive member is rendered substantially zero in regions thereof corresponding to the background of the image of the original. The surface potential of the photosensitive member in regions thereof corresponding to the regions of color $\alpha$ of the original is rendered negative when copying modes 1, 2a and 3a are selected, rendered positive when copying mode 2b is selected and rendered substantially zero when copying mode 3b is selected. The surface potential of the photosensitive member in regions thereof corresponding to the regions of color $\beta$ of the original is rendered positive when copying modes 1, 2b and 3b are selected, rendered negative when copying mode 2a is selected and rendered substantially zero when copying mode 3a is selected.

Thus electrostatic latent images of different polarities depending on the color or colors in which the original is to be reproduced are formed and developed by using developing agents suiting the polarities of the latent images in one developing step to produce visible images of two colors or predetermined one color in which regions of the original not desired to be reproduced are erased.

From the foregoing description, it will be appreciated that the invention of an original of two colors to be effected by selecting any one of five copying modes by a simple process of changing the conditions of charging and exposing, so that a plurality of copying modes can be selectively carried out by using the same copying apparatus. The copying apparatus can be switched between five different copying modes. When necessary, the copying apparatus may be constructed so that it is switched between two, three or four copying modes. Depending on the type of selection, some steps in the flow chart shown in FIG. 27 may be dispensed with (the same goes with the examples subsequently to be described).

The polarities shown in Table 1 may be reversed for primary charging and secondary charging depending on the polarities of the developing agents and the nature of the photosensitive member.

II-B A Photosensitive Member of Type II-B.

In this type of photosensitive member, the L layer is formed of a material highly sensitive to light of all colors or light of color $\beta$ and becoming conductive when positively or negatively charged and capable of providing the L layer with a potential which is high enough to enable a surface potential to be formed on the photoconductive member when the surface of the photosensitive member is subjected to corona discharge of positive or negative polarity. The material has a property such that electrons or holes are introduced from the conductive base plate into the L layer when charged positively or negatively. The U layer is formed of a material having substantially no sensitivity to light of color $\beta$ only and having the property of blocking light of color $\alpha$ (when color $\alpha$ is black, the same result as blocing light of color $\alpha$ is obtained even if the material transmits light of substantially all colors) and capable of providing the U layer with a potential which is high enough to enable a surface potential to be formed on the photoconductive member when the surface of the photosensitive member is subjected to corona discharge of positive or negative polarity.

When color $\alpha$ is black and color $\beta$ is red, for example, the conductive base plate 1a may be in the form of a drum of aluminum or a polyester film having a coat of aluminum deposited by vaporization in vacuum. The L layer 1b may be composed of a coat of selenium of 65 $\mu$m thick and a coat of selenium telluride (10 weight %) of 5 $\mu$m thick. The U layer may be composed of a coat of selenium of 1 $\mu$m thick serving as an electric charge generating layer and a coat of poly-N-vinyl carbazole/-polyester 49000=9/1 coat of 10 $\mu$m thick serving as an electric charge migrating layer. The intermediate layer 1d may be formed of Shadolack (trade name of a product by Shadoe Company, Ltd.) in a thickness of 1 $\mu$m.

When each one of the aforesaid five copying modes is carried out by using this type of photosensitive member, the copying steps followed in each copying mode are as follows.

(1) Copying Mode 1

Copying steps are followed in the order described hereinafter.

(i) Primary Charging of the Photosensitive Member (One Example, at −6.5 kv)

Figure 28A:
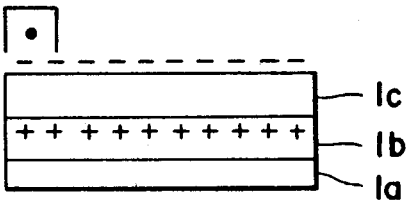
FIGS. 28–38 are views in explanation of another type of photosensitive member, FIG. 28 showing changes in electric charge on the photosensitive member occuring in copying mode 1 shown in a, b, c and d in the order of steps, FIG. 29 showing changes in the surface potential of the photosensitive member, FIGS. 30 showing changes in the surface potential of the photosensitive member shown in a, b, c and d in the order of steps occurring in copying mode 2*a*, FIG. 31 showing changes in the electric charge on the photosensitive member occuring in copying mode 2*a*, FIGS. 32, 34 and 36 showing changes in the electric charge on the photosensitive member occurring in copying mode 2*b*, copying mode 3*a* and copying mode 3*b* respectively shown in a, b and c or a, b, c and d in the order of steps, FIGS. 33, 35 and 37 showing changes in the surface potential of the photosensitive member in copying mode 2*b*, copying mode 3*a* and copying mode 3*b* respectively and FIG. 38 being a view showing one example of the essential portions of the copying apparatus that can be switched from one copying mode to another by using the photosensitive member shown in FIGS. 28–37.
Figure 29:
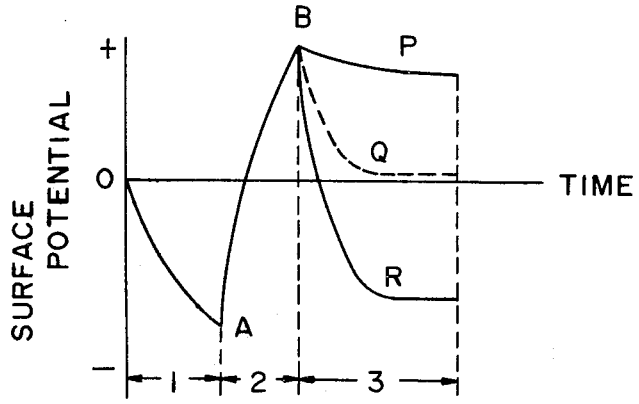

As shown in FIG. 28a, the photosensitive member is negatively charged on its surface, and a portion of the L layer 1b near the boundary between the L layer 1b and U layer 1c is positively charged. As indicated at a point A in FIG. 29a, the surface potential of the photosensitive member is negative.

(ii) Secondary Charging of the Photosensitive member with Polarity Opposite That of Primary Charging (One Example, at +5.5 kv)

Figure 28B:
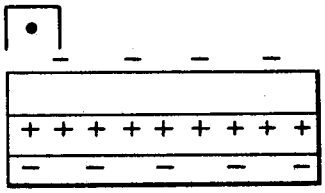

As shown in FIG. 28*b*, part of the charge on the surface of the photosensitive member is neutralized and an apparent surface charge is reduced, and a charge of the same polarity as that of the surface is produced in the conductive base plate 1*a*. As indicated at a point B in FIG. 29, the surface potential of the photosensitive member is positive.

(iii) Exposing to Optical Image

Figure 28C:
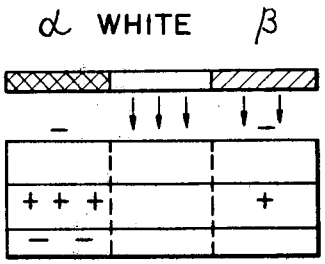

Following exposure of the photosensitive member to an optical image, the following changes occur as shown in FIG. 28*c*. Regions of the photosensitive member corresponding to the white regions or no image regions of the original have their charge removed depending on the properties of the photoconductive layers of the L layer 1*b* and U layer 1*c*. Regions of the photosensitive member corresponding to the regions of color $\alpha$ or black, for example have their charge all remain intact, and in regions of the photosensitive member corresponding to the regions of color $\beta$ or red, for example, the L layer becomes conductive and has its surface potential and charge of the opposite polarity induced to be produced in the L layer by the remaining surface charge. The surface potential of the photosensitive member becomes substantially zero as represented by a curve Q in FIG. 29 in regions corresponding to the regions of white color of the original, becomes positive as represented by a curve P in FIG. 29 in regions corresponding to the regions of color $\alpha$ of the original, and becomes negative in regions corresponding to the resions of color $\beta$ of the original.

(iv) Developing

Developing is carried out by using a toner of color $\alpha$ (black, for example) of negative polarity and a toner of color $\beta$ (red, for example) of positive polarity, as shown in FIG. 28*b*. The toner of color $\alpha$ adheres to the regions of the photosensitive member having a positive surface potential, and the toner of color $\beta$ adheres to the regions of the photosensitive member having a negative surface potential.

One example of developing process is as follows. Primary developing is carried out with the positive toner of color $\beta$ by impressing a developing bias voltage of −100 v, and secondary developing is carried out with the negative toner of color $\alpha$ by impressing a developing bias voltage of +100 v. The polarity and color may be reversed. Alternatively, a mixture of toners of two colors may be used to develop regions of two colors simultaneously in one developing operation.

(v) Transfer-Printing

The visible image formed by developing is printed on copy sheets by transfer-printing.

One example of transfer-printing process is as follows. The photosensitive member is subjected to preliminary charging by impressing a voltage of −4.5 kv before transfer-printing is carried out. Then, a copy sheet is brought into contact with the photosensitive member to carry out primary transfer-printing by using a charger of −5.5 kv and secondary transfer-printing by using a charger of +5.0 kv.

(vi) After-Treatment

Following transfer-printing, the image printed on the copy sheets are fixed in the usual manner, and the photosensitive member is subjected to charge removing and cleaning.

(2) Copying Mode 2*a*

Copying steps are followed in the order described hereinafter.

(i) Primary Charging of the Photosensitive Member (One Example, at −6.5 kv)

Figure 30A:
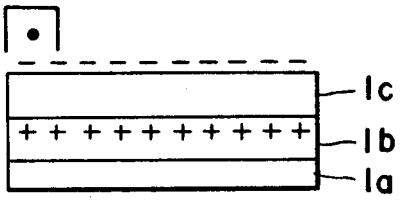

As shown in FIG. 30*a*, the surface of the photosensitive member is negatively charged, and a portion of the L layer 1*b* near the boundary between the L layer 1*b* and U layer 1*c* is positively charged. As indicated at a point A in FIG. 31, the surface potential of the photosensitive member is negative.

(ii) Secondary Charging of the Photosensitive Member with Polarity Opposite That of the Primary Charging (One Example, at +5.0 kv)

Figure 30B:
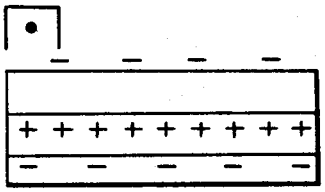

As shown in FIG. 30*b*, the charge on the surface of the photosensitive member is substantially neutralized and the apparent surface potential is removed, and a charge opposite that of the L layer 1*b* is produced in the conductive base plate 1*a*. As indicated at a point B in FIG. 31, the surface of the photosensitive member is positive.

(iii) Exposing Through $\beta$ Color Absorbing Filter

Figure 30C:
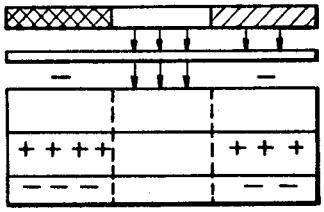
Figure 28D:
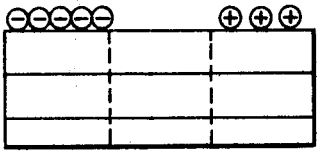

As shown in FIG. 30*c*, regions of the photosensitive member corresponding to the white regions of the original have their charge removed because the L layer 1*b* becomes conductive. Regions of the photosensitive member corresponding to the regions of color $\alpha$ of the original have their charge remain intact, while regions corresponding to the regions of color $\beta$ have the charge of the L layer 1*b* remain partly intact, with the rest of the charge being removed.

Figure 31:
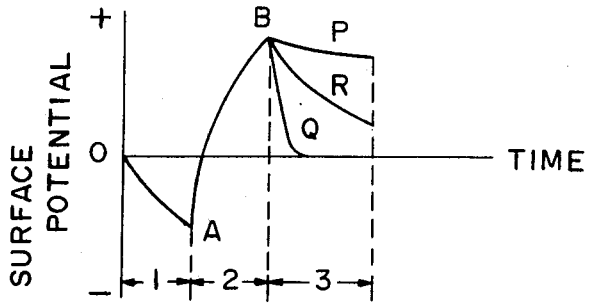

As shown in FIG. 31, the surface layer of the photosensitive member becomes substantially zero (+30 v) in regins thereof corresponding to the white regions of the original as represented by a curve Q, has substantially the same potential (+600 v) as after the secondary charging in regions thereof corresponding to the regions of color $\alpha$ as represented by a curve P, and has its potential reduced slightly (+300 v) in regions corresponding to the regions of color $\beta$ as compared with that in the regions of color $\alpha$ as represented by a curve R, although the potential is of the same polarity.

(iv) Developing

Developing is carried out by using a developing agent of color $\alpha$. A developing bias voltage of +150 v may be applied in developing the latent image.

Since no developing agent of color $\beta$ is required, a developer containing a developing agent of color $\beta$ is rendered inoperative when the developing device includes a developer containing a developing agent of color $\alpha$ and a developer containing a developing agent of color $\beta$.

(v) Transfer-Printing

The visible image formed by developing is printed by transfer-printing on copy sheets. Copy sheets are brought into contact with the photosensitive member following developing, and transfer-printing is carried out by using a charger of +5.0 kv.

(vi) After-Treatment the copy sheets are fixed by the usual manner, and the photosensitive member is subjected to charge removing and cleaning.

(3) Copying Mode 2*b*

Copying steps are followed in the order described hereinafter.

(i) Primary Charging of the Photosensitive Member (One Example, at −5.5 kv)

Figure 33:
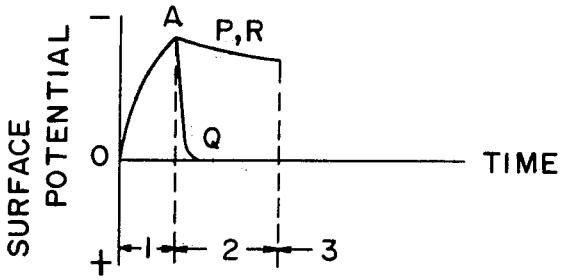
Figure 32A:
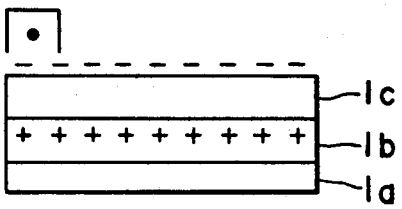

As shown in FIG. 32*a*, the surface of the photosensitive member is negatively charged, and a portion of the L layer 1*b* near the boundary between the L layer 1*b* and U layer 1*c* is positively charged. As indicated at a point A in FIG. 33, the surface potential of the photosensitive member is negative.

(ii) Exposing (Secondary Charging is Dispensed with) to Optical Image

Figure 32B:
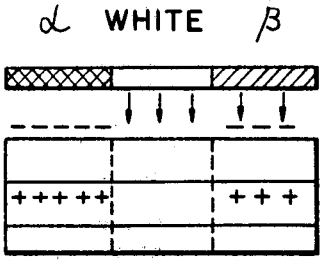
Figure 32C:
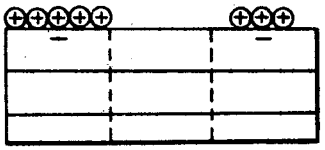

As shown in FIG. 32*b*, regions corresponding to the white regions of the original have their charge removed because the L layer becomes conductive. In regions corresponding to the regions of color $\alpha$ of the original, the charge remains intact because the L layer is not rendered conductive, and in regions corresponding to the regions of color $\beta$ of the original, the charge remains intact because of the rectifying property, although the L layer becomes conductive. In regions corresponding to the white regions of the original, the surface potential of the photosensitive member becomes substantially zero (−10 v) as represented by a curve Q in FIG. 33. In regions corresponding to the regions of colors $\alpha$ and $\beta$, the surface potential which is negative is substantially the same as after the primary charging (−580 v ($\alpha$) and −600 v ($\beta$) respectively).

(iii) Developing

Developing is carried out by using a developer containing a developing agent of color $\beta$. As an example, the developing agent of color $\beta$ has positive polarity and a developing bias voltage of −50 v is applied when developing is effected. Since no developing agent of color $\alpha$ is required, a developer containing a developing agent of color $\alpha$ is rendered inoperative when the developing device includes a developer containing a developing agent of color $\alpha$ and a developer containing a developing agent of color $\beta$.

(iv) Transfer-Printing

Following developing, copy sheets are brought into contact with the photosensitive member to print visible images on the copy sheets by transfer-printing. As an example, a transfer-printing charger may be used to impress a voltage of −5.5 kv.

(v) After-Treatment

Following transfer-printing, the printed images on the copy sheets are fixed in the usual manner, and the photosensitive member is subjected to charge removing and cleaning.

A developer containing a black toner of the same polarity as the developing agent of color $\beta$ may be separately provided and selectively actuated, so that the latent image of color $\alpha$ or black, for example, can be formed as in copying mode 2*a*. That is, copying mode 2*a* can be carried out.

(4) Copying Mode 3*a*

Copying steps are followed in the order described hereinafter.

(i) Primary Charging of the Photosensitive Member (One Example, at −6.0 kv)

Figure 34A:
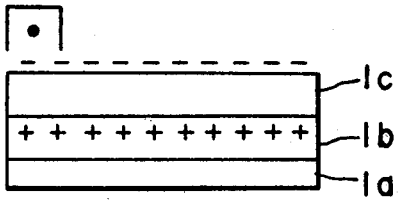

As shown in FIG. 34*a*, the surface of the photosensitive member is negatively charged and a portion of the L layer 1*b* near the border between the L layer 1*b* and U layer 1*c* is positively charged. The surface potential of the photosensitive member is negative as indicated at a point A in FIG. 35.

(ii) Secondary Charging of the Photosensitive Member with Polarity Opposite That of Primary Charging (One Example, at +6.0 kv)

Figure 34B:
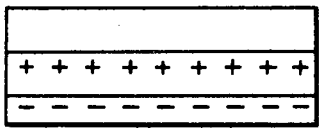

As shown in FIG. 34*b*, the surface potential is all neutralized and a charge of a polarity opposite that of the L layer 1*b* is induced to develop in the conductive base layer 1*a*. The surface layer is positive as indicated at a point B in FIG. 35.

(iii) Exposing to Optical Image

Figure 34C:
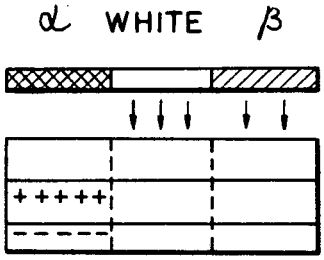

As shown in FIG. 34*c*, regions of the photosensitive member corresponding to the white regions and regions of color $\beta$ of the original have their charge all removed because of the L layer 1*b* becoming conductive, but regions corresponding to the regions of color $\alpha$ have their charge remain intact.

Figure 35:
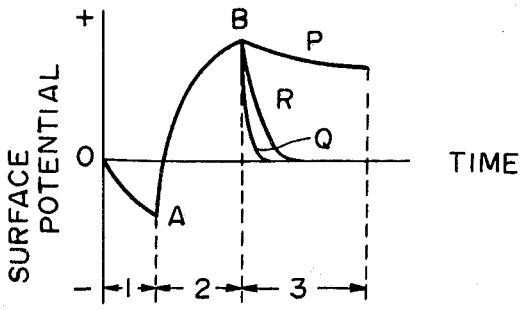

As represented by a curve Q in FIG. 35, the surface potential becomes substantially zero in regions corresponding to the white regions. The surface potential becomes substantially zero as represented by a curve R in regions corresponding to the regions of color $\beta$, and substantially equal (positive) to that following secondary charging in regions corresponding to the regions of color $\alpha$ as represented by a curve P. That is, the surface potential of regions corresponding to the background of the original and the regions of color $\beta$ becomes substantially zero while that of regions corresponding to the regions of color $\alpha$ only remains charged.

(iv) The latent image is developed by using a developer of color $\alpha$.

Figure 34D:
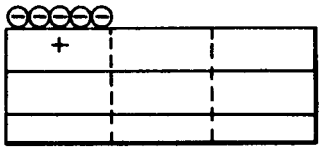

A developer of color $\beta$ is rendered inoperative. As shown in FIG. 34*d*, regions corresponding to the regions of color $\alpha$ of the original are only developed into a visible image. As a bias voltage for developing, a voltage of +150 v may be impressed, for example.

(v) Transfer-Printing

Copy sheets are brought into contact with the photosensitive member, and the visible image thereon is printed on the copy sheets by using a transfer-printing charger of +50 kv, for example.

(vi) After-Treatment

Following transfer-printing, the printed images on the copy sheets are fixed in the usual manner, and the photosensitive member is subjected to charge removing and cleaning.

(5) Copying Mode 3*b*

Copying steps are followed in the order described hereinafter.

(i) Primary Charging of the Photosensitive Member (One Example, at −6.5 kv)

Figure 36A:
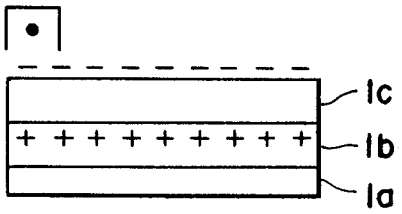
Figure 37:
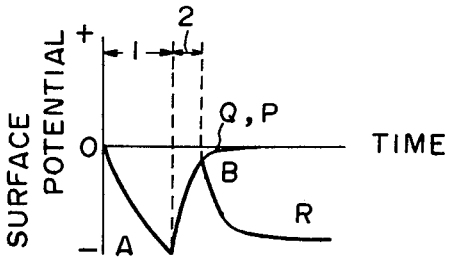

Primary charging is carried out in the same manner as in copying mode 1. FIG. 36*a* shows charges of the photosensitive member. The surface potential is negative as indicated at a point A in FIG. 37.

(ii) Secondary Charging of the Photosensitive Member with Polarity Opposite That of Primary Charging (One Example, at +4.2 kv)

Figure 36B:
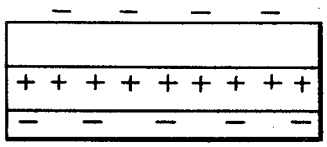
Figure 36C:
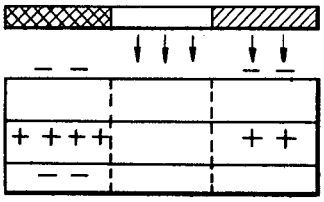
Figure 36D:
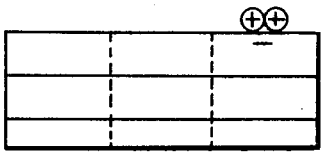

As shown in FIG. 36*b*, part of the surface charge is neutralized to cause a charge of the same polarity as the surface charge to be produced in the conductive base layer 1*a*. The surface potential becomes substantially zero as indicated at a point B in FIG. 37.

(iii) Exposing to Optical Image

The L layer 1*b* becomes conductive so that charge of regions corresponding to the white regions of the original is all removed. In regions corresponding to the regions of color $\beta$, charge of the conductive base plate 1*a* is removed and charge of the opposite polarity corresponding to surface potential remains intact in the L layer 1*b*. All the charge of regions corresponding to the regions of color $\alpha$ remains intact. The surface potential of the photosensitive member becomes negative only in regions corresponding to the regions of color $\beta$ as represented by a curve R in FIG. 37, and becomes substantially zero in regions corresponding to the white regions and regions of color $\alpha$.

(iv) Developing

The latent image is developed by using a developer of color $\beta$ and a developer of color $\alpha$ is rendered inoperative. As an example, a developing bias voltage of $-100$ v may be impressed for developing. Regions corresponding to the regions of color $\beta$ of the original are only developed, and no image is formed in the background regions and regions of color $\alpha$ of the original.

(v) Transfer-Printing

Copying sheets are brought into contact with the photosensitive member to print visible images on the copy sheets. A transfer-printing charger of $-5.5$ kv may be used.

(vi) After-Treatment

Following transfer-printing, printed images on the copy sheets are fixed in the usual manner, and the photosensitive member is subjected to charge removing and cleaning.

In copying modes 3*a* and 3*b*, image regions of the two colors may be formed into latent images regions of opposite polarities while the copying apparatus is set for charging conditions of copying mode 1. The developer of one color may be rendered inoperative to leave the image regions of one color undeveloped, or the image regions of two colors are both developed by using developers of the two colors while turning off the preliminary transfer-printing charger. That is, the charger of corona discharge for attracting the developing agent of the color to be erased is turned off, to prevent the image regions of the color to be erased from being printed on copy sheets by transfer-printing.

To facilitate understanding of the copying steps and copying conditions of five copying modes carried out by using the photosensitive member of the type described, the description set forth hereinabove are shown in tabulated form in Table 2.

TABLE 2

| Copying Step | | Copying Mode 1 Color $\alpha$ (Black), Color $\beta$ (Red) | 2a White, Color $\alpha$ (Black) | 2b White, Color $\beta$ (Red) | 3a Color $\beta$ (Red) Erased | 3b Color $\alpha$ (Black) Erased |
|---|---|---|---|---|---|---|
| Primary Charging | | ON (−6.5 kv) | ON (−6.5 kv) | ON (−5.5 kv) | ON (−6.0 kv) | ON (−6.5 kv) |
| Secondary Charging | | ON (+5.5 kv) | ON (+5.5 kv) | OFF | ON (+6.0 kv) | ON (+4.2 kv) |
| Exposing to Optical Image | | ON | ON | ON | ON | ON |
| Exposing Filter | | OFF | ON | OFF | OFF | OFF |
| Developing | First Developing (⊕ Red) | ON | OFF | ON | OFF | ON |
| | First Developing Bias | ON (−100 v) | OFF | ON (−50 v) | OFF | ON (−100 v) |
| | Second Developing (⊖ Black) | ON | ON | OFF | ON | OFF |
| | Second Developing Bias | ON (+100 v) | ON (+150 v) | OFF | ON (+150 v) | OFF |
| Preliminary Transfer-Printing Charging | | ON (−4.5 kv) | OFF | OFF | OFF | OFF |
| Transfer-Printing | First Transfer-Printing Voltage Source | ON (−5.5 kv) | OFF | ON (−5.5 kv) | OFF | ON (−5.5 kv) |
| | Second Transfer-Printing Voltage Source | ON (+5.0 kv) | ON (+5.0 kv) | OFF | ON (+5.0 kv) | OFF |
| After-Treatment (Charge Removing, Cleaning, Quenching, Image Fixing) | | ON | ON | ON | ON | ON |

It will be seen that by switching the copying apparatus between the charging conditions and the use and non-use of the filter at the time of exposing the photosensitive member to an optical image as shown in Table 2, it is possible to selectively form different electrostatic latent image regions on the same photosensitive member from the same original of two colors in different five copying modes by following the three steps of primary charging, secondary charging and exposing to an optical image. It is necessary to select suitable developing and transfer-printing conditions or a developing bias voltage and a transfer-printing voltage depending on the copying mode carried out.

Figure 38:
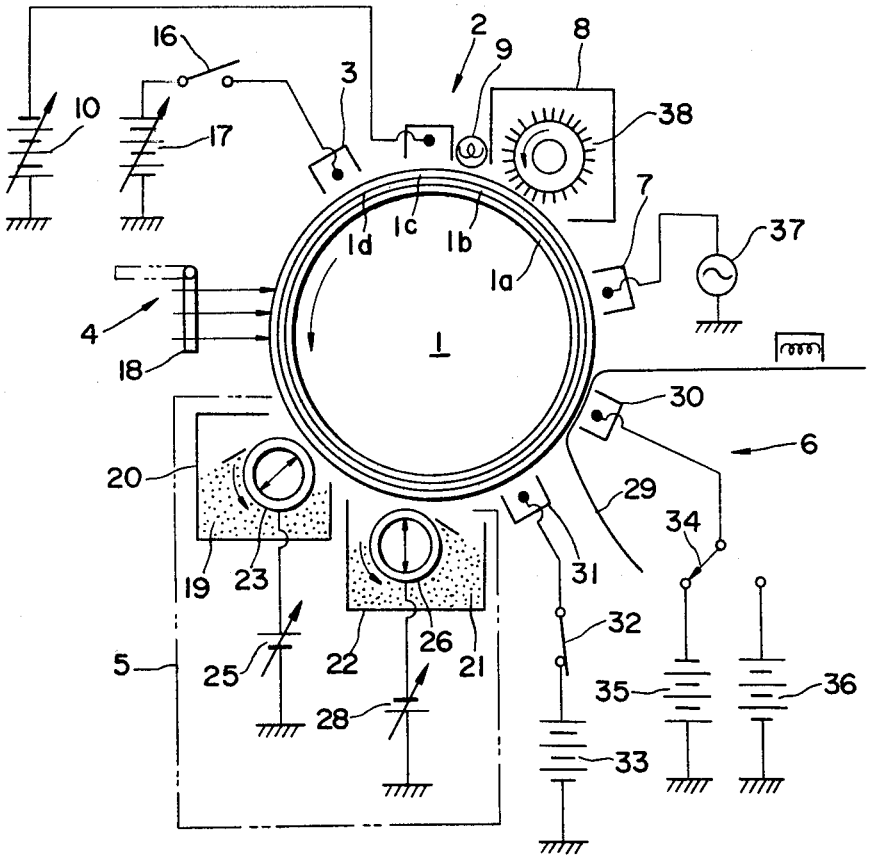

One example of the copying apparatus for carrying this embodiment into practice will be described. In FIG. 38, the photosensitive member 1 is in the form of a drum. However, the invention is not limited to this specific form of the photosensitive member and the photosensitive member may be in the form of a sheet.

Located around the photosensitive member 1 in the direction of rotation thereof are primary charger 2, a secondary charger 3, an exposing optical system 4, a developing device 5, a transfer-printing device 6, a charge remover 7, a cleaning device 8 and a quenching device 9 (when necessary) in the indicated order.

The primary charger 2 is connected to a first variable voltage source 10 in such a manner that in the example shown in the explanation of the copying steps the voltage source 10 applies a negative voltage to the primary charger 2. By considering the polarity of the developing agent and the characteristic of the photosensitive member, a positive voltage may be impressed on the primary charger 2.

The secondary charger 3 is connected to a second variable voltage source 17 via an ON-OFF switch 16, the second variable voltage source 17 being constructed to impress on the secondary charger 3 a voltage of the opposite polarity that applied to the primary charger 2.

An AC power source may be used as the second variable voltage source 17.

The exposing optical system 4 may be of any known type. The optical system 4 is provided with a $\beta$ color blocking filter 18 movable between an operative position disposed in the path of the light beam of the optical system 4 and an inoperative position disposed out of the path of the light beam.

The developing device 5 can carry out developing by using two developing agents of colors $\alpha$ and $\beta$. To this end, one developing may be used that contain a mixture of developing agents of two colors so that developing of colors $\alpha$ and $\beta$ can be simultaneously effected. In the example shown, the developing device 5 includes a first developer 20 containing a developing agent 19 of negative polarity and color $\alpha$ and having a developing sleeve 23 connected to a first developing bias voltage source 25 which is a variable voltage source of positive polarity for impressing a developing bias voltage on the developing sleeve 15, and a second developer 22 containing a developing agent 21 of positive polarity and color $\beta$ and having a developing sleeve 26 connected to a second developing bias voltage source 28 which is variable voltage source of negative polarity for impressing a developing bias voltage on the developing sleeve 26. The first developer 20 and second developer 22 can be individually switched between an operative position and an inoperative position.

The transfer-printing device 6 includes a transfer-printing charger 30 positioned against the photosensitive member 1 in a transfer-printing position in which a copy sheet 29 is interposed between the transfer-printing charger 30 and photosensitive member 1, and a preliminary transfer-printing charger 31 for subjecting the photosensitive member to preliminary charging before the latter reaches the transfer-printing position. The preliminary transfer-printing charger 31 is connected to via an ON-OFF switch 32 to a voltage source 33 which is set at a predetermined voltage level.

Figure 39:
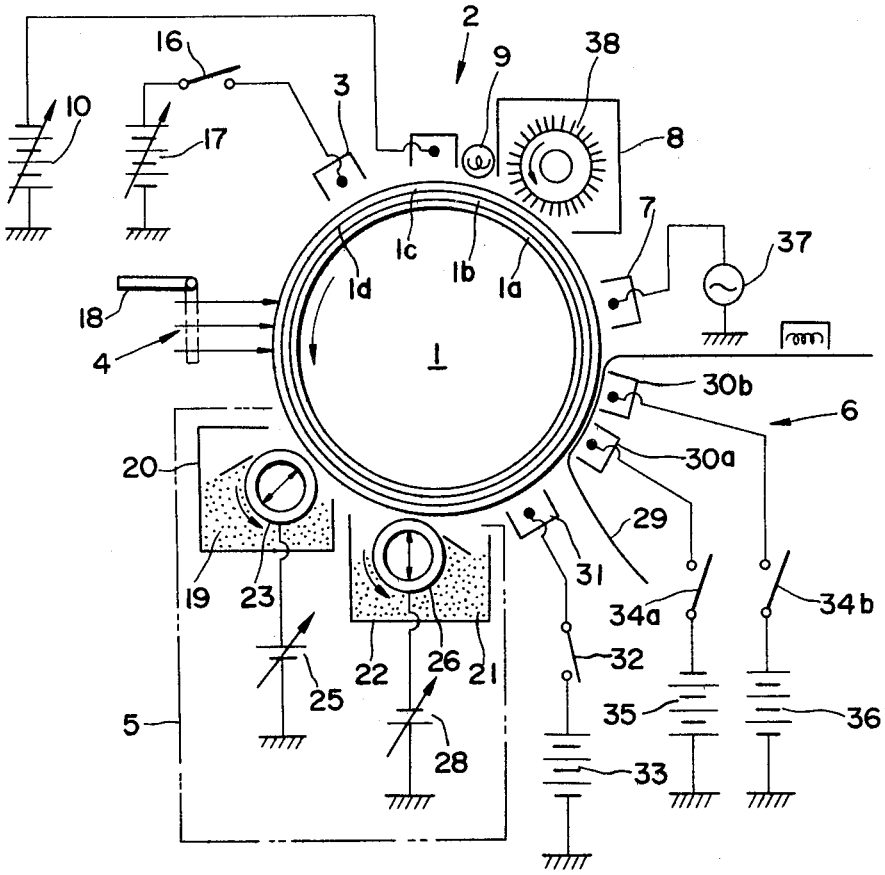
FIG. 39 is a view showing a modification of the copying apparatus shown in FIG. 38.

The transfer-printing charger 30 can be switched between a first transfer-printing voltage source 35 and a second transfer-printing voltage source 36 by means of a change-over switch 34. When copying mode 1 is carried out, a first transfer-printing charger **30*a* connected to the first transfer-printing voltage source 35 via an ON-OFF switch 34*a* and a second transfer-printing charger 30*b* connected to the second transfer-printing voltage source 36 via an ON-OFF switch 34*b* are advantageously located in side-by-side relation as shown in FIG. 39**.

The first transfer-printing voltage source 35 and second transfer-printing voltage source 36 are each set at voltage levels suitable for developing the developing agent (of color $\alpha$, for example) of the first developer 20 and the developing agent (of color $\beta$, for example) of the second developer 22, respectively. In the example described hereinabove, the first transfer-printing voltage source 35 and second transfer-printing voltage source 36 are set at $-5.5$ kv and 30 5.0 kv respectively.

The charge remover 7 is connected to a charge removing power pack 37.

The cleaning device 8 is shown as using a cleaning brush 38.

In the figures, devices concerned in copying an original by using the photosensitive member of the aforesaid type are mainly shown. Device not shown in the figure may be of known type.

The process for switching the copying apparatus shown in FIG. 38 or 39 from one copying mode to another in carrying out copying of an original may be controlled by following the steps shown in the flow chart of FIG. 27 in the same manner as the process for switching the copying apparatus shown in FIG. 25 or 26. The conditions of voltages shown in Table 2 may be used. Detailed description will be omitted.

II-C A Photosensitive Member of the Type II-C

In this type of photosensitive member, the L layer is formed of a material sensitive to light of color $\beta$ when negatively charged and capable of providing the L layer with a potential which is high enough to enable a surface potential to be formed on the photosensitive member when the surface of the photosensitive member has its surface exposed to positive or negative corona discharge. The U layer is formed of a material transmitting light of color $\beta$ and substantially insensitive to light of color $\beta$ when charged. Such material is sensitive to visible light beams of colors other than $\beta$ and capable of providing the U layer with a potential high enough to enables a surface potential to be formed on the photosensitive member when the photosensitive member has its surface exposed to positive or negative corona discharge.

Assume that red and black are used as colors $\beta$ and $\alpha$. The conductive base plate **1*a* may be an aluminum drum or a polyester film having an aluminum coat applied thereto by vaporization deposition in vacuum. The L layer 1*b*** may be a layer of material including a eutectic crystal complex having a thickness of about 30 $\mu$m. The U layer may include a charge developing layer of about 1 $\mu$m thick formed of selenium, for example, and a charge migration layer of about 10 $\mu$m thick formed of poly N-vinylcarbazole/polyester 49000=9/1, for example.

An intermediate layer of about 1 $\mu$m thick formed of polyvinyl pyrolidone/polyvinyl alcohol=7/3 may be provided between the L layer and U layer.

When each one of the aforesaid five copying modes is carried out by using this type of photosensitive member, the copying steps followed in each copying mode are as follows.

(1) Coyping Mode 1

Copying steps are followed in the order described hereinafter.

(i) Primary Charging of the Photosensitive Member under Exposure to Color $\beta$ (Red, for example)

As shown in FIG. 40, the photosensitive member is charged at $-6.5$ kv, for example, so that the surface of the photosensitive member is negatively charged and a portion of the L layer **1*b* near the boundary between the L layer 1*b* and U layer 1*c* is positively charged. The surface potential is negative as shown at a point A in FIG. 41**.

Figure 40A:
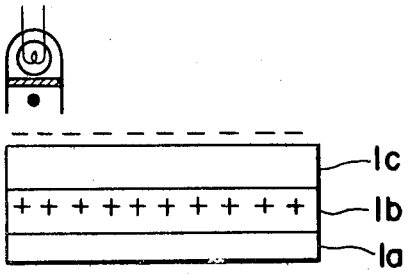
FIGS. 40–49 are views in explanation of still another type of photosensitive member, FIG. 40 showing changes in the electric charge on the photosensitive member occurring in copying mode 1 in the order of steps in a, b, c and d, FIG. 41 showing changes in the surface potential of the photosensitive member, FIG. 42 showing changes in the electric charge on the photosensitive member occurring in copying mode 2*a* in the order of steps in a, b and c, FIG. 43 showing changes in the surface potential of the photosensitive member occurring in copying mode 2*a*, FIGS. 44, 46 and 48 showing changes in the electric charge on the photosensitive member occurring in copying mode 2*b*, copying mode 3*a* and copying mode 3*b* respectively shown in a, b and c or in a, b, c and d in the order of steps, and FIGS. 45, 47 and 49 showing changes in the surface potential of the photosensitive member occurring in copying mode 2*b*, copying mode 3*a* and copying mode 3*b* respectively.
Figure 40B:
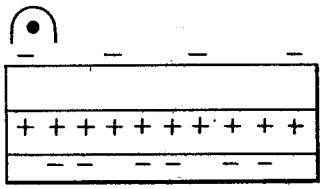
Figure 40C:
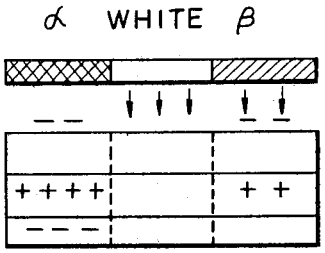

(ii) Secondary Charging of the Photosensitive Member with Polarity Opposite That of Primary Charging in the Dark The photosensitive member is charged at $+5.5$ kv, for example, so that the majority of the surface potential of the photosensitive member is neutralized and a negative charge is produced in the conductive base plate **1*a* to render the surface potential of the photosensitive member positive and sufficiently high to carry out developing, as shown in FIG. 40*b*. The surface potential is indicated at a point B in FIG. 41**.

(iii) Exposing to Optical Image

Figure 41:
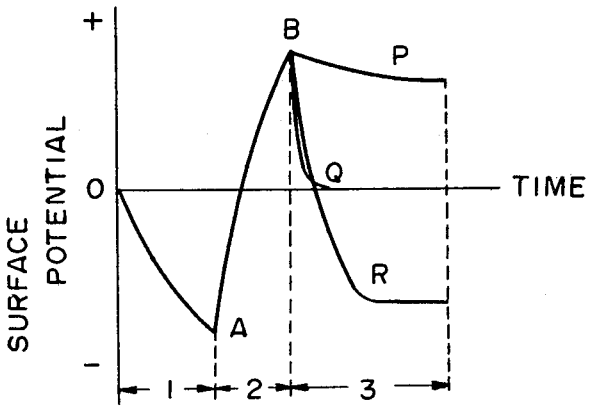

Exposing of the photosensitive member to an optical image causes changes to occur in various layers of the photosensitive member. Regions corresponding to the regions of color α (black, for example) of the original regains a positive surface potential. Regions corresponding to the white regions have their charge removed and their surface potential becomes substantially zero because of the U layer and L layer becoming conductive. Regions corresponding to the regions of color β (red, for example) have a positive charge corresponding to the charge of opposite polarity on the surface of the photosensitive member only remain in the L layer and their surface potential become negative because of the L layer becoming conductive. In FIG. 41, changes in surface potential in regions corresponding to the regions of color α, the white regions and regions of color β are represented by curves P, Q and R respectively. In FIG. 41, the abscissa represents the time and ordinate indicate the potential, and step 1 (primary charging), step 2 (secondary charging) and step 3 (exposing) the indicated by intervals in time 1, 2 and 3.

Following exposing of the photosensitive member to an optical image, the surface potentials of the photosensitive member may be as follows, as one example: +600 v in regions corresponding to the regions of color α; +10 v in regions corresponding to the regions of white; and −400 v in regions corresponding to the regions of color β.

(iv) Developing

The electrostatic latent image formed on the photosensitive member following exposing of the latter to an optical image is developed by using developing agents of colors α and β.

Developing may be carried out by using a developing agent of red color of positive polarity (+10 μc/g, for example) and a developing agent of black color of negative polarity (−15 μc/g, for example). In this case, primary dveloping may be carried out in red color while impressing a developing bias voltage of −100 v on the photosensitive member, and then secondary developing may be carried out in black while impressing a developing bias voltage of +100 v. The order in which developing in colors α and β is carried out may be selected as desired.

Figure 40D:
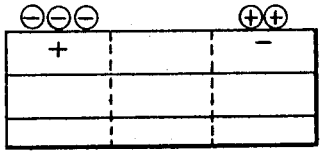

The developing agents adhere to the surface of the photosensitive member in suitable positions, as shown in FIG. 40*d*.

(v) Transfer-Printing

Following developing of the latent image on the photosensitive member, copy sheets are brought into contact with the photosensitive member to print visible images on the copy sheets by transfer-printing. As one example of transfer-printing conditions, the photosensitive member may be subjected to preliminary charging at −4.5 kv and then transfer-printing may be carried out by using a first transfer-printing charger of −5.5 kv and a second transfer-printing charger of +5.0 kv.

(vi) Following transfer-printing, the printing images on the copy sheet are fixed in the usual manner, and the photosensitive member is subjected to charge removing and cleaning.

(2) Copying Mode 2*a*

Copying steps are followed in the order described hereinafter.

(i) Primary Charging of the Photosensitive Member under Exposure to Color β (Red, for example)

Figure 42A:
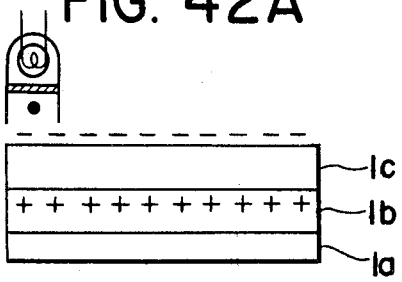

As shown in FIG. 42*a*, the photosensitive member is charged at −6.5 kv , for example, so that the surface of the photosensitive member is negatively charged and a portion of the L layer 1*b* near the boundary between the L layer and U layer 1*c* is positively charged, as shown in FIG. 42*a*. The surface potential is negative as indicated at a point A in FIG. 43.

Figure 42B:
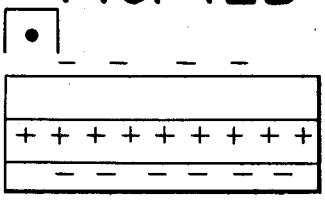
Figure 44B:
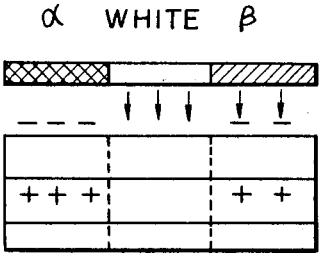

(ii) Secondary Charging of the Photosensitive Member with Polarity Opposite That of Primary Charging in the Dark Secondary charging is carried out at +5.0 kv, for example. As shown in FIG. 42*b*, the surface potential becomes substantially zero and the L layer 1*b* is positively charged while the conductive base plate 1*a* is negatively charged. The surface potential of the photosensitive member becomes positive as indicated at a point B in FIG. 43.

Figure 42C:
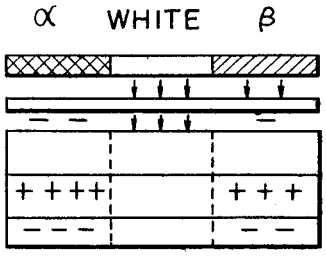
Figure 44C:
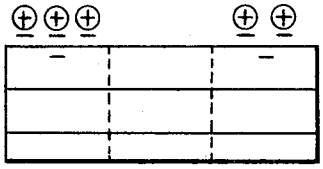

(iii) Exposing to Optical Image through a Color β (Red, for example) Absorption Filter Following exposure to an optical image, the photosensitive member shows various charnges in its regions. Regions corresponding to the regions of color α (black, for example) of the original have all the charge remain intact, and their surface potential remains positive. In regions corresponding to the white regions, the charge is removed and the surface potential becomes substantially zero because of the U layer 1*c* and L layer 1*b* becoming conductive. Regions corresponding to the regions of color β (red, for example) have the majority of the charge remain intact except for a certain portion thereof which is absorbed by the filter (See FIG. 42*c*).

Figure 43:
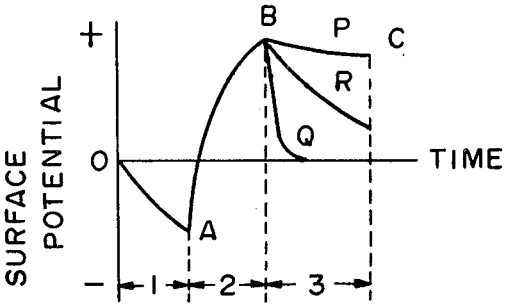

Exposure causes the surface potential to change as shown in FIG. 43. Curves P, Q and R represent changes in potential occuring in regions corresponding to the regions of color α, regions corresponding to the white regions and the regions corresponding to the regions of color β, respectively. FIG. 43 is similar to FIG. 42 for showing the abscissa and the ordinates. As one example, regions corresponding to the regions of color α, regions corresponding to the white regions and regions corresponding to the regions of color β have surface potentials of +600 v, +20 v and +220 v, respectively.

(iv) Developi-ng

Developing is carried out by using a developing agent of color α (black, for example) while impressing a developing bias voltage of +150 v, for example, on the photosensitive member. The developing agent of color α adheres to regions of the photosensitive member corresponding to the regions of colors α and β of the original.

(v) Transfer-Printing

Following developing, copy sheets are brought into contact with the photosensitive member to print visible images on the copy sheets by transfer-printing by using a transfer-printing charger of +5.0 kv, for example.

(vi) After-Treatment

After-treatment is carried out in the same manner as described with reference to copying mode 1.

(3) Copying Mode 2*b*

Copying steps are followed in the order described hereinafter.

(i) Primary Charging of the Photosensitive Member under Exposure to Light of Color β

Figure 44A:
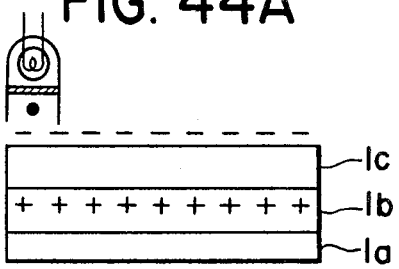

Primary charging is carried out at −5.5 kv, for example. As shown in FIG. 44*a*, the surface of the photosensitive member is negatively charged and a portion of the L layer 1*b* near the boundary between the L layer and U layer 1c is positively charged. The surface potential becomes negative as indicated at a point A in FIG. 45.

(iii) Exposing to Optical Image

Following exposure of the photosensitive member to an optical image, regions of the photosensitive member show changes as follows. In regions corresponding to the regions of color α (black, for example), the charge remains intact and the surface potential stays negative. In regions corresponding to the white regions, the charge is removed and the surface potential becomes substantially zero because of the L layer 1b and U layer 1c becoming conductive. In regions corresponding to the regions of color β (red, for example), the negative charge on the surface of the photosensitive member and the positive charge of the L layer remains intact and the surface potential stays negative because the U layer 1c is insensitive to color β and the L layer 1b becomes conductive.

Figure 45:
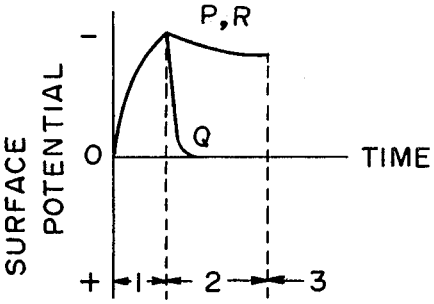

With regard to changes in surface potential, curves P, Q and R in FIG. 45 represent changes in regions corresponding to the regions of color α, regions corresponding to the white regions and regions corresponding to the regions of color β respectively. FIG. 45 is similar to FIG. 41 for showing the abscissa and the ordinates. As one example, the surface potentials of the photosensitive member following exposure are as follows: −600 v, −10 v and −580 v in regions corresponding to the regions of color α, white regions and regions of color β respectively.

(iii) Developing

Developing is carried out by using a developing agent of color β (red, for example) while impressing a bias voltage of −50 v on the photosensitive member. The developing agent of color β adheres to regions of the photosensitive member corresponding to the regions of colors α and β of the original.

(iv) Transfer-Printing

Following developing, copy sheets are brought into contact with the photosensitive member and visible images are printed on the copy sheets by using a transfer-printing charger of −5.5 kv.

(v) After-Treatment

After-treatment is carried out in the same manner as described with reference to copying mode 1.

In this case, an additional developer containing a black toner of the same polarity as the red developing agent or positive porality, for example, may be provided and selectively rendered operative, so that a visible image of black color or color α can be obtained by forming a latent image in copying mode 2b. That is, copying mode 2a may be carried out.

(4) Copying Mode 3a

Copying steps are followed in the order of description.

(i) Primary Charging of the Photosensitive Member under exposure to Light of Color β (Red, for example)

Figure 46A:
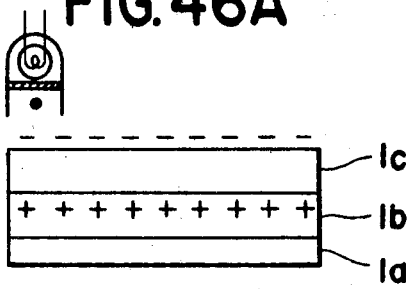

The photosensitive member is charged at −5.5 kv, for example. As shown in FIG. 46a, the surface of the photosensitive member is negatively charged and a portion of the L layer 1b near the boundary between the L layer and U layer 1c is positively charged. The surface potential becomes negative as indicated at a point A in FIG. 47.

Figure 46B:
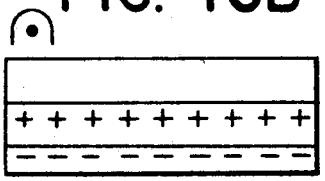

(ii) Secondary Charging of the Photosensitive Member with Polarity Opposite That of Primary Charging in the Dark The photosensitive member is charged at +5.7 kv, for example. As shown in FIG. 46b, the surface charge becomes substantially zero while the L layer 1b is positively charged and the conductive base plate 1a is negatively charged. The surface potential of the photosensitive member becomes positive as indicated at a point B in FIG. 47.

(iii) Exposing

Figure 46C:
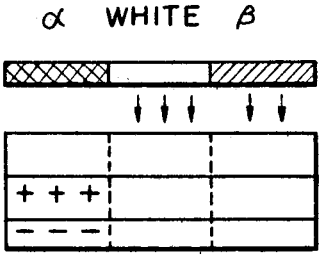

Following exposure, the photosensitive member shows various changes in its regions as shown in FIG. 46c. Regions corresponding to the regions of color α of the original have their charge remain intact and their surface potential is kept positive. In regions corresponding to the white regions and the regions of color β, the charge is removed and the surface potential becomes substantially zero because of the L layer 1b becoming conductive.

Figure 47:
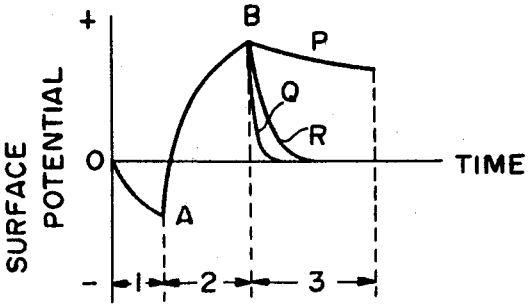

With regard to changes in surface potential, curves P, Q and R in FIG. 47 represents changes occurring in regions corresponding to the regions of color α (black, for example), white regions and regions corresponding to the regions of color β (red, for example), respectively. FIG. 47 is similar to FIG. 41 for showing the abscissa and the ordinates.

As an example, the surface potentials of the photosensitive member following exposure are as follows: +600 v, +5 v and +20 v in regions corresponding to the regions of color α, white regions and regions of color β, respectively.

(iv) Developing

Figure 46D:
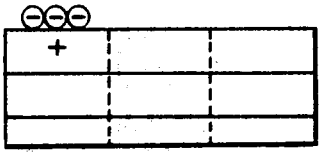

Following exposure, the photosensitive member is developed by using a developing agent of color α while impressing a bias voltage of +150 v on the photosensitive member. As shown in FIG. 46d, regions of the photosensitive member corresponding to the regions of color α are developed by the developing agent of color α while information carried by the regions of color β is erased.

(v) Transfer-Printing

Following developing, copy sheets are brought into contact with the photosensitive member to print visible images on the copy sheets by transfer-printing by using a transfer-printing charger of +5.0 kv.

(vi) After-Treatment

After-Treatment is carried out in the same manner as described with reference to copying mode 1.

(5) Copying Mode 3b

Copying steps are followed in the order of description.

(i) Primary Charging of the Photosensitive Member under Exposure to Light of color β (Red, for example)

Figure 48A:
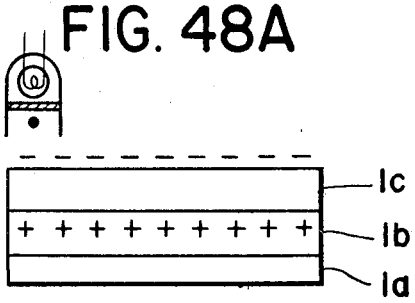
Figure 48B:
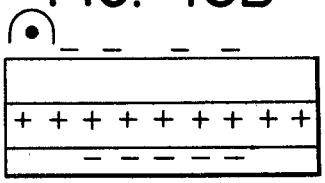

The photosensitive member is charged at −6.5 kv, for example. As shown in FIG. 48a, the surface of the photosensitive member is negatively charged and a portion of the L layer 1b near the boundary between the L layer and U layer 1c is positively charged. The surface potential becomes negative as indicated at a point A in FIG. 49.

(ii) Secondary Charging of the Photosensitive Member with Polarity Opposite That of Primary Charging The photosensitive member is charged at +4.5 kv, for example, so that the L layer is charged to bring the surface potential to almost zero. The surface potential of the photosensitive member becomes substantially zero as indicated at a point B in FIG. 49.

(iii) Exposing to Optical Image

Figure 48C:
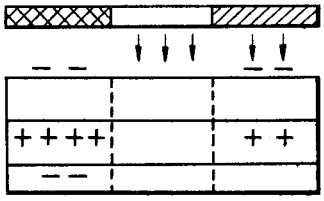

Exposing of the photosensitive member to an optical image causes the following charges as shown in FIG. 48*c*. In regions corresponding to the regions of color α (black, for example), the charge remains intact and the surface potential stays almost zero. In regions corresponding to the white regions, the charge almost disappears and the surface potential becomes substantially zero because of the L layer 1*b* and U layer 1*c* becoming conductive. In regions corresponding to the regions of color β, a positive charge corresponding to the surface charge of opposite polarity remains in L layer because of its becoming conductive, so that the charge of the conductive base plate 1*a* disappears and the surface potential of the photosensitive member becomes negative.

Figure 49:
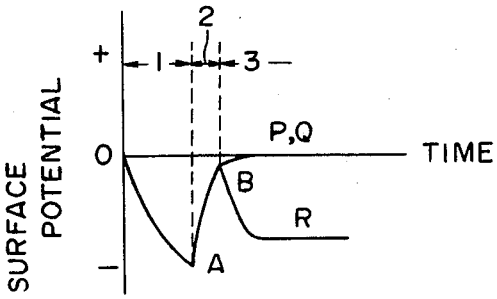

Following exposing, the surface potentials of the photosensitive member show changes as follows: curves P, Q and R in FIG. 49 represent changes in regions corresponding to the regions of color α, regions corresponding to the white regions, corresponding to the regions of color β, respectively.

As one example, the surface potentials of the photosensitive member are as follows: −20 v, −10 v and −600 v in regions corresponding to the regions of color α, regions corresponding to the white regions and regions corresponding to the regions of color β, respectively.

(iv) Developing

Figure 48D:
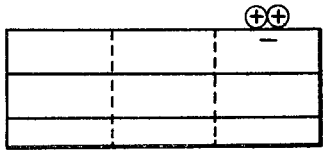

Following exposing, the photosensitive member is developed by using a developing agent of color β while impressing a bias voltage of −100 v, for example, on the photosensitive member. As shown in FIG. 48*d*, regions of the photosensitive member corresponding to the regions of color β of the original are developed while information carried by the regions of color α is erased.

(v) Transfer-Printing

Following developing, copy sheets are brought into contact with the photosensitive member to print visible images on the copy sheets by transfer-printing by using a transfer-printing charger of −5.5 kv.

(vi) After-Treatment

After-Treatment is carried out in the same manner as described with reference to copying mode 1.

In copying modes 3*a* and 3*b*, it is possible to form image portions of two colors of different polarities while using the charging conditions of copying mode 1 and to render one developer inoperative to leave the image portions of one color undeveloped or to develop the image portions by using two developers while turning off the preliminary transfer-printing charger and also turning off the transfer-printing charger for corona discharge for attracting the developing agent of the color of the information to be erased.

To facilitate understanding of the copying steps of various copying modes, Table 3 shows one example of copying conditions of different copying modes. Depending on the polarity of the developing agent, the polarities of the primary charging and secondary charging may be reversed.

TABLE 3

| Copying Step | | Copying Mode 1 Color (Black) Color (Red) | 2a White, Color (Black) | 2b White, Color (Red) | 3a Color β (Red), Erased | 3b Color α (Black), Erased |
|---|---|---|---|---|---|---|
| Primary Charging | | ON (−6.5 kv) | ON (−6.5 kv) | ON (−5.5 kv) | ON (−5.5 kv) | ON (−6.5 kv) |
| Primary Exposure | | ON | ON | ON | ON | ON |
| Secondary Charging | | ON (+5.5 kv) | ON (+5.0 kv) | OFF | ON (+5.7 kv) | ON (+4.5 kv) |
| Exposing to Optical Image | | ON | ON | ON | ON | ON |
| Filter Used in Exposing | | OFF | ON | OFF | OFF | OFF |
| Developing | First Developing (⊕ Red) | ON | OFF | ON | OFF | ON |
| | First Developing Bias | ON (−100 v) | OFF | ON (−50 v) | OFF | ON (−100 v) |
| | Secondary Developing (⊖ Black) | ON | ON | OFF | ON | OFF |
| | Secondary Developing Bias | ON (+100 v) | ON (+150 v) | OFF | ON (+150 v) | OFF |
| Preliminary Charging for Transfer-Printing | | ON (−4.5 kv) | OFF | OFF | OFF | OFF |
| Transfer-Printing | First Transfer-Printing Voltage Source | ON (−5.5 kv) | OFF | ON (−5.5 kv) | OFF | ON (−5.5 kv) |
| | Second Transfer-Printing Voltage Source | ON (+5.0 kv) | ON (+5.0 kv) | OFF | ON (+5.0 kv) | OFF |
| After-Treatment (Charge Removing, Cleaning, Quenching, Fixing of Printed Images) | | ON | ON | ON | ON | ON |

In Table 3, it will be seen that electrostatic latent images each corresponding to one of the five copying modes can be formed by selecting suitable conditions of primary charging, secondary charging and exposing to an optical image. In developing and transfer-printing steps, suitable developing bias voltages and transfer-printing chargers are selected to suit the polarity of the electrostatic latent images.

The copying apparatus shown in FIGS. 25 and 26 may be used for carrying the embodiment of the invention into practice by using the type of the photosensitive member described. However, in some steps, voltage sources of the polarity opposite to that shown in FIGS. 25 and 26 are used.

The primary charger 2 is provided with a filter 12 transmitting light of color β (red, for example) only and a light source 12, to expose the photosensitive member 1 to an optical image in color β simultaneously as primary charging is carried out. The primary charger 2 is connected to a first variable voltage source 10, so that when a voltage is impressed on the primary charger 2 power is simultaneously supplied to the light source 12 to simultaneously carry out primary charging and exposing to color β. The polarity of the primary charging may vary depending on the polarity of each of the developing agents used or a toner of color α and a toner of color β. For example, when a black toner of negative polarity and a red toner of positive polarity are used as developing agents, primary charging is carried out with negative polarity.

The secondary charger 3 is connected via an ON-OFF switch 16 to a second variable voltage source 17 having a polarity selected such that a voltage of a polarity opposite that of primary charging is impressed on the secondary charger 3. In the case of Table 3, the secondary charger 3 has a positive polarity.

The exposing optical system 4 may be of any known type. The optical system 4 includes an exposing filter 11 which is a color β absorbing filter or red color absorbing filter, for example. The exposing filter 11 can be moved into and out of the path of light beam of the optical system 4 depending on the copying mode selection signal.

The developing device 5 is constructed such that developing can be carried out by using developing agents of two colors. The developing agents of two colors may be formed into a mixture contained in a single developer. In the example shown, however, the developing device 5 includes a first developer 20 and a second developer 22. The first developer 20 which contains a developer of color α 19 of negative polarity has a developing sleeve 23 to which a positive developing bias voltage is applied from a voltage source 25, and the second developer 22 which contains a developing agent of color β 21 of positive polarity has a developing roller 26 to which a negative developing bias voltage is applied from a voltage source 28. The latent image can be developed in suitable color or colors by selectively using the two developers 20 and 22.

The transfer-printing charger 30 is connected to a first voltage source 35 of negative polarity and a second voltage source 36 of positive polarity.

The process of switching the copying apparatus shown in FIGS. 25 and 26 from one copying mode to another by selecting the conditions shown in Table 3 will be described by referring to the flow chart shown in FIG. 27.

Instructions are given to perform selection of the copying mode by actuating a button or a switch on the operation panel in step 1.

In step 2, upon input of a copying mode selection signal, judgement is given as to whether or not the image portions of colors α and β are to be discriminated. A reply YES is given to the question whether or not the image portions of colors α and β are to be discriminated when copying mode 1 is selected in which the original is copied in two colors and copying mode 3 is selected in which image portions of one of the two colors are erased. A reply NO is given when copying mode 2 is selected in which all the image portions are reproduced in one of two colors.

When a signal representing the reply NO is issued, a decision is given as to whether or not copying to be carried out in color β in step 3.

When copying mode 2a is selected. A signal NO is issued in step 3, so that the first variable voltage source 10 and second variable voltage source 17 have their conditions changed so that they suit copying mode 2a. In the example shown in Table 3, the first variable voltage source 10 and second variable voltage source 17 are set at −6.5 kv and +5.0 kv respectively.

In step 4, the exposing filter 18 is moved to the operative position.

When copying mode 2b is selected, a signal representing YES is issued in step 3, so that the first variable voltage source 10 and second variable voltage source 17 have their conditions changed so that they suit copying mode 2b. In the example shown in Table 3, the first variable voltage source 10 is set at −5.5 kv and the second variable voltage source 17 is turned off.

When a signal YES is issued in step 2 or when copying mode 1 or 3 is selected, the question is asked whether copying is to be effected in a single color (step 6).

When copying mode 1 is selected in which colors α and β are both used, a signal NO is produced in step 6, so that the first and second variable voltage sources 10 and 17 have their conditions changed so that they suit copying mode 1 in step 7. In the example shown in Table 3, the first and second variable voltage sources 10 and 17 are set at −6.5 kv and +5.5 kv respectively.

When a signal of YES is produced in step 6, a judgment is given as to whether or not copying is to be effected in color β in step 8.

When copying mode 3a is selected in which image portions of color β are erased and image portions of color α are reproduced, a signal NO is produced in step 8, so that the first and second variable voltage sources 10 and 18 are set at the voltage conditions of copying mode 3a in step 9. In the example shown in Table 3, the first and second variable voltage sources 10 and 17 are set at −5.5 kv and +5.7 kv respectively.

When copying mode 3b is selected in which image portions of color α are erased and image portions of color β are reproduced, a signal YES is produced in step 8. If copying mode 3b is the preliminarily selected copying mode, the production of the YES signal permits a copy starting button to be depressed immediately. However, when other copying mode is the preliminarily selected copying mode, the production of the YES signal causes the first and second variable voltage sources 10 and 17 have their conditions changed to those that suit copying mode 3b.

Thus the copying conditions are switched to suit the selected copying mode. Thereafter the copy starting button is depressed to actuate the copying apparatus so that the copying steps are successively followed.

The foregoing description mainly refers to switching the apparatus between various conditions of primary charging, secondary charging and exposing with reference to FIG. 27. However, conditions of developing and transfer-printing can be changed at the same time. More specifically, the operations of turning the second developer 22 and second transfer-printing voltage source 36 on in copying modes 1, 2a and 3a and turning the first developer 20 and first transfer-printing voltage source 35 on in copying modes 1, 2b and 3b are performed in conjunction with the aforesaid operations of changing the primary charging, secondary charging and exposing conditions.

By changing the conditions of copying steps as aforesaid, regions of the photosensitive member corresponding to the white regions of the original have their surface potential rendered substantially zero. Regions of corresponding to the regions of color $\alpha$ have their surface potentials rendered positive in copying modes 1, 2*a* and 3*a*, negative in copying mode 2*b* and substantially zero in copying mode 3*b*. Regions corresponding to the regions of color $\beta$ have their surface potentials rendered negative in copying modes 1, 2*b* and 3*b*, positive in copying mode 2*a* and substantially zero in copying mode 3*a*.

Electrostatic latent images formed have polarities which vary depending on the color or colors in which the duplicates are produced. A developing agent or agents of the polarities commensurate with the polarities of the electrostatic latent images are used to develop the latent images into visible images of one color or two colors in one developing operation with image portions becoming white when they are not desired to be reproduced.

II-D. A Photosensitive Member of the Type II-D.

The L layer is formed of a material substantially insensitive to color $\beta$ when positively or negatively charged and, when the surface of the photosensitive member is subjected to negative or positive corona discharge, it becomes sensitive to color $\beta$ and develops a potential holding ability at least in one polarity and is hardly charged or becomes sensitive to light of complementary color of color $\beta$ if charged. The U layer is formed of a material capable of transmitting light and highly sensitive to color $\beta$ when charged positively and negatively. The material for the U layer is also capable of transmitting at least part of light of visible colors other than $\beta$ and developing a potential holding ability high enough to contribute to the production of a surface potential of the photosensitive member when subjected to corona discharge of positive or negative polarity.

When the material for the U layer essentially blocks light of color $\beta$ by reflection or absorption, substantially the same effect as achieved when a material insensitive to color $\beta$ is used can be achieved even if the material for the L layer is not limited to those which are insensitive to light of color $\beta$.

When color $\beta$ is red, light of red color is absorbed by the U layer and does not reach the L layer if the U layer is formed of a material having a cyanine pigment therein. Thus, even if a material sensitive to light of red color is used for forming the L layer, the L layer does not become conductive upon exposure to light of red color.

Assume that colors $\alpha$ and $\beta$ are black and red respectively. The conductive base plate 1*a* may be in the form of a drum of aluminum or a polyester film having a coat of aluminum deposited by vaporization in vacuum. The L layer 1*b* may be in the form of a coat of selium or selium telluride, and the U layer 1*c* may be formed of an organic photoconductive material including as a main constituent an eutectic criytal complex composed of a thiapyrillate and polycarbonate. As an alternative, the U layer may be formed of two coats of organic conductive material, one coat being a charge producing coat formed as of bisazo pigment and the other coat being a charge transporting coat formed as of triphenylmethane. Also, the U layer may be formed of an organic crystal, such as ZnO, CdS, etc., and any one of the aforesaid materials may be used for forming the U layer which is superposed on the L layer.

An intermediate layer formed of one or a mixture of the materials selected from the group consisting of phenol resin and vinyl resin, with or without an additive which may be a pigment or dye-stuff may be provided between the U and L layers.

When each one of the five copying modes is carried out by using this type of photosensitive member, the following copying steps are followed.

(1) Copying mode 1

Copying steps are followed in the order described hereinafter.

(i) Primary Charging of the Photosensitive Member in the Dark

Figure 50A:
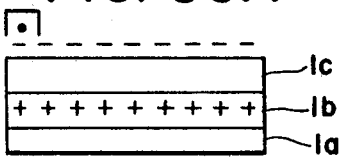
FIGS. 50–65 are views in explanation of still another type of photosensitive member, FIG. 50 showing changes in the electric charge on the photosensitive member occurring in copying mode 1 showing changes in the electric charge in the order of steps in a, b and c, FIG. 51 showing changes in the surface potential of the photosensitive member occurring in copying mode 1, FIGS. 52, 54, 56, 58, 60 and 62 showing changes in the electric charge on the photosensitive member occurring in copying mode 2*a*, copying mode 2*b*, a modification of copying mode 2*b*, copying mode 3*a* and copying mode 3*b* respectively shown in the order of steps in a, b and c or in a, b, c and d, FIGS. 53, 55, 57, 59, 61 and 63 showing changes in the surface potential of the photosensitive member occurring in copying mode 2*a*, a modification of copying mode 2*a*, copying mode 2*b*, a modification of copying mode 2*b*, copying mode 3*a* and copying mode 3*b*, FIG. 64 being a flow chart showing one example of the switching process according to the invention, and FIG. 65 being a view in explanation of a voltage control for the primary charger and the secondary charger.
Figure 51:
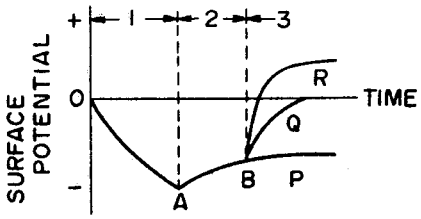

The photosensitive member is charged at $-6.5$ kv, for example. As shown in FIG. 50*a*, the surface of the photosensitive member is negatively charged and a portion of the L layer 1*b* near the boundary between the L layer and U layer 1*c* is positively charged. A positive charge is produced in the L layer 1*b* which is not rendered conductive because of the rectifying property of the material. The surface potential of the photosensitive member becomes negative as indicated at a point A in FIG. 51 following primary charging. FIG. 51 is a graph in which the abscissa represents the time and the ordinate indicates the surface potential and time intervals 1, 2 and 3 represent different steps, with 1 representing primary charging.

Figure 50B:
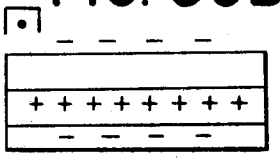

(ii) Secondary Charging of the Photosensitive Member with Polarity Opposite That of Primary Charging in the Dark The photosensitive member is charged at $+3.8$ kv, for example. As shown in FIG. 50*b*, the negative charge on the surface of the photosensitive member is partly neutralized and the conductive base plate 1*a* is correspondingly charged negatively. Due to the rectifying property of the L layer 1*b*, the conductive base plate 1*a* is negatively charged on its surface and the L layer 1*b* is not charged. The surface potential of the photosensitive member remains negative following secondary charging, with its potential being slightly reduced as indicated at a point B in FIG. 51.

(iii) Exposing to Optical Image

Figure 50C:
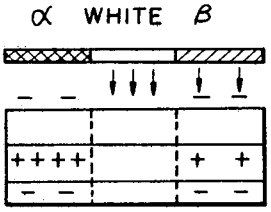

The photosensitive member is exposed to an optical image. As shown in FIG. 50*c*, regions of the photosensitive member corresponding to the regions of color $\alpha$ of the original are not affected by exposure and their charge remains unaltered, when color $\alpha$ is black. Regions corresponding to the background of the image or which regions have their charge disappear because the U layer 1*c* and L layer 1*b* both become conductive. Regions corresponding to the regions of color $\beta$ have the charge on the surface of the photosensitive member disappear because the U layer 1*b* alone becomes conductive, with the charge of the L layer 1*b* remaining intact. Thus a charge of opposite polarity corresponding to the charge in the L layer 1*b* is produced in the conductive base plate 1*a*.

The surface potential of the photosensitive member shows a change as shown in FIG. 51. More specifically, regions corresponding to the regions of color $\alpha$ show a change represented by a curve P and continue to have a negative potential following exposing. Regions corresponding to the white regions show a change represented by a curve Q and have substantially zero potential following exposing. Regions corresponding to the regions of color $\beta$ show a change represented by a curve R and have a positive potential following exposing. Thus the electrostatic latent image formed have potentials of opposite polarities in regions thereof corresponding to the regions of colors α and β.

(iv) Developing

Developing is carried out by using a developing agent of color β of negative polarity or a toner of red color while impressing a developing bias voltage of +50 v and by using a developing agent of color α of positive polarity or black color toner while impressing a developing bias voltage of −50 v, for example. The result of this is that the developing agent of color β adheres to the image portions of positive potential corresponding to the regions of color β and that the developing agent of color α adheres to the image portions of negativve polarity corresponding to the regions of color α, so that a visible image of two colors α and β can be obtained.

(v) Transfer-Printing

Copy sheets are brought into contact with the photosensitive member to print the visible image on the copy sheets by transfer-printing from the photosensitive member by using a transfer-printing charger of +5.5 kv and a transfer-printing charger of −5.0 kv, for example.

(vi) After-Treatment

Following transfer-printing, the printed image on the copy sheets are fixed in the usual manner, and the photosensitive member is subjected to charge removing and cleaning.

In this way, an original of two color can be duplicated in two colors.

(2) Copying Mode 2*a*

Copying steps are followed in the order described hereinafter.

(i) Primary Charging of the Photosensitive Member in the Dark

Figure 52A:
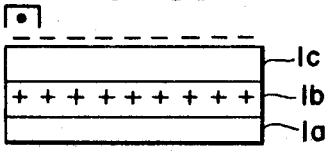
Figure 52B:
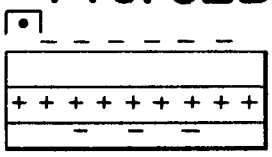

The photosensitive member is charged at −6.5 kv, for example. As shown in FIG. 52, the surface of the photosensitive member is negatively charged and a portion of the L layer 1*b* near the boundary between the L layer 1*b* and U layer 1*c* is positively charged, as in copying mode 1. The surface potential becomes negative following primary charging, as indicated at a point A in FIG. 53.

Figure 53:
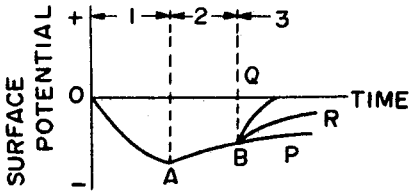

(ii) Secondary Charging of the Photosensitive Member with Polarity Opposite that of Primary Charging in the Dark The photosensitive member is charged at +3.8 kv, for example. As shown in FIG. 53*b*, the surface potential is neutralized in part and the conductive base plate 1*a* is brought to a condition in which it is negatively charged, as in copying mode 1. The surface potential of the photosensitive member becomes negative following secondary charging as indicated at a point B in FIG. 53, with the potential being slightly reduced.

(iii) Exposing to Optical Image

Figure 52C:
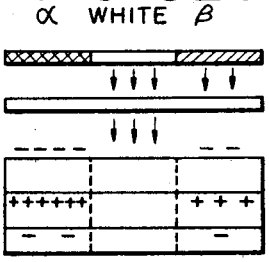

The photosensitive member is exposed to an optical image through a color β light blocking filter. As shown in FIG. 52*c*, regions of the photosensitive member corresponding to the regions of color α of the original have their charge remain intact.

Regions corresponding to the white regions have their charge disappear due to the L layer 1*b* and U layer 1*c* becoming conductive. In regions corresponding to the regions of color β, the surface layer disappears in part as a result of exposing but the majority remains because of the use of the color β light blocking filter.

The surface potential of the photosensitive member shows a charge as shown in FIG. 53. More specifically, in regions corresponding to the regions of color α, the negative potential existing after secondary charging remains substantially intact as indicated by a curve P. In regions corresponding to the white regions, the potential becomes substantially zero as indicated by a curve Q. In regions corresponding to the regions of color β, the charge represented by a curve R occurs, with the potential remaining negative although its value is slightly reduced. Thus an electrostatic latent image is formed on the photosensitive member in which regions corresponding to the regions of colors α and β both have negative potentials.

(iv) Developing

Developing is carried out by using a developing agent of color α of positive polarity while impressing a developing bias voltage of −100 v, for example. The developing agent of color α adheres to the image portions of colors α and β, so that the visible image obtained is in color α only, in spite of the fact that the original is in two colors.

(v) Transfer-Printing

Copy sheets are brought into contact with the photosensitive member to print the visible images on the copy sheets by transfer-printing from the photosensitive member by using a transfer-printing charger of −5.0 kv, for example.

(vi) After-Treatment

After-treatment is carried out as described with reference to copying mode 1.

(2') A Modification of Copying Mode 2*a*

Copying mode 2*a* may be carried out by using a Carlson system.

(i) Primary Charging of the Photosensitive Member in the Dark

Figure 54A:
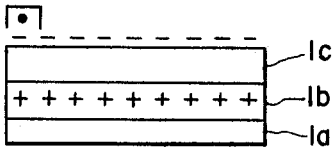

The photosensitive member is charged at −5.5 kv, for example. As shown in FIG. 54*a*, the surface of the photosensitive member is negatively charged and a portion of the L layer 1*b* near the boundary between the L layer and U layer 1*c* is positively charged. The surface potential of the photosensitive member is negative as indicated at a point A in FIG. 55.

(ii) Secondary Charging of the Photosensitive Member with Polarity Opposite That of Primary Charging in the Dark Charging voltage is turned off. States differently, the secondary charger is turned off.

(iii) Exposing

Figure 54B:
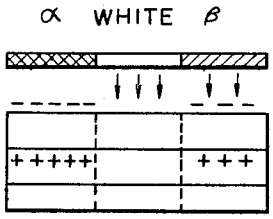

The photosensitive member is exposed to an optical image through a color β light blocking filter, so that regions of the photosensitive member corresponding to the regions of color α have their charge remain intact. The charge in regions corresponding to the white regions is removed, while part of the charge in regions corresponding to the regions of color β remains intact, as shown in FIG. 54*b*.

Figure 55:
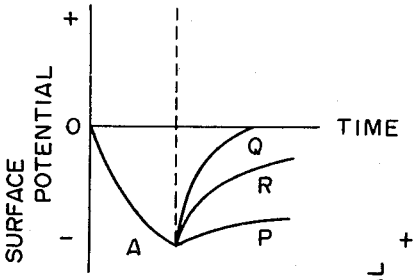

The surface potential of the photosensitive member shows changes as shown in FIG. 55. Curves P, Q and R represent changes in regions corresponding to the regions of color α, regions white of color and regions of color β respectively. Following exposing, the potentials of regions corresponding to the regions of colors α and β become negative and the potential of regions corresponding to the regions of white becomes substantially zero.

(iv) Developing, Transfer-Printing and After-Treatment

These steps are similar to those as described with reference to copying mode 2*a*.

(3) Copying Mode 2*b*

Copying steps are followed in the order described hereinafter.

(i) Primary Charging of the Photosensitive Member in the Dark

Figure 56A:
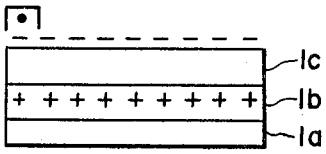

The photosensitive member is charged at −5.5 kv, for example. As shown in FIG. 56*a*, the surface of the photosensitive member is negatively charged and a portion of the L layer 1*b* near the boundary between the L layer and U layer 1*c* is positively charged, as described with reference to copying mode 1.

Figure 57:
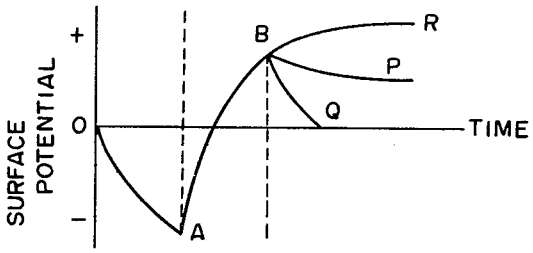

As indicated at a point A in FIG. 57, the surface potential of the photosensitive member is negative.

Figure 56B:
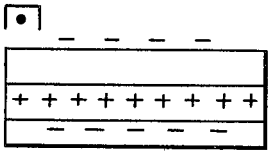

(ii) Secondary Charging of the Photosensitive Member with Polarity Opposite That of Primary Charging The photosensitive member is charged at +5.5 kv, for example. As shown in FIG. 56*b*, part of the charge on the surface of the photosensitive member is neutralized and the conductive base plate 1*a* is negatively charged correspondingly. Due to rectification, the L layer 1*b* is positively charged in primary charging and the conductive base plate 1*a*, not the L layer 1*b*, is negatively charged in secondary charging.

As indicated at a point B in FIG. 57, the surface potential of the photosensitive member becomes positive following secondary charging.

(iii) Exposing to Optical Image

Figure 56C:
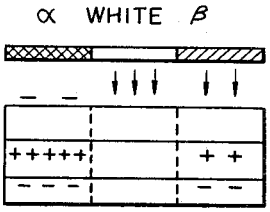

The photosensitive member is exposed to an optical image. As shown in FIG. 56*c*, the charge in regions corresponding to the white regions disappears because of the L layer 1*b* and U layer 1*c* becoming conductive. In regions corresponding to the regions of color $\beta$, the negative charge on the surface of the photosensitive member disappears because of the U layer 1*c* becoming conductive, the positive charge in the L layer 1*b* remains intact because this layer is insensitive to light of color $\beta$, and a negative charge corresponding to this positive charge is produced in the conductive base plate 1*a*.

As shown in FIG. 57, the surface potential of the photosensitive member show changes, with a curve P representing regions corresponding to the regions of color $\alpha$ in which the positive charge existing after secondary charging remaining substantially unaltered, a curve Q representing regions corresponding to the white regions in which the potential becomes substantially zero and a curve R representing regions corresponding to the regions of color $\beta$ in which the positive potential existing after secondary charging remains substantially intact or becomes slightly higher. The electrostatic latent image formed have regions of colors $\alpha$ and $\beta$ which both have positive potentials.

(iv) Developing

Developing is carried out by using a developing agent of color $\beta$ of negative polarity or a red color toner while impressing a developing bias voltage of +100 v, for example. The visible image obtained by developing is in color $\beta$ in both image portions thereof which correspond to the regions of colors $\alpha$ and $\beta$ of the original.

(v) Transfer-Printing

Copy sheets are brought into contact with the photosensitive member to print the visible images of color $\beta$ on the copy sheets by transfer-printing from the photosensitive member by using a tranfer-printing charger of +5.5 kv, for example. Thus the duplicates of the original in two colors of $\alpha$ and $\beta$ are obtained in color $\beta$ only.

(vi) After-Treatment

After-treatment is carried out in the same manner as described with reference to copying mode 1.

(3') A Modification of Copying Mode 2*b*

When the U layer 1*c* has a potential holding ability with respect to the potentials of both positive and negative polarities, it is possible to form a latent image in which image portions corresponding to the regions of colors $\alpha$ and $\beta$ both have positive potentials, by eliminating primary charging or carrying out secondary charging and exposing to an optical image while turning off the primary charger.

Figure 58A:
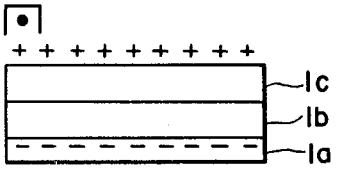
Figure 58B:
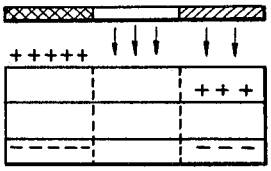
Figure 59:
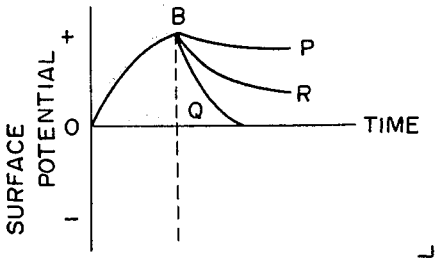

FIGS. 58*a* and 58*b* show the manner in which the photosensitive member is charged in this modification. FIG. 59 shows changes in surface potential. Following exposure, the charge in regions corresponding to the regions of color existing after charging remains unaltered, and the positive charge in regions corresponding to the regions of color $\beta$ shifts from the surface of the photosensitive member to the boundary between the L layer 1*b* and U layer 1*c* because of the U layer becoming conductive.

(4) Copying Mode 3*a*

Copying steps are followed in the order described hereinafter.

(i) Primary Charging of the Photosensitive Member in the Dark

Figure 60A:
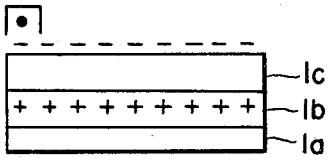

The photosensitive member is charged at −6.5 kv, for example. As shown in FIG. 60*a*, the photosensitive member is charged in the same manner as in copying mode 1. The surface potential of the photosensitive member becomes negative as indicated at a point A in FIG. 61.

Figure 60B:
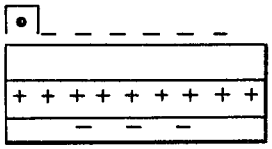

(ii) Secondary Charging of the Photosensitive Member with Polarity Opposite That of Primary Charging in the Dark The photosensitive member is charged at +3.5 kv, for example. As shown in FIG. 60*b*, the photosensitive member is charged substantially in the same manner as in copying mode 1. As indicated at a point B in FIG. 61, the surface potential of the photosensitive member remains negative, although its value is reduced, in the same manner as described with reference to copying mode 1.

(iii) Exposing to Optical Image

Figure 60C:
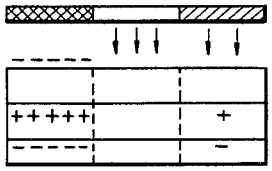

The photosensitive member is exposed to an optical image. The charge of the photosensitive member shows changes shown in FIG. 60*c*. More specifically, in regions corresponding to the regions of color $\alpha$, the charge nearly all remains intact. In regions corresponding to the white regions, nearly all the charge disappears due to the L layer 1*b* and U layer 1*c* becoming conductive. In regions corresponding to the regions of color $\beta$, the surface charge disappears and the charge remaining in the L layer is reduced to a low level in value because of the U layer becoming conductive.

Figure 61:
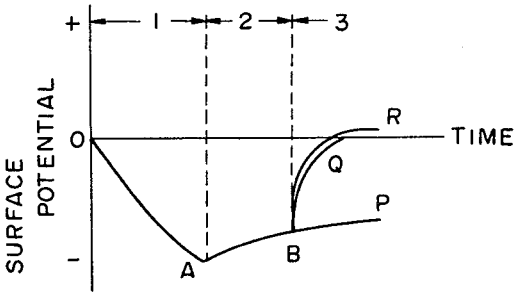

The surface potential of the photosensitive member shows changes shown in FIG. 61. In regions corresponding to the regions of color $\alpha$, the negative potential remains as represented by a curve P. In regions corresponding to the white regions and the regions of color $\beta$, the potentials become substantially zero as represented by curves Q and R respectively. That is, the electrostatic latent image formed contains image regions of negative polarity corresponding to the regions of color α of the original but no image regions corresponding to the regions of color β of the original.

(iv) Developing

Developing is carried out by using a developing agent of color α of positive polarity or a black toner, for example, while impressing a developing bias voltage of −50 v, for example. As a result, regions corresponding to the regions of color α alone are developed in color α while regions corresponding to the regions of color β become white because the image portions of color β are erased.

(v) Transfer-Printing

Copying sheets are brought into contact with the photosensitive member to print visible images on the copy sheets by transfer-printing from the photosensitive member while impressing a transfer-printing voltage of −5.0 kv, for example. The duplicates obtained contain image portions of color α only while image portions of color β are erased.

(vi) After-Treatment

After-treatment is carried out in the same manner as described with reference to copying mode 1.

(5) Copying Mode *3b*

Copying steps are followed in the order described hereinafter.

(i) Primary Charging of the Photosensitive Member in the Dark

Figure 62A:
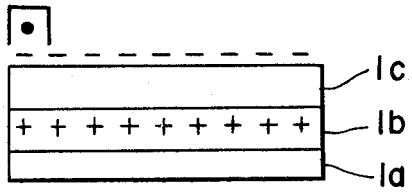
Figure 63:
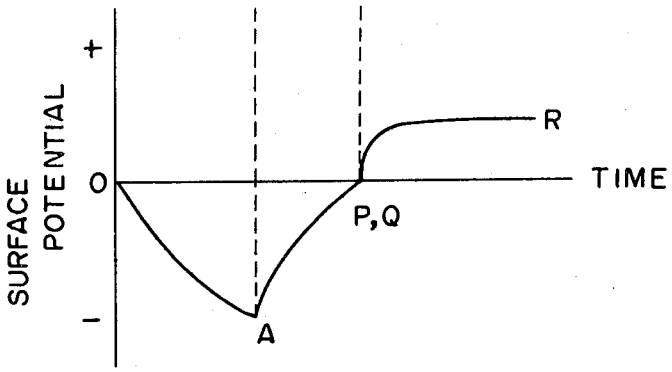

The photosensitive member is charged at −6.5 kv, for example. The manner in which the photosensitive member is charged is shown in FIG. 62*a*. The surface potential is indicated at point A in FIG. 63. They are similar as those in copying mode 1.

Figure 62B:
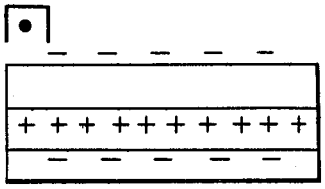

(ii) Secondary Charging of the Photosensitive Member with Polarity Opposite That of Primary Charging The photosensitive member is charged at +4.2 kv, for example. As shown in FIG. 62*b*, part of the surface potential is neutralized and the conductive base plate 1*a* is negatively charged correspondingly. In this case, charging conditions are selected such that the surface potential of the photosensitive member becomes substantially zero following secondary charging, as indicated at a point B in FIG. 63.

(iii) Exposing to Optical Image

Figure 62C:
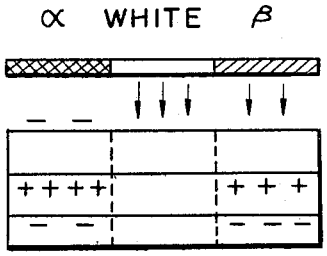

The photosensitive member is exposed to an optical image. The results are shown in FIG. 62*c*. More specifically, in regions corresponding to the regions of color α, the charge remains substantially all intact and the potential becomes almost zero as represented by a curve P in FIG. 63. In regions corresponding to the white regions, the charge disappeared due to the U layer 1*c* and L layer 1*b* becoming conductive, and the potential becomes almost zero as represented by a curve Q in FIG. 63. In regions corresponding to the regions of color β, the surface charge disappears and the potential becomes positive as represented by a curve R in FIG. 63 because of the L layer 1*c* becoming conductive.

Thus the electrostatic latent image formed contains image portions of positive polarity corresponding to the regions of color β of the original while no image portions corresponding to the regions of color α are formed because the potential becomes zero as in regions corresponding to the white regions. Even if image portions corresponding to the regions of color α are formed electrostatically, their potential is within the threshold potential range for effecting developing with developing agents of colors α and β.

(iv) Developing

Developing is carried out by using a developing agent of color β of negative polarity while impressing a developing bias voltage of +100 v, for example. The visible image obtained contains image portions corresponding to the regions of color β of the original while image regions corresponding to the regions of color α are erased.

(v) Transfer-Printing

Copy sheets are brought into contact with the photosensitive member to print the visible images on the copy sheets by transfer-printing from the photosensitive member. In the duplicates of the original obtained, image portions corresponding to the regions of color β only are reproduced in color β while image portions corresponding to the regions of color α are erased, leaving the blank in the duplicates.

(vi) After-Treatment

After-treatment is carried out in the same manner as described with reference to copying mode 1.

To enable the difference in copying steps between different copying modes to be better understood, one example of copying conditions of different copying modes will be shown in Table 4.

In Table 4, it will be seen that by changing the conditions of charging and selectively using a filter when exposing is carried out, it is possible to form different electrostatic latent images of the same original of two colors commensurate with five different copying modes by following the three steps of primary charging, secondary charging and exposing to an optical image by using the same type of photosensitive member.

For the electrostatic latent images formed in five different copying modes, it is necessary that suitable developing and transfer-printing conditions or suitable developing bias voltages and transfer-printing voltages be selected.

TABLE 4

| | Copying Mode | | | | | |
|---|---|---|---|---|---|---|
| | 1 | 2a | | 2b | 3a | 3b |
| | Color (Black), | White, Color (Black) | | White, | Color (Red) | Color (Black) |
| Copying Step | Color (Red) | | Carlson System | Color (Red) | Erased | Erased |
| Primary Charging | ON (−6.5 kv) | ON (−6.5 kv) | ON (−5.5 kv) | ON (−5.5 kv) | ON (−6.5 kv) | ON (−6.5 kv) |
| Secondary Charging | ON (+3.8 kv) | ON (+3.8 kv) | OFF | ON (+5.5 kv) | ON (+3.5 kv) | ON (+4.2 kv) |
| Expsoing to Optical Image | ON | ON | ON | ON | ON | ON |
| Filter Used in Exposing | OFF | ON | ON | OFF | OFF | OFF |
| Developing First Developing (⊖ Red) | ON | OFF | OFF | ON | OFF | ON |
| First Developing Bias | ON (+50 v) | OFF | OFF | ON (+100 v) | OFF | ON (+100 v) |

TABLE 4-continued

| Copying Step | | Copying Mode 1 Color (Black), Color (Red) | 2a White, Color (Black) | 2a Carlson System | 2b White, Color (Red) | 3a Color (Red) Erased | 3b Color (Black) Erased |
|---|---|---|---|---|---|---|---|
| | Second Developing (⊕ Black) | ON | ON | ON | OFF | ON | OFF |
| | Second Developing Bias | ON (−5.0 v) | ON (−100 v) | ON (−100 v) | OFF | ON (−50 v) | OFF |
| Preliminary Charging for Transfer-Printing | | ON (+4.5 kv) | OFF | OFF | OFF | OFF | OFF |
| Transfer-Printing | First Transfer-Printing Voltage Source | ON (+5.5 kv) | OFF | OFF | ON (+5.5 kv) | OFF | ON (+5.5 kv) |
| | Second Transfer-Printing Voltage Source | ON (−5.5 kv) | ON (−5.0 kv) | ON (−5.0 kv) | OFF | ON (−5.0 kv) | OFF |
| After-Treatment (Charge Removing, Cleaning, Quenching, Image Fixing) | | ON | ON | ON | ON | ON | ON |

The copying apparatus shown in FIGS. 25 and 26 may be used for carrying out the embodiment of the invention into practice by using the type of the photosensitive member described. However, in some steps, voltage sources of the polarity opposite that shown in FIGS. 25 and 26 are used. The photosensitive member shown in FIGS. 25 and 26 is of the drum type. It is to be understood that a photosensitive member in sheet form may also be used.

Located around the photosensitive member 1 in the direction of rotation thereof are a primary charger 2, a secondary charger 3, an exposing optical system 4, a developing device 5, a transfer-printing device 6, a charge remover 7, a cleaning device 8 and a quenching device 9 (only when necessary).

The primary charger 2 is connected to a first variable voltage source 10. In the example used for explaining the copying steps, the voltage source 10 is connected to the primary charger 2 in a manner to impress a negative voltage thereon. By taking into consideration the polarity of the developing agents and the characteristics of the photosensitive member, a positive voltage may, of course, be impressed on the primary charger 2.

The secondary charger 3 is connected to a second variable voltage source 17 via an ON-OFF switch 16. When the Carlson system is not used in copying mode 2*a*, the secondary charger 3 may be directly connected to the second variable voltage source 17 by eliminating the ON-OFF switch 16. The second variable voltage source 17 is constructed such that a voltage of a polarity opposite that of the first variable voltage source 10 is impressed on the secondary charger 3. An AC power source may be used as the second variable voltage source 17.

Any known type of construction may be used for the exposing optical system 4. A filter 18 blocking or absorbing light of color $\beta$ is provided to the optical system 4 and movable between an operative position disposed in the path of light beam of the optical system 4 and an inoperative position disposed out of the light beam.

The developing device 5 is constructed such that developing can be carried out by using developing agents of two colors or color $\alpha$ and $\beta$. To this end, one developer may be used to contain a mixture of developing agents of two colors to simultaneously develop image portions of colors $\alpha$ and $\beta$. As shown, the developing device 5 includes a first developer 20 containing a developing agent 19 of color $\beta$ of negative a polarity and including a developing roller 23 connected to a variable positive voltage source 25 for impressing a developing bias voltage on the developing roller 23, and a second developer 22 containing a developing agent 21 of color $\alpha$ of positive polarity and including a developing roller 26 connected to a variable negative voltage source 28 for impressing a developing bias voltage on the developing roller 26. The first and second developers 20 and 22 may be separately rendered operative and inoperative.

The transfer-printing device 6 includes a transfer-printing charger 30 positioned against the photosensitive member 1 in such a manner that a transfer-printing sheet 29 in the transfer-printing position is interposed between the photosensitive member 1 and the transfer-printing charger 30, and a preliminary transfer-printing charger 31 for subjecting the photosensitive member 1 to preliminary charging before it reaches the transfer-printing position.

The transfer-printing charger 30 can be switched between a first transfer-printing voltage source 35 of positive polarity and a second transfer-printing voltage source 36 of negative polarity by a change-over switch 34. When it is desired to carry out copying mode 1, the transfer-printing device 6 may advantageously include a first transfer-printing charger 30*a* and a second transfer-printing charger 30*b* arranged in side-by-side relation as shown in FIG. 26, the first transfer-printing charger 30*a* being connected to a first transfer-printing voltage source 35 via an ON-OFF switch 34*a* and the second transfer-printing charger 30*b* being connected to a second transfer-printing voltage source 36 via an ON-OFF switch 34*b*.

The first transfer-printing voltage source 35 is set at a voltage suitable for transfer-printing of image portions developed by the developing agent of the first developer (of color $\beta$, for example) 20 or at 5.5 kv in the example shown in Table 4. The second transfer-printing voltage source 36 is set at a voltage suitable for transfer-printing of image portions developed by the developing agent of the second developer (of color $\alpha$, for example) 22 or at −5.0 kv in the example shown in Table 4.

The charge remover 7 is connected to a charge removing power pack 37.

The cleaning device 8 may include a cleaning brush 38.

In FIGS. 25 and 26, parts of the copying apparatus mainly concerned with copying by using the photosensitive member 1 are shown. Other parts of the copying apparatus may be of any known type.

The process for switching the copying apparatus from one copying mode to another will be described by referring to FIGS. 25 and 26.

In step 1, selection of the copying mode desired is effected by using a change-over or pushbutton on the operation panel. In selecting the desired copying mode, one of the five copying modes described hereinabove may be directly selected. That is, when copying mode *2a* is selected, the pushbutton for the desired copying mode may be directly depressed. It is also possible to select the color in which the duplicates are desired to be produced or to select whether or not image portions of a color other than the specified color should be erased, by depressing a button or actuating a switch.

When one of the five different copying modes of 1, *2a*, *2b*, *3a* and *3b* is selected directly, an electric circuit enabling the voltages of the first variable voltage source 10, second variable voltage source 17, the power source 25 of first developer and the power source 28 of second developer to be changed to the predetermined voltage levels and permitting the ON-OFF switch 16, the ON-OFF switch 32 of preliminary transfer-printing charger and the ON-OFF switches 34 or 34*a* and 34*b* of transfer-printing charger to be brought to conditions suitable for the desired copying mode when a copying mode selection signal is produced is advantageously used to readily select the desired copying mode by depressing a suitable mode selecting pushbutton or actuating a mode change-over switch.

Figure 64:
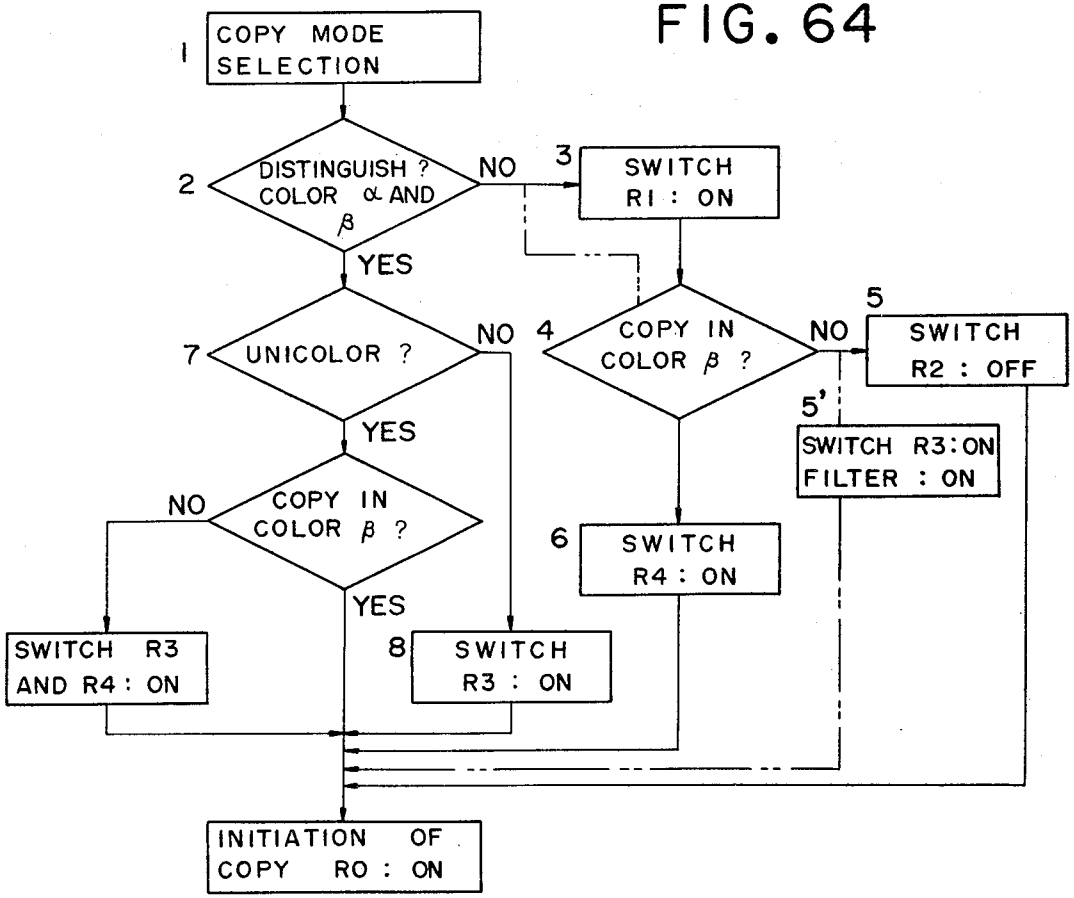

When selection of the color desired to be used for producing duplicates or selection of whether the entire image of the original should be reproduced or part of the image should be erased is carried out by means of a pushbutton or a change-over switch or when a pushbutton for directly selecting one of the five copying modes is depressed to change the charging, exposing, developing and transfer-printing conditions so that they suit the selected copying mode while the selection of color and the need to erase part of the image are judged by the control in the copying apparatus, a control process as shown in FIG. 64 in flow chart may be employed. Such control process will be described by referring to the conditions shown in Table 4.

In step 1, selection is made and instructions are given by operating a pushbutton or actuating a change-over switch on the operation panel.

In step 2, judgment is passed as to whether or not image portions of colors $\alpha$ and $\beta$ should be discriminated against, upon production of a selection signal. More specifically, when duplicates are to be produced in two colors in copying mode 1 and when image portions of one color are to be erased in copying mode 3, a reply YES is given to the questions whether image portions of colors $\alpha$ and $\beta$ are discriminated. When copying mode 2 is selected in which the entire image is to be reproduced in one of colors $\alpha$ and $\beta$, a reply NO is given to the question whether image portions of colors $\alpha$ and $\beta$ are discriminated.

The voltage of the first variable voltage source 10 is changed when a NO signal is produced. That is a switch R1 shown in FIG. 65 is turned on in step 3 which is followed when the Carlson system is used in copying mode *2a* in the example shown in Table 4.

In step 4, judgment is given as to whether copying should be carried out in color $\beta$. When primary charging conditions are such that the production of the NO signal does not cause a change to the first variable voltage source 10 (or when the Carlson system is not adopted for copying mode *2a* in the example shown in Table 4), judgment is given as to whether copying is to be carried out in color $\beta$ when the NO signal is produced in step 2. This is indicated by a dash-and-dot line in the flow chart in FIG. 64.

Figure 65:
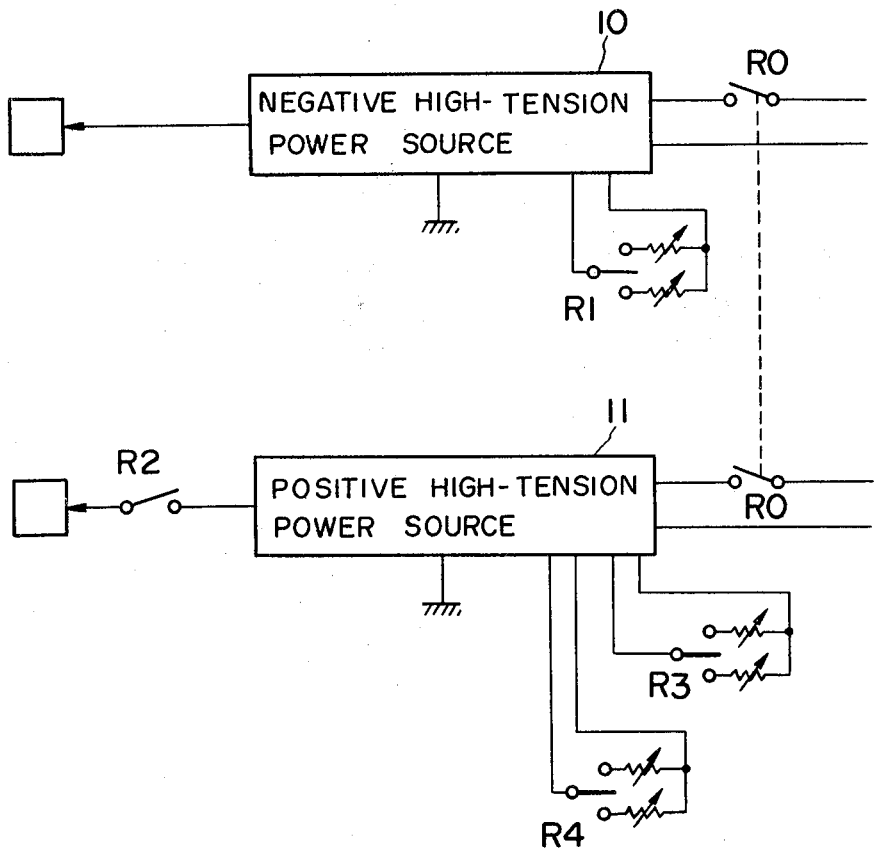

When the Carlson system is adopted, the NO signal produced in step 4 turns off the ON-OFF switch 16 of secondary charger or a switch R2 shown in FIG. 65. The switch R2 is normally in ON position.

When the Carlson system is not adopted, the NO signal produced in step 4 turns on a switch R3 shown in FIG. 65 and sets the voltage of the secondary charger 3 at a predetermined voltage level for copying mode *2a*. At the same time, the filter 18 of the exposing optical system 4 is turned on (step 5'). In step 5, the voltage of the second variable voltage source 17 is charged to the voltage level of copying mode *2a*. The filter 18 which is normally in the inoperative position is brought to the operative position when turned on.

A YES signal produced in step 4 turns on a switch R4 shown in FIG. 65 and sets the voltage of secondary charger 3 at a predetermined voltage level for copying mode *2b* (step 6). In step 6, the voltage of second variable voltage source 17 is at the level of copying mode *2b*.

When a YES signal is produced in step 2 or copying mode 1 or 3 is selected, judgment is given whether the image portions are to be reproduced all in one color in step 7. When copying mode 1 is selected in which colors $\alpha$ and $\beta$ are both used, a NO signal is produced in step 7. In this case, if the switches R3 and R4 shown in FIG. 65 are set at the conditions of secondary charger for copying mode 1 beforehand, the NO signal brings the apparatus to a position ready for starting copying. However, in the example shown in Table 4, the conditions of secondary charger are similar to those for copying mode *2a*, so that the switch R3 is turned on in step 8.

When a YES signal is produced in step 7, judgment is given as to whether copying is to be effected in color $\beta$ in step 8.

When copying mode *3a* is selected in which image portions of color $\beta$ are erased, a NO signal is produced in step 8. In this case, the switches R3 and R4 shown in FIG. 65 are turned on and the voltage of secondary charger 3 is set at the predetermined voltage level for copying mode *3a* in step 9. In step 9, the conditions of second variable voltage source 17 are changed to those of copying mode *3a*.

In this way, copying conditions are selected so that they suit the selected copying mode.

Depression of the pushbutton for starting copying turns on a switch R0 shown in FIG. 65, so that a copying operation is started.

A process for switching the conditions for primary charging, secondary charging and exposing has been described by referring to FIG. 64. It is to be understood that the conditions for developing and transfer-printing simultaneously switched. More specifically, when copying modes 1, *2a* and *3a* are selected, the second developer 22 and second transfer-printing voltage source 36 are turned on, when copying modes 1, *2b* and *3b* are selected, the first developer 20 and first tranfer-printing voltage source 35 are turned on.

By controlling the switching of the conditions of various steps of copying as described hereinabove, the surface potential of regions of the photosensitive member corresponding to the background of the original is rendered substantially zero. The surface potential of regions corresponding to the regions of color $\alpha$ is rendered negative in copying modes 1, 2*a* and 3*a* and rendered negative and substantially zero in copying modes 2*b* and 3*b* respectively. The surface potential of regions corresponding to the regions of color $\beta$ is rendered positive in copying modes 1, 2*b* and 3*b*, rendered negative in copying mode 2*a* and rendered substantially zero in copying mode 3*a*. Thus an electrostatic latent image is produced which has different polarities in different regions depending on the colors in which the regions are desired to be duplicated. A visible image of two colors or a predetermined color is produced in one developing step by using a developing agent or agents suitable for the polarities of the image regions while image regions not desired to be duplicated are erased.

From the foregoing description, it will be appreciated that the present invention enables any one of five different copying modes to be selected in duplicating an original of two colors by a simple process of controlling the switching of the conditions for charging and exposing. Thus it is possible to switch one copying apparatus from one copying mode to another so that copying can be carried out in any one of five copying modes by using a single copying apparatus.

In the example described hereinabove, the surface potential of a photosensitive member can be controlled in such a manner that the surface potential has the same polarity following primary charging and secondary charging. In this case, the U layer may be formed of a material which is insensitive to red color and which has no rectifying property, and the L layer may be formed of a material highly sensitive to light of red color. A material incorporating therein a cyan pigment for controlling electric resistance and achieving filtering effects may be used for forming the U layer or an intermediate layer between the U layer and L layer.

II-E Photosensitive Member of Type II-E

This type of photosensitive member includes two photoconductive layers, and an intermediate layer may be provided between the U layer and L layer when necessary (this type of photosensitive member is referred to as a triple layer photosensitive member because it has three principal layers comprising two photoconductive layers and one conductive base plate). When this type of photosensitive member is used, an electrostatic latent image of any copying mode as desired can be formed by charging the photosensitive member twice and exposing same to an optical image once, as described in the foregoing description. However, this type of photosensitive member may be charged three times. This copying process will be described by referring to FIG. 66. In the example shown and described, the U layer is formed of a material sensitive to color $\beta$ (red, for example) and having a large transmission factor for light of color $\alpha$. The L layer is formed of a material substantilly insensitive to color $\beta$ (red, for example) and highly sensitive to and having high polarization effects with visible light of less than 600 mm. The intermediate layer is a transparent insulating layer, or the intermediate layer is a blue filter insulating layer with the L layer being sensitive to all the colors. The L layer may be formed of a material having no polarization effects.

Figure 66A:
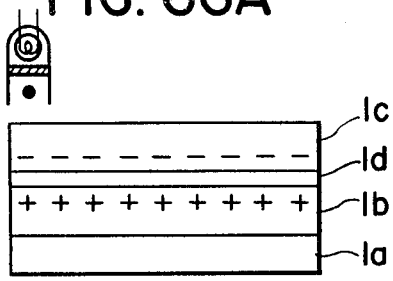
FIG. 66 is a view showing changes in the electric charge on the composite photosensitive member having two photoconductive layers occurring in copying mode 1 in which charging is carried out three times.

In FIG. 66*a*, primary charging is carried out under exposure to light of white color or color $\beta$. A positive or negative polarity may be selected for primary charging as desired. In the example shown, negative primary charging is carried out.

Following primary charing, a portion of the U layer 1*c* in the vicinity of the boundary between the U layer 1*c* and the intermediate layer is negatively charged, and a portion of the L layer 1*b* in the vicinity of the boundary between the L layer 1*b* and the intermediate layer is positively charged.

Figure 66B:
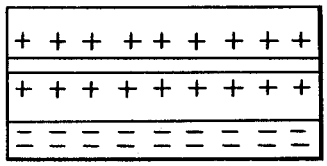

In step 2, the photosensitive member is subjected to secondary charging with a polarity opposite that of primary charging, under exposure to light of color $\beta$ through a filter transmitting light of red color, for example. In FIG. 66*b*, the U layer 1*c* is positively charged, the L layer 1*b* has a residual charge because it is insensitive to color $\beta$ and it does not become conductive, and the conductive base plate 1*a* is negatively charged to balance the positive charge of the L and U layers.

Figure 66C:
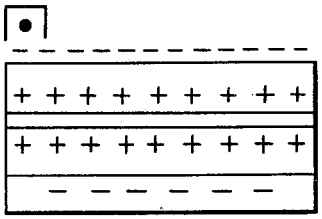

In step 3, the photosensitive member is subjected to secondary charging in the dark with the same polarity as that of primary charging. In FIG. 66*c*, the surface of the photosensitive member is negatively charged, the L layer 1*b* and U layer 1*c* have their charge remain intact, and the negative charge of the conductive base plate 1*a* disappears corresponding to the surface charge.

Figure 66D:
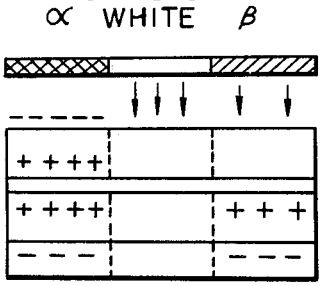

In step 4, the photosensitive member is exposed to an optical image. In FIG. 66*d*, regions corresponding to the regions of color $\alpha$ have the charge remain almost intact and regions corresponding to the white regions have the charge substantially disappear (due to the L and U layers becoming conductive). In regions corresponding to the regions of color $\beta$, the surface charge and the charge of the U layer substantially disappear and the charge of L layer remain intact because the U layer alone becomes conductive. As a result, regions corresponding to the regions of color $\alpha$ have a negative surface potential, regions corresponding to the regions of color $\beta$ have a positive surface potential and regions corresponding to the white regins have almost no surface potential.

Figure 67:
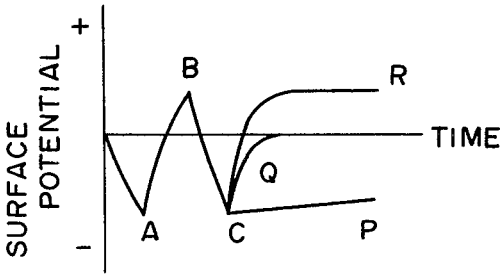
FIG. 67 is a view showing changes in the surface potential of the photosensitive member corresponding to FIG. 66.

FIG. 67 is a graph showing changes in the surface potential of the photosensitive member which occur while the steps shown in FIG. 66 are followed. In the graph, the abscissa represents the time and the ordinate indicates the potential.

Following primary charging, the surface potential becomes negative as indicated at a point A. Following secondary charging, the surface potential becomes positive as indicated at a point B. Following tertiary charging, the surface potential becomes negative as indicated at a point C. Following exposing of the photosensitive member to an optical image, regions corresponding to the regions of color $\alpha$ show change represented by a curve P in surface potential which becomes negative, regions corresponding to the regions of color $\beta$ show changes represented by a curve R in surface potential which becomes positive, and regions corresponding to the white regions show changes represented by a curve Q in surface potential which becomes almost zero.

Thus copying mode 1 can be carried out in which regions of colors $\alpha$ and $\beta$ of the original are reproduced in the duplicates.

Figure 68:
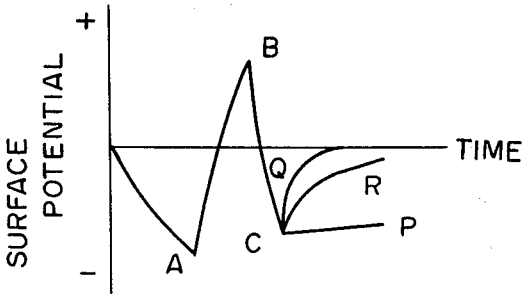
FIG. 68–71 are views showing changes in the surface potential of the photosensitive member shown in FIG. 66 occurring in copying mode 2*a*, copying mode 2*b*, copying mode 3*a* and copying mode 3*b* respectively.
Figure 69:
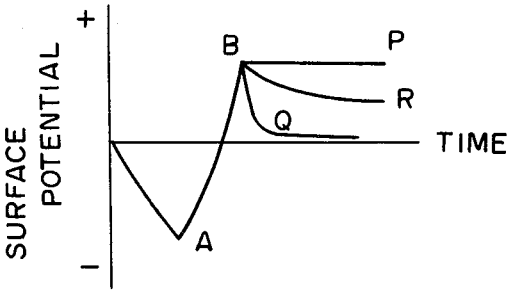
Figure 72A:
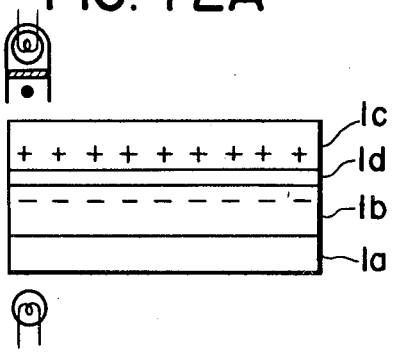
FIG. 72 is a view corresponding to FIG. 66 but showing changes in the electric charge on a further type of photosensitive member.
Figure 72B:
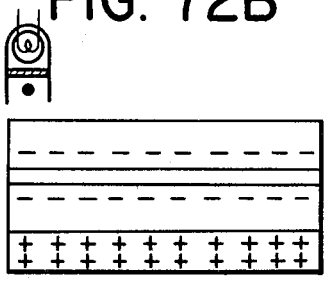
Figure 72C:
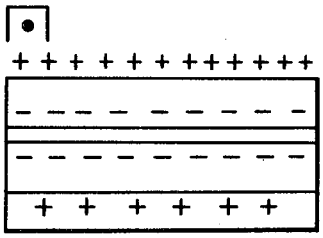
Figure 72D:
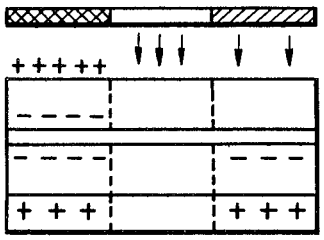
Figure 70:
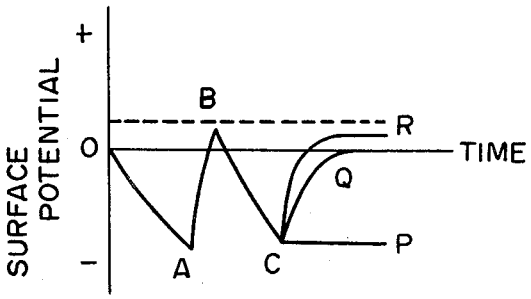
Figure 71:
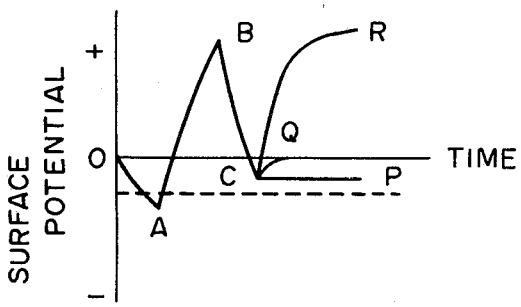

Other four copying modes or copying modes 2*a*, 2*b*, 3*a* and 3*b* can be carried out in the same manner as described with regard to the method if twice charging copying method by referring to FIG. 66. One example of the copying conditions for carrying out other four copying modes will be shown in Table 5. Changes occurring in the surface potential of the photosensitive member when copying mode 2*a* shown in Table 5 is carried out are shown in FIG. 68. Corresponding changes occurring in surface potential when copying modes 2*b*, 3*a* and 3*b* are shown in FIGS. 69, 70 and 71 respectively. Detailed descriptions are omitted.

By using a copying apparatus having a tertiary charger, it is possible to selectively carry out copying by triple charging and copying by double charging.

In each example described hereinabove, conditions are set so that the surface potential of regions of the photosensitive member corresponding to the white regions or regions to be erased becomes substantially zero. The surface potential need not become zero and

TABLE 5

| Copying Step | | Copying Mode 1 Color (Black), Color (Red) | 2a White, Color (Black) | 2b White, Color (Red) | 3a Color (Red) Erased | 3b Color (Black) Erased |
|---|---|---|---|---|---|---|
| Primary Charging | | ON (−6.0 kv) | ON (−5.5 kv) | ON (−6.5 kv) | ON (−6.0 kv) | ON (−6.0 kv) |
| Primary Exposing | | ON | ON | ON | ON | ON |
| Secondary Charging | | ON (+6.0 kv) | ON (+6.0 kv) | ON (−5.7 kv) | ON (+5.7 kv) | ON (+6.2 kv) |
| Secondary Exposing | | ON | ON | ON | ON | ON |
| Tertiary Charging | | ON (−6.5 kv) | ON (−6.2 kv) | OFF | ON (−6.5 kv) | ON (−6.2 kv) |
| Exposing to Optical Image | | ON | ON | ON | ON | ON |
| Exposing Filter | | OFF | ON (Red Blocking) | OFF | OFF | OFF |
| Developing | First Developing (⊕ Red) | ON | OFF | ON | OFF | ON |
| | First Developing Bias | ON (+100 v) | OFF | ON (+100 v) | OFF | ON (+100 v) |
| | Second Developing (⊖ Black) | ON | ON | OFF | ON | OFF |
| | Second Developing Bias | ON (−150 v) | ON (−150 v) | OFF | ON (−150 v) | OFF |
| Preliminary Transfer-Printing | | ON (−4.5 kv) | OFF | OFF | OFF | OFF |
| Transfer-Printing | First Transfer-Printing Voltage Source | ON (+5.5 kv) | OFF | ON (+5.5 kv) | OFF | ON (+5.5 kv) |
| | Second Transfer-Printing Voltage Source | ON (−5.0 kv) | ON (−5.0 kv) | OFF | ON (−5.0 kv) | OFF |
| After-Treatment (Charge Removing, Cleaning, Quenching, Image Fixing) | | ON | ON | ON | ON | ON |

With the photosensitive member having the L layer formed of a material of no polarization, changes occurring when charging is carried out by following the copying steps shown in FIG. 66 are shown in FIG. 72. When the photosensitive member is exposed to light of white color simultaneously as primary charging is carried out as in this example, it is necessary to expose the conductive base layer 1*a* to the light of white color. However, if the surface of the photosensitive member is exposed to the light of white color, it is not necessary to expose the conductive base plate to the light of white color.

Figure 73:
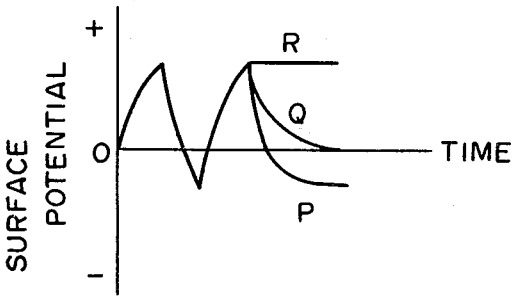
FIG. 73 shows changes in the surface potential of the photosensitive member shown in FIG. 72.

The subsequent steps are the same as those shown in FIG. 66. Changes occurring in the surface potential are shown in FIG. 73.

When the steps of triple charging are followed, it is possible to effect switching of the copying apparatus from one copying mode to another based on the same concept as described hereinabove merely by adding a tertiary charger and a variable voltage source connected thereto to the charging device shown in FIG. 22 or FIG. 23.

Figure 24:
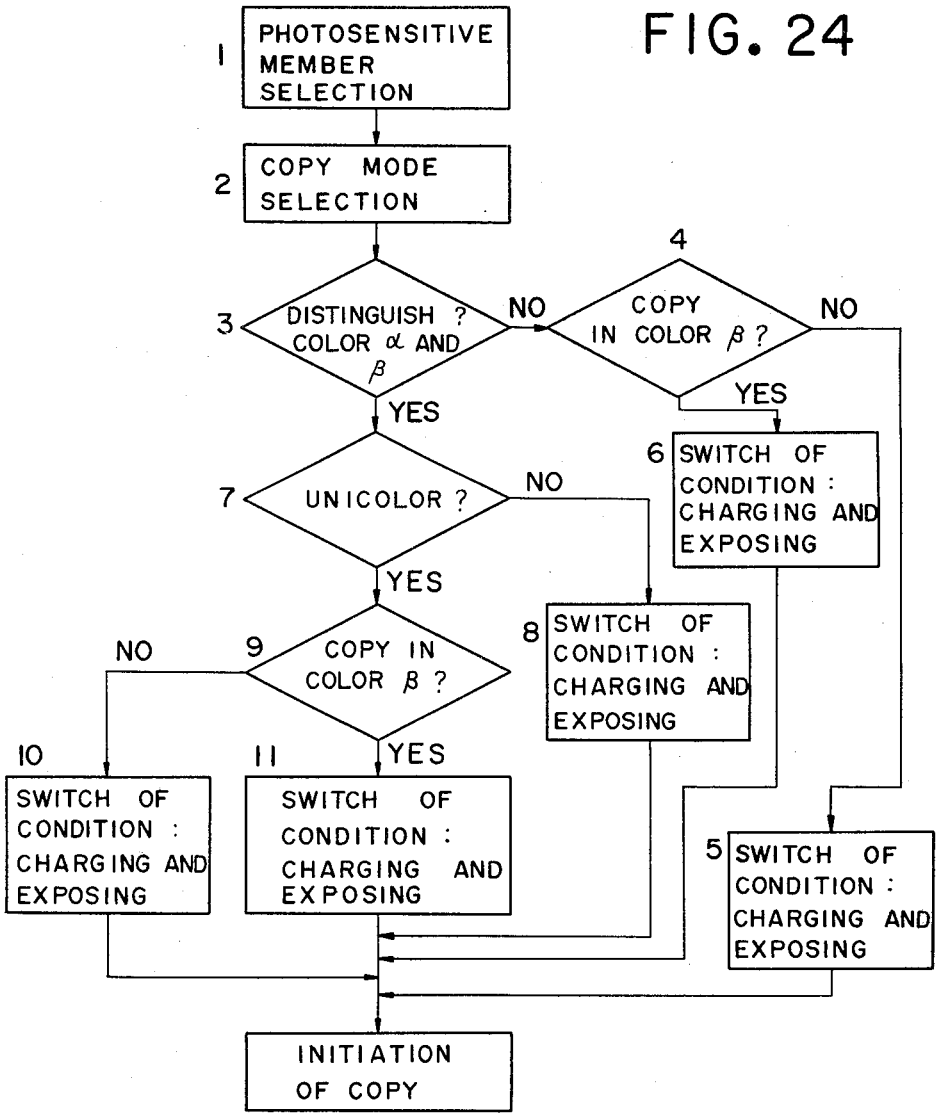
FIG. 24 is a view showing the process in which switching of the copying apparatus from one copying mode to another is effected.

Copying steps utilizing the steps of triple charging can be carried out while changing the copying modes based on the same concept as shown in the flow chart in FIG. 24.

any potential level lower than a predetermined potential level may be tolerated, by taking into consideration the fact that it is possible to avoid adhesion of the developing agent so long as the potential is below the developing initiating potential even if no zero potential is provided.

As a process for erasing image portions of one of two colors, an electrostatic latent image may be formed by carrying out copying mode 1 and then rendering inoperative the developer corresponding to the color of the image regions to be erased.

The present invention enables a copying apparatus to be freely switched from one copying mode to another by using a simple apparatus and a simple method when originals of two colors are duplicated.

The present invention enables copying to be effected in any copying mode as desired by using a single copying apparatus and a composite photosensitive member including over three layers if charging is carried out more than three times and exposing to an optical image is carried out only once, so long as charging conditions and exposing condicitions are changed to suit the properties of the photosensitive member and the selected copying mode. Thus the need to use the same number of copying apparatus as the copying modes desired to be carried out in the prior art can be eliminated.

One embodiment of the apparatus for carrying the present invention into practice will now be described.

Figure 74:
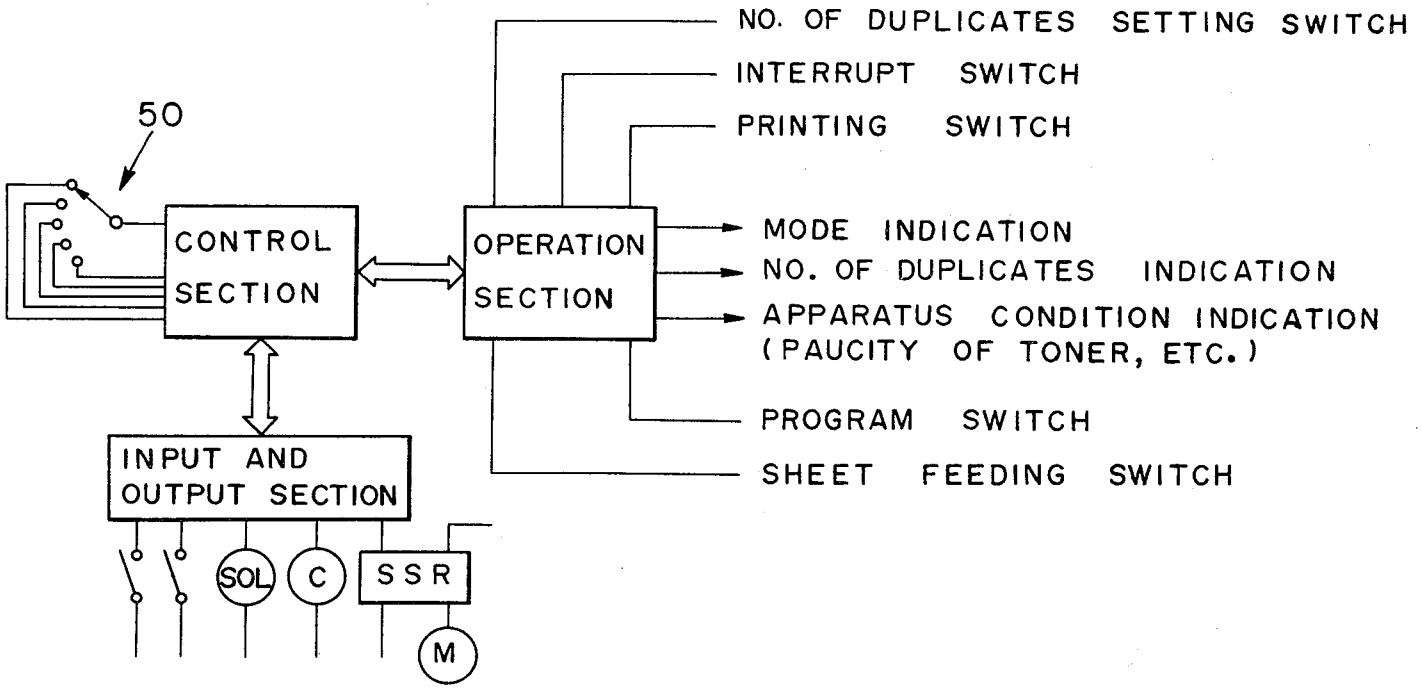
FIG. 74 is a block diagram showing control of the copying apparatus for carrying the method according to the invention into practice.
Figure 75:
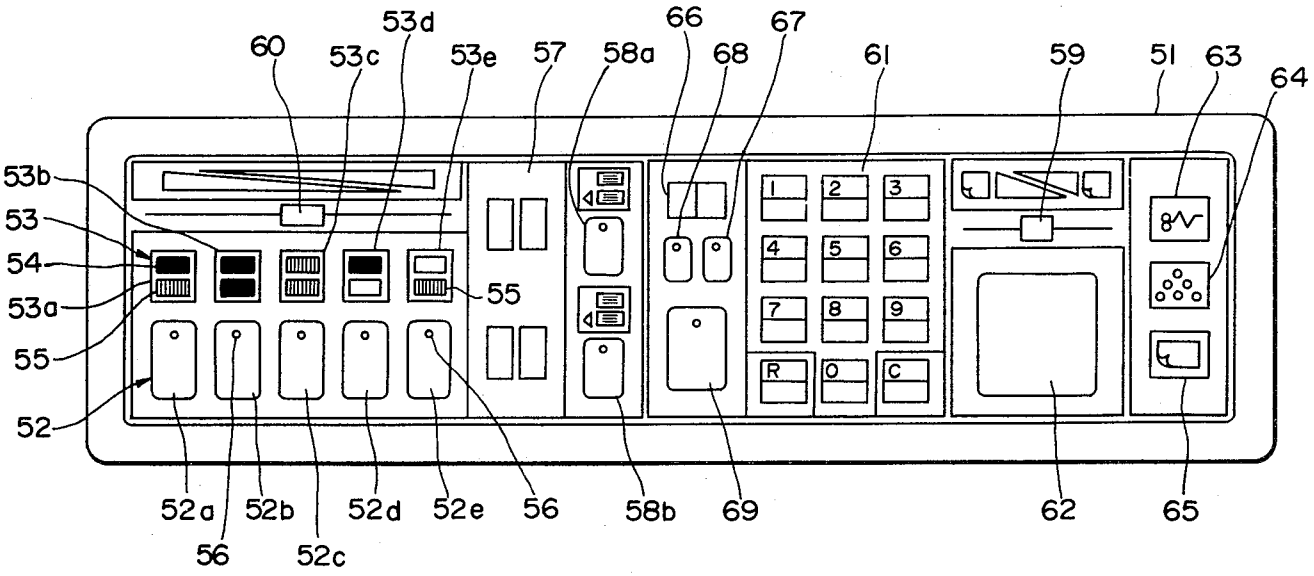
FIG. 75 is a plan view of one example of the operation panel.
Figure 76:
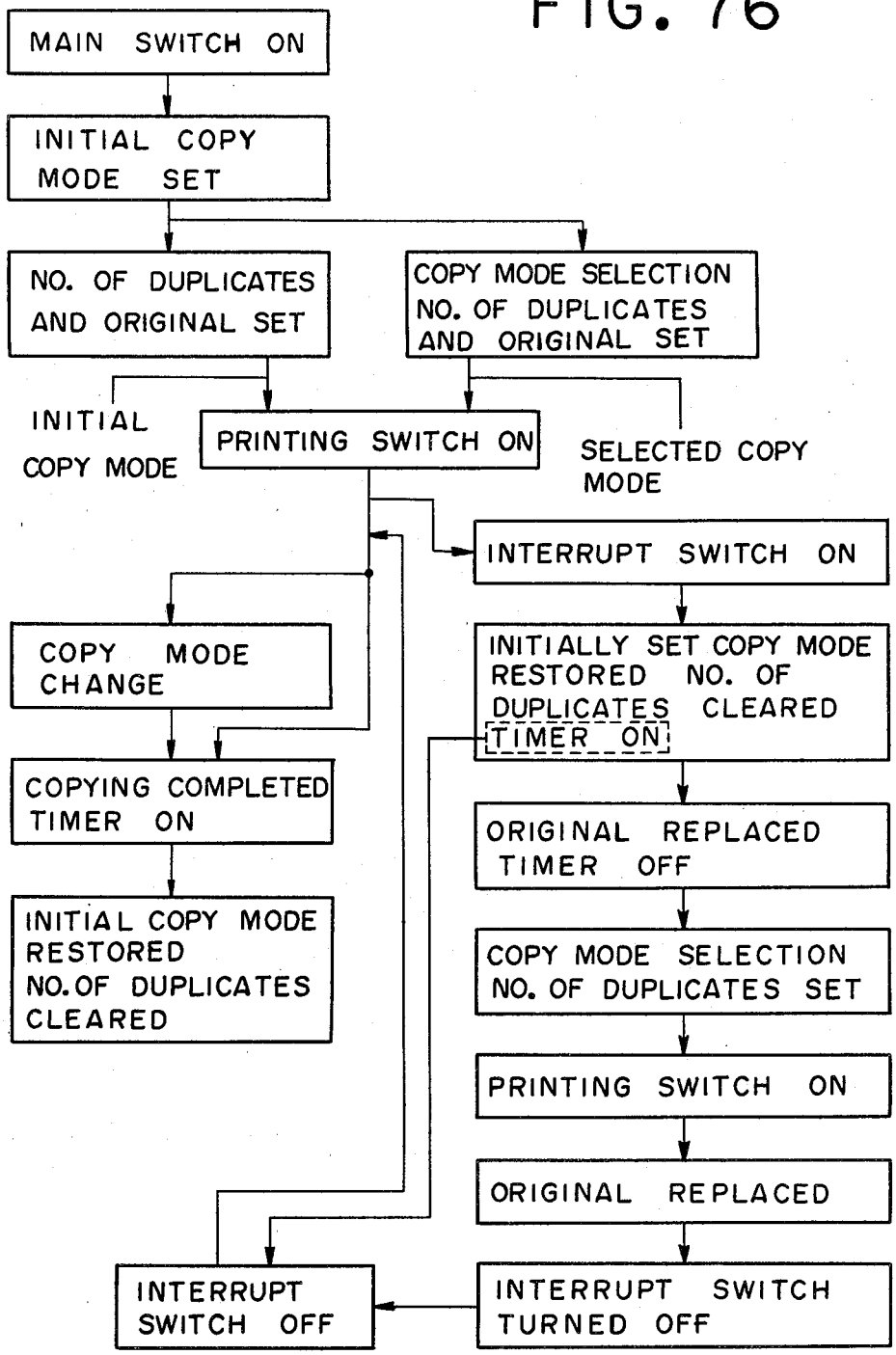
FIG. 76 is a flow chart of one example of the copying apparatus operated by the operation panel shown in FIG. 75.

For controlling the operation of the copying apparatus shown in FIG. 26 to carry out switching of the copying apparatus from one copying mode to another according to the flow chart shown in FIG. 76 with the copying conditions shown in Table 5, there is provided in the control section an initially setting device 50 shown in FIG. 74 which may be a switching device, such as a rotary change-over switch, having five switching terminals. By actuating such initially setting device 50, the copying apparatus is initially set so that one of five copying modes is selected in which the entire image of an original is duplicated in black, for example. Upon turning on the main switch of the copying apparatus, the control section is brought to a condition in which copying steps are followed to carry out the copying mode for which the copying apparatus is initially set. An operation panel 51 shown in FIG. 75 is provided with a copying mode selection device 52 including five pushbuttons 52*a*, 52*b*, 52*c*, 52*d* and 52*e*, for example. There is also provided a copying mode indicating device 53 including first five indicating members 54 and five second indicating members 55, each pair of first and second indicating members 54 and 55 being associated with one of five pushbutton 52*a*, 52*b*, 52*c*, 52*d* and 52*e*. Each pair of first and second indicating members 54 and 55 constitutes one of five indicating sections 53*a*, 53*b*, 53*c*, 53*d* and 53*e* formed on the white background, and the first and second indicating members 54 and 55 of each pair indicates different colors corresponding to the selected copying mode. When the selected copying mode selection pushbutton 52*a* represents a two-color copying mode, for example, the first indicating member 54 and second indicating member 55 associated with the pushbutton 52*a* are shown in black and red colors respectively. Likewise, when the copying mode selection pushbuttons 52*b* represents a black color copying mode, the first indicating member 54 and second indicating member 55 associated with the pushbutton 52*b* are both shown in black. When the copying mode selection pushbutton 52*c* represents a red color copying mode, the first indicating member 54 and second indicating member 55 associated with the pushbutton 52*c* are both shown in red. When the copying mode selection pushbutton 52*d* represents a red color erasing copying mode, the first indicating member 54 is indicated in red and the second indicating member 55 is either shown in white or erased. When the copying mode selection pushbutton 52*e* represents a black color erasing copying mode, the first indicating member 54 is erased or shown in white and the second indicating member 55 is shown in red. The manner in which the first and second indicating members 54 and 55 are indicated is not limited to the specific form of the embodiment shown and described, and any other suitable system of indication may be adopted. The order in which the copying modes are indicated by the indicating members is not limited to the specific form of the embodiment shown and described.

The indicating sections 53*a*–53*e* are shown as being disposed outside the copying mode selection pushbuttons 52*a*–52*e* in FIG. 75. The invention is not limited to this specific arrangement of the indicating sections 53*a*–53*e*, and the indicating sections 53*a*–53*e* may be disposed on the surfaces of the copying mode selection pushbuttons 52*a*–52*e*, respectively.

In order than the control section may clearly indicate the copying mode that can be carried out, an indicating lamp 56 is mounted on each of the mode selection pushbuttons 52*a*–52*e*. The indication lamps 56 may illuminate the surfaces of either the mode selection pushbuttons 52*a*–52*e* or the indication sections 53*a*–53*e*.

When initial seeting of the desired copying mode is effected and the main switch is turned on, the indicating lamp 56 that indicates the initially selected copying mode is turned on. For example, when the black clock copying mode is initially selected with the copying mode selection pushbuttons 52 being arranged as aforesaid, the indicating lamp 56 illuminating the copying mode selection pushbutton 52*b* or the indicating section 53*b* is turned on.

When copying is carried out in the initially selected copying mode, a copying operation is performed without making any alteration. However, when it is desired to carry out copying in other copying mode than the initially selected copying mode, one of the copying mode selection pushbuttons 52*a*–52*e* corresponding to the desired copying mode is depressed, so that the control section supplied a signal to an input and output section to actuate switches, a solenoid SOL and a clutch C. This switches the copying apparatus, such as the one shown in FIG. 26, to the desired copying conditions. At the same time, a signal is supplied from the control section through an operation section to turn on the indicating lamp 56 corresponding to the desired copying mode.

The operation panel 51 includes a sheet size indicating section 57 comprising an upper sheet feeding section indicating one size of copy sheets, a lower sheet feeding section indicating another size of copy sheets, and a sheet feeding section indicating the size of copy sheets now ready for feeding. By depressing an upper sheet indicating key 58*a* or a lower sheet indicating key 58*b*, the desired size of copy sheets can be selected. Then the desired color density is selected by actuating a black-white color density adjusting lever 59 or a red-black color density adjusting lever 60, and the number of duplicates to be produced is selected by actuating a duplicate number selecting key assembly 61. Thereafter, by depressing a printing switch 62, a signal can be supplied from the operation section to the input and output section through the control, to thereby actuate a motor M and other movable parts to start a copying operation.

The operation panel 51 further mounts thereon a misfeeding indicating lamp 63 for indicating misfeeding, such as sheet jam, a toner replenishing lamp 64 indicating that the developing device has run out of toner, a sheet replenishing lamp 65 indicating that the sheet feeding selection has run out of sheets, and other lamps necessary for indicating troubles. Thus the conditions of the copying apparatus are indicated by the respective lamps on the indication panel 51 through the control and operation section.

After the number of duplicates to be produced is selected by actuating the duplicate number selecting key assembly 61, the predetermined copying steps are followed, and the number of duplicates produced is indicated by a duplicate number indicating section 66 either by adding each duplicate produced to the number of duplicates already produced or by substracting each duplicate produced from a predetermined number of duplicates to be produced. The predetermined number of duplicates to be produced. The predetermined number of duplicates to be produced that has been selected can be temporarily indicated in the duplicate number indicating section 66 by depressing a selected duplicate number confirming key R of the duplicate number selecting key assembly 61 any time as desired including the time during which copying is in progress.

Upon completion of production of the number of duplicates selected by actuating the duplicate number selecting key assembly 61, a timer or any other suitable means is actuated in the control, and automatic restoring means mounted in the control is actuated after lapse of a time at which the timer or other suitable means is set irrespective of the type of the selected copying mode. Thus the copying apparatus is automatically restored to the initially selected copying mode and the indicating lamp 56 for the initially selected copying mode is turned on. At the same time, the number of duplicates indicated in the duplicate number indicating section 66 is cleared.

While a copying operation is being performed, it may become necessary to make an interrupt so that a breake is caused to the copying operations in progress to give place to another urgent copying operation that requires immediate attention. To this end, an interrupt switch 67 is actuated to turn it on so that the operation section supplies a signal to the control to actuate the automatic restoring means in the control for restoring the copying apparatus to the initially selected copying mode and clearing the number of duplicates produced. At the same time, a timer is actuated. The timer is deactuated when the pressing plate is opened to replace the original being reproduced by a new original and closed after completion of the replacing. Then the desired copying mode and the number of duplicates to be produced are selected by depressing the respective pushbuttons. After the printing switch is turned on, an interrupt copying operation is initiated.

Upon completion of the interrupt copying operation, the originals are replaced again and the interrupt switch is reset to actuate interrupted program resuming means in the control section, so that the copying can be resumed in the copying mode and at the number of duplicates produced prevailing before the interrupt is made from the point at which the break occurred.

When the interrupt switch 67 is turned on, the timer is actuated and the operation of replacing the originals is sensed as by detecting the movement of the pressing plate in a predetermined period of time. In the event that this does not take place, the interrupted program cancelling means in the control is actuated to resume the provided copying operation from the point at which the break occurred.

When it is desired to alter the copying mode during a copying operation, the copying mode selecting pushbutton corresponding to the desired copying mode is depressed. The control operates such that the copying operation is continued until the cycle of the copying process is finished. Upon completion of the cycle, a signal is produced by the control to switch the copying apparatus to the desired new copying mode and continue copying in the new copying mode while the number of duplicates produced in the new copying mode is added to the total of the duplicates produced in the old copying mode.

The copying mode indicating lamp corresponding to the desired new copying mode is turned on immediately after the switching of the copying apparatus from the old copying mode to the new copying mode is effected.

When the number of duplicates produced is cleared in the aforesaid operation, the number of duplicates selected by the duplicate number selecting key assembly 61 generally returns to 1. Unless the number of duplicates to be produced is selected for the next copying operation when the number of duplicates is not added to the number of duplicates produced in the old copying mode, copying is effected for producing one duplicate in the new copying mode.

It may be desired to produce duplicates of an original in several copying modes. The desired copying mode and the numbers of duplicates to be produced in several copying modes may be fixed beforehand for one original. To avoid the trouble of effecting the selection of the copying modes and the number of duplicates for each copying mode, a programming device may be mounted in the control. Programming may be carried out as follows, as an example. The copying mode selecting pushbuttons 52*a*–52*e* are depressed to select the copying modes and the numbers of duplicates to be produced are selected by actuating the duplicate number selecting key assembly 61, before a programming button 68 is depressed. This operation is repeated for each of the desired copying modes. For example, the original to be duplicated may be comprised of information in black color and remarks in red color. When two duplicates of this original are required in black and red colors and five duplicates thereof are desired in which the information in black color only is reproduced while the remarks in red color are erased, the black color copying mode is selected by depressing the copying mode selecting pushbutton 52*b* (when the black color copying mode is the initially selected copying mode this operation is dispensed with) and the number 'two' is selected for the duplicates to be produced by actuating the duplicate number selecting key assembly 61 before the programming button 68 is depressed. Then the red color copying mode is selected by depressing the copying mode selecting pushbutton 52*d* and the number 'five' is selected for the duplicates to be produced before the programming button 68 is depressed. Thus the copying apparatus is programmed for the desired copying modes.

As the original is placed in the predetermined position and a program printing switch 69 is turned on, copying is carred out as programmed. Following completion of the copying operation, the copying apparatus is restored to the initial condition after lapse of a predetermined time, in the same manner as no programming is performed.

Upon the program printing switch 69 being turned on. a lamp indicating the program printing is turned on. The control is constructed such that alteration of the copying modes by means of the copying mode selecting pushbuttons 52 is not effected white program printing is being carried out.

The control section can be constructed such that in the event that the program printing switch 69 is turned on when the copying apparatus is not programmed, no copying operation may be performed or copying may be carried out in the copying mode indicated and at the number of duplicates selected.

A program may be cleared by using a program clearing switch in such a manner that the number of duplicates is cleared when such switch is actuated for the first time and the program is cleared when it is actuated for the second time. Clearing may be obtained when the copying apparatus is restored to the initial condition after lapse of a predetermined time. It is also possible to clear a program when the program button is depressed following completion of a copying operation and replace the old program by a new one.

What is claimed is:

1. A two color copying apparatus comprising a single copying apparatus to produce copy sheet duplicates of an original of two colors and a white region with the copy sheet duplicates having two colors and a white region in the same areas corresponding to the areas of the original, the apparatus including a photoconductive material around which is arranged a charging unit, an exposure unit, a developing unit having two sections one of which is adapted to one color development and the other is for another color development, a transfer unit for transferring a toner image from said photoconductive material to copy sheet, and a cleaning unit, characterized in that switch means is provided for selecting a copy mode in which duplication is performed, the switch means including control means to actuate certain combinations of the aforementioned units and sections to obtain the two-color copying mode, in which both colors of the original are copied using two colors on the copy sheet, one color copying mode in which both colors of the original are copied using one color on the copying sheet or erasable mode in which one of the two colors of the original is not duplicated on the copy sheet while the other color is duplicated on the copy sheet.

2. A two-color copying apparatus according to claim 1 wherein one section of the development unit is a black toner section for reproducing the black image of the original.

3. A two-color copying apparatus according to claim 1 wherein said one color mode is the black color reproduction mode in which the two-color original is reproduced into a black color image.

4. A two-color copying apparatus according to claim 1 wherein said one color mode is the red color mode.

5. A two-color copying apparatus according to claim 2 wherein the black image of the original is reproduced, and the areas of the latent image corresponding to the other color are erased.

6. A two-color copying apparatus according to claim 2 wherein the black image of the original is erased and the areas of the latent image corresponding to the other color are red and reproduced.

7. A two-color copying apparatus according to claim 1, wherein the control means comprises means for indicating the selected copying mode and means for automatically restoring the copying apparatus to the copying mode and the number of duplicates to be produced at which the copying apparatus is initially set when a main switch of the copying apparatus is turned on, following lapse of a predetermined period of time after a copying operation is completed or when an interrupt occurs while a copying operation is being performed.

8. A two-color copying apparatus as claimed in claim 7 further comprising means for switching the copying apparatus, when a command is given by means of a copying mode selecting pushbutton to switch the copying apparatus to another copying mode while a copying operation is being performed, to the newly selected copying mode from the time the next following copying process following the acceptance of the command is initiated.

9. A two-color copying apparatus as claimed in claim 7 further comprising means for actuating interrupt indicating means and a timer when an interrupt occurs while a copying operation is being performed and allowing the copying apparatus to resume the original copying mode and continue counting or the produced duplicates by the timer from the point at which the break occured, in the absence of opening and closing of a pressing plate or an action associated with opening and closing of the presseing plate in a predetermined period of time.

10. A two-color copying apparatus according to claim 1 wherein the photoconductive material comprises a conductive substrate, a first photoconductive layer and a second photoconductive layer of which said first and second photoconductive layers have different sensitivity to color, and a first charger and a second charger in said charging unit which are arranged for forming the bipole image on the surface of the photoconductive material.

11. A copying method using a single copying apparatus for producing copy sheet duplicates of an original of two colors for $\alpha$ and $\beta$ and a white region by using a composite photosensitive member, said photosensitive member including more than two layers, at least two layers being primarily sensitive to different chromatic colors of visible light, the method comprising the steps, in sequence, of:

subjecting the photosensitive member to more than two charging operations in sequence to change its charged condition; and imparting to the photosensitive member signals corresponding to image regions of colors $\alpha$ and $\beta$ and the white regions of the original and selectively forming on the photosensitive member one of two types of electrostatic latent images corresponding to the signals imparted thereto, one type of electrostatic latent image including image regions of positive polarity, negative polarity and approximately zero polarity and the other type of electrostatic latent image including image regions of a higher potential, a lower potential of the same polarity, and a potential of approximately zero; and selecting one mode of the following developing and transfer-printing copying modes for producing a duplicate on a coppy sheet; producing duplicates of the original in one of the two colors, two of the two colors, and by erasing image portions of one color.

* * * * *